US008258079B2

(12) United States Patent
Yokozawa et al.

(10) Patent No.: US 8,258,079 B2
(45) Date of Patent: Sep. 4, 2012

(54) HEAT-SENSITIVE TRANSFER SHEET

(75) Inventors: Akito Yokozawa, Minami-ashigara (JP); Shinichi Teramae, Minami-ashigara (JP); Naotsugu Muro, Minami-ashigara (JP); Hisato Nagase, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 441 days.

(21) Appl. No.: 12/570,424

(22) Filed: Sep. 30, 2009

(65) Prior Publication Data

US 2010/0101714 A1 Apr. 29, 2010

(30) Foreign Application Priority Data

Sep. 30, 2008 (JP) ..... 2008-254800
Sep. 30, 2008 (JP) ..... 2008-254801
Sep. 30, 2008 (JP) ..... 2008-254803

(51) Int. Cl.
*B41M 5/035* (2006.01)
*B41M 5/39* (2006.01)

(52) U.S. Cl. ..... 503/227; 428/32.66

(58) Field of Classification Search ..... None
See application file for complete search history.

(56) References Cited

U.S. PATENT DOCUMENTS 7,122,504 B2 * 10/2006 Watanabe et al. ..... 503/227

FOREIGN PATENT DOCUMENTS

| | | | |
|---|---|---|---|
| EP | 0 523 623 | A1 | 1/1993 |
| EP | 0 577 051 | A1 | 1/1994 |
| EP | 0 820 875 | A1 | 1/1998 |
| EP | 2 030 798 | A2 | 3/2009 |
| EP | 2 042 334 | A2 | 4/2009 |
| JP | 62-227787 | A | 10/1987 |
| JP | 6-19033 | B2 | 3/1994 |
| JP | 8-90942 | A | 4/1996 |
| JP | 9-99656 | A | 4/1997 |
| JP | 2655544 | B2 | 5/1997 |
| JP | 11-58989 | A | 3/1999 |
| JP | 2003-154763 | A | 5/2003 |
| JP | 3596922 | B2 | 9/2004 |
| JP | 2005-178210 | A | 7/2005 |
| JP | 2007-190909 | A | 8/2007 |
| JP | 2008-94017 | A | 5/2008 |
| JP | 2010-83001 | A | 4/2010 |

OTHER PUBLICATIONS

European Office Action based on European Application No. 09 012 393.6-1251 dated Mar. 18, 2011.

* cited by examiner

*Primary Examiner* — Bruce H Hess
(74) *Attorney, Agent, or Firm* — Sughrue Mion, PLLC

(57) ABSTRACT

A heat-sensitive transfer sheet, having:
a base film;
a dye layer; and
a heat-resistant lubricating layer;
wherein the heat-resistant lubricating layer contains a specific compound, and wherein, when a characteristic X-ray intensity originated from K-line of phosphorus element in the heat-resistant lubricating layer is measured with respect to each points within a 200 μm square region, the largest value of the characteristic X-ray intensity is at least 2.5 times or more relative to the smallest value of the characteristic X-ray intensity within the 200 μm square region, and a plurality of maximum regions having a maximum value of the characteristic X-ray intensity exist in the 200 μm square region, and a variation coefficient that is obtained by dividing a standard deviation of the maximum values of the characteristic X-ray intensity among these maximum regions with an average value of the characteristic X-ray intensities is 0.25 or less.

17 Claims, No Drawings

HEAT-SENSITIVE TRANSFER SHEET

FIELD OF THE INVENTION

The present invention relates to a heat-sensitive transfer sheet. Specifically, the present invention relates to a heat-sensitive transfer sheet capable of providing an image having less image defects due to reduction in stretch of the heat-sensitive transfer sheet that occurs at the time of high-speed printing, and also capable of providing a print having less discoloration due to suppression of dye transfer from a dye layer to a heat-resistant lubricating layer, in a case where the heat-sensitive transfer sheet is stored in a roll form.

Further, the present invention relates to a heat-sensitive transfer sheet conspicuously improved in a head stain that occurs when the heat-sensitive transfer sheet having been stored over time is used to print in running.

Further, the present invention relates to a heat-sensitive transfer sheet capable of forming a high-quality image due to both achievement of high density and conspicuous improvement of kickback.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

In the dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated, for example, by a thermal printer head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In recent years, various printers allowing higher-speed printing have been developed and commercialized increasingly in the field of the dye-diffusion transfer recording systems. The high-speed printing is a performance desirable for shortening the time of the user waiting for printing in photo shop.

In order to prevent thermal sticking between a thermal printer head of a printer and a heat-sensitive transfer sheet and to give the thermal printer head and the ink sheet a slipping property therebetween, a heat-resistant lubricating layer is formed on the heat-sensitive transfer sheet surface contacting the thermal printer head. The thermal sticking may cause a break of the heat-sensitive transfer sheet when an image is printed. On the other hand, in a case where the slipping property is insufficient, the heat-sensitive transfer sheet may be stretched or creased, or deformed into some other form when an image is printed. As a result, an image defect may be caused. According to high-speed printing, a thermal printer head comes to contact the heat-resistant lubricating layer at a higher temperature and a higher speed. Thus, the heat-resistant lubricating layer is desired to have even better performances.

For example, JP-A-8-90942 ("JP-A" means unexamined published Japanese patent application) discloses that phosphoric acid ester series surfactants are added to the heat-resistant lubricating layer in order to improve a lubricating (slipping) property. Further, Japanese Patent No. 2655544 discloses that zinc salts of specific phosphoric acid ester are added to the heat-resistant lubricating layer to give a lubricating property.

Ordinarily, these heat-sensitive transfer sheets are stored as such a product form that the heat-sensitive transfer sheet is prepared by coating a dye layer on or above a base film, followed by drying, and then once stored as a roll form, and subsequently the heat-sensitive transfer sheet is taken out from the roll and cut into a sheet having a desired width, and then rewound in a roll form which is then set in a printer.

Accordingly, in this product form, the heat-resistant lubricating layer and the dye layer are left to stand over time in the state that these layers contact each other. For this reason, a dye of the dye layer is transferred to the heat-resistant lubricating layer over time, and thereafter if a printing is performed, the heat-resistant lubricating layer with a dye adhered thereto is heated with a thermal head at the time of print. Therefore, if the printing is continued in large numbers, thermally decomposing materials of the dye accumulate as a stain of the thermal head, finally, the materials eventually causes a problem of viewing surface defect at the time of print.

On the other hand, the study of the heat-resistant lubricating layer has been previously carried out. For example, as mentioned above, JP-A-8-90942 describes that phosphoric acid ester-series surfactants are added to the heat-resistant lubricating layer in order to improve a lubricating property. Further, Japanese Patent No. 2655544 discloses that zinc salts of specific phosphoric acid ester are added to the heat-resistant lubricating layer to give a lubricating property. Further, the study of the dye that is used in the dye layer has been previously carried out. For example, in JP-B-6-19033 ("JP-B" means examined Japanese patent publication), the study of a yellow dye having a specific structure is disclosed.

However, the heat-sensitive transfer sheets described in these patent literatures are not necessarily satisfied to resolve the aforementioned problems. Therefore, improvement of the heat-sensitive transfer sheets has been earnestly desired.

Further, various methods whereby a high-quality image can be obtained are previously proposed. For example, Japanese Patent No. 3596922 discloses a specific dye having high transferability (high-transferable dye) whereby a high density can be obtained. However, a problem arises such that a scumming owing to a kickback is likely to occur as a result of using the high-transferable dye. Herein, the term "kickback" is such a phenomenon that, during storage of the roll-formed heat-sensitive transfer sheet produced by coating a dye layer on or above a base film, the dye transfers to a heat-resistant lubricating layer (this step is called "kick"), and when the heat-sensitive transfer sheet is rewound in order to process it into a product form, the dye transferred to the heat-resistant lubricating layer transfers back to the dye layer or a protective layer (this step is called "back"). If the dye layer or the protective layer is stained owing to the kickback, image quality conspicuously deteriorates due to change of color hue and scummimg of a white background. Therefore, improvement of the heat-sensitive transfer sheet has been earnestly desired.

As to the technique of resolving the kickback problem, for example, JP-A-2003-154763 discloses that a compound capable of chelate-reacting with a thermally transferable dye is contained in a back layer. However, this compound is decomposed by heat at the time of printing, and the decomposed material accumulates as a stain of the thermal printer head. As a result, this compound tends to cause such a problem that viewing surface defects occur. Therefore, another technique for resolving this problem has been required.

SUMMARY OF THE INVENTION

The present invention resides in a heat-sensitive transfer sheet, having:

a base film;

at least one dye layer containing at least one heat-transferable dye and a resin formed on one side of the base film; and a heat-resistant lubricating layer containing a lubricant and a resin formed on the other side of the base film;

wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

Further, the present invention resides in a method of forming an image, having the steps of:

superposing a heat-sensitive transfer sheet on a heat-transfer image receiving sheet; and applying thermal energy from a side of a heat-resistant lubricating layer described below of the heat-sensitive transfer sheet in accordance with an image signal, to form a thermally transferred image, wherein the heat-sensitive transfer sheet has a base film, at least one dye layer containing at least one heat-transferable dye and a resin formed on one side of the base film, and a heat-resistant lubricating layer containing a lubricant and a resin formed on the other side of the base film, wherein the heat-sensitive transfer image-receiving sheet has a support, and a heat insulation layer containing a hollow polymer latex, and a receptor layer containing a latex polymer on the support, wherein, in the superposing step, said at least one dye layer of the heat-sensitive transfer sheet is contact with the receptor layer of the heat-transfer image receiving sheet, wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

Other and further features and advantages of the invention will appear more fully from the following description.

DETAILED DESCRIPTION OF THE INVENTION

The study on improvement in performance of the heat-resistant lubricating layer at the time of high-speed print was carried out using phosphoric acid ester-series surfactants, or zinc salts of phosphoric acid. As a result, it was found that a stretch was particularly large for the heat-sensitive transfer sheet of from a first sheet to a fifth sheet under the conditions that print was resumed in 10 minutes or more of suspension (waiting time) of the printer after once print was finished. On the other hand, it was found that when the stretch of the ink sheet at the time of print was suppressed while maintaining a lubricating property between the thermal printer head and the heat-resistant lubricating layer, the dye was more likely to transfer from the dye layer to the heat-resistant lubricating layer.

When many images are continuously printed in accordance with orders of image reproduction from ordinary customers, occurrence of image defects is limited to from a first print to about a fifth print. However, in the case of self-service by which ordinary customers carry out print by themselves at a shop, print is quiet often resumed after the printer is waited for 10 minutes or more. Therefore, improvement is required whereby the aforementioned stretch is more effectively suppressed even though print is resumed after waiting time of the printer as mentioned above.

Meanwhile, in a manufacturing process of the heat-sensitive transfer sheet, the heat-sensitive transfer sheet is stored as such a product form that the heat-sensitive transfer sheet is prepared by coating a dye layer on or above a base film, followed by drying, and then once stored as a roll form, and subsequently the heat-sensitive transfer sheet is taken out from the roll and cut into a sheet having a desired width, and then rewound in a roll form which is then set in a printer. In these roll forms, the dye layer and the heat-resistant lubricating layer contact each other, and therefore a dye may transfer to the heat-resistant lubricating layer. In the roll form after drying, the dye transfers to the heat-resistant lubricating layer, and in the roll form of the product form, the dye having been transferred to the heat-resistant lubricating layer is further reversely transferred to the dye layer side. As a result, discoloration of the thus obtained print occurs owing to a difference between the predetermined setting and an actual amount of dye at the dye layer side or a position coated with dye. Further improvement of the heat-sensitive transfer sheet in terms of this point has been required.

According to the present invention, there is provided the following means:

(1-1) A heat-sensitive transfer sheet, having:

a base film;

at least one dye layer containing at least one heat-transferable dye and a resin formed on one side of the base film; and a heat-resistant lubricating layer containing a lubricant and a resin formed on the other side of the base film;

wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

(1-2) The heat-sensitive transfer sheet described in the above item (1-1), wherein the ratio of the largest value to the smallest value of the characteristic X-ray intensity is at least 3 times or more, and the coefficient of variation is 0.22 or less.

(1-3) The heat-sensitive transfer sheet described in the above item (1-1) or (1-2), wherein the melting point of at least one of the compounds represented by formula (P) contained in the heat-resistant lubricating layer is 40° C. to 100° C.

(1-4) The heat-sensitive transfer sheet described in any one of the above items (1-1) to (1-3), having a multivalent metal salt of alkyl carboxylic acid in the heat-resistant lubricating layer.

(1-5) The heat-sensitive transfer sheet described in any one of the above items (1-1) to (1-4), having talc particles in the heat-resistant lubricating layer.

(1-6) The heat-sensitive transfer sheet described in the above item (1-5), wherein the relationship between the content of the talc particles and the content of the compound represented by formula (P) is such the proportion that the content of the talc particles is 30 parts by mass or more, provided that the content of the compound represented by formula (P) is 100 parts by mass.

(1-7) The heat-sensitive transfer sheet described in any one of the above items (1-1) to (1-6), having an easy adhesion layer on at least one surface of the base film.

(1-8) The heat-sensitive transfer sheet described in any one of the above items (1-1) to (1-7), wherein the resin in the heat-resistant lubricating layer has two or more hydroxyl group at the end of polymer chain length of the resin or in a polymer structure of the resin.

(1-9) The heat-sensitive transfer sheet described in the above item (1-8), wherein the resin is a polyacrylpolyol resin.

(1-10) The heat-sensitive transfer sheet described in the above item (1-8) or (1-9), wherein the resin in the heat-resistant lubricating layer has cross-linking structure.

(1-11) The heat-sensitive transfer sheet described in the above item (1-10), wherein a crosslinking reaction for constructing the cross-linking structure of the resin is carried out in the temperature range from 40° C. to 53° C. and for a period from 1 day to 20 days.

(1-12) The heat-sensitive transfer sheet described in any one of the above items (1-1) to (1-11), wherein the heat-sensitive transfer sheet is used in combination with a heat-transfer image receiving sheet having a support and a heat insulation layer containing a hollow latex polymer and a receptor layer containing a latex polymer disposed on the support.

(1-13) A method of forming an image, having the steps of:

superposing a heat-sensitive transfer sheet on a heat-transfer image receiving sheet; and applying thermal energy from a side of a heat-resistant lubricating layer described below of the heat-sensitive transfer sheet in accordance with an image signal, to form a thermally transferred image, wherein the heat-sensitive transfer sheet has a base film, at least one dye layer containing at least one heat-transferable dye and a resin formed on one side of the base film, and a heat-resistant lubricating layer containing a lubricant and a resin formed on the other side of the base film, wherein the heat-sensitive transfer image-receiving sheet has a support, and a heat insulation layer containing a hollow polymer latex, and a receptor layer containing a latex polymer on the support, wherein, in the superposing step, said at least one dye layer of the heat-sensitive transfer sheet is contact with the receptor layer of the heat-transfer image receiving sheet, wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

(2-1) A heat-sensitive transfer sheet, having:

a base film;

a yellow dye layer containing at least one yellow dye formed on one side of the base film; and a heat-resistant lubricating layer containing a lubricant and a resin formed on the other side of the base film;

wherein at least one of said at least one yellow dye is represented by formula (1):

Formula (1)

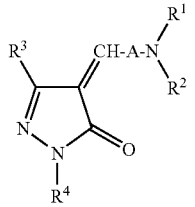

wherein A represents a substituted or unsubstituted phenylene group; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group or a substituted or unsubstituted aryl group;

wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

(2-2) The heat-sensitive transfer sheet described in the above item (2-1), wherein the ratio of the largest value to the smallest value of the characteristic X-ray intensity is at least 3 times or more, and the coefficient of variation is 0.22 or less.

(2-3) The heat-sensitive transfer sheet described in the above item (2-1) or (2-2), wherein the melting point of at least one of the compounds represented by formula (P) contained in the heat-resistant lubricating layer is 40° C. to 100° C.

(2-4) The heat-sensitive transfer sheet described in any one of the above items (2-1) to (2-3), having a multivalent metal salt of alkyl carboxylic acid in the heat-resistant lubricating layer.

(2-5) The heat-sensitive transfer sheet described in any one of the above items (2-1) to (2-4), having talc particles in the heat-resistant lubricating layer.

(2-6) The heat-sensitive transfer sheet described in the above item (2-5), wherein the relationship between the content of the talc particles and the content of the compound represented by formula (P) is such the proportion that the content of the talc particles is 30 parts by mass or more, provided that the content of the compound represented by formula (P) is 100 parts by mass.

(2-7) The heat-sensitive transfer sheet described in any one of the above items (2-1) to (2-6), having an easy adhesion layer on at least one surface of the base film.

(2-8) The heat-sensitive transfer sheet described in any one of the above items (2-1) to (2-7), wherein the resin in the heat-resistant lubricating layer has two or more hydroxyl group at the end of polymer chain length of the resin or in a polymer structure of the resin.

(2-9) The heat-sensitive transfer sheet described in the above item (2-8), wherein the resin is a polyacrylpolyol resin.

(2-10) The heat-sensitive transfer sheet described in the above item (2-8) or (2-9), wherein the resin in the heat-resistant lubricating layer has cross-linking structure.

(2-11) The heat-sensitive transfer sheet described in the above item (2-10), wherein a crosslinking reaction for constructing the cross-linking structure of the resin is carried out in the temperature range from 40° C. to 53° C. and for a period from 1 day to 20 days.

(2-12) The heat-sensitive transfer sheet described in any one of the above items (2-1) to (2-11), wherein the heat-sensitive transfer sheet is used in combination with a heat-transfer image receiving sheet having a support and a heat insulation layer containing a hollow latex polymer and a receptor layer containing a latex polymer disposed on the support.

(2-13) A method of forming an image, having the steps of:

superposing a heat-sensitive transfer sheet on a heat-transfer image receiving sheet; and applying thermal energy from a side of a heat-resistant lubricating layer described below of the heat-sensitive transfer sheet in accordance with an image signal, to form a thermally transferred image, wherein the heat-sensitive transfer sheet has a base film, a yellow dye layer containing at least one yellow dye formed on one side of the base film, and a heat-resistant lubricating layer containing a lubricant and a resin formed on the other side of the base film, wherein the heat-sensitive transfer image-receiving sheet has a support, and a heat insulation layer containing a hollow polymer latex, and a receptor layer containing a latex polymer on the support, wherein, in the superposing step, said at least one dye layer of the heat-sensitive transfer sheet is contact with the receptor layer of the heat-sensitive image receiving sheet, wherein at least one of said at least one yellow dye is represented by formula (1):

Formula (1)

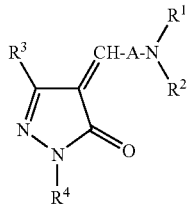

wherein A represents a substituted or unsubstituted phenylene group; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group or a substituted or unsubstituted aryl group;

wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

(3-1) A heat-sensitive transfer sheet, having:

a base film;

at least one dye layer containing at least one dye and a resin formed on one side of the base film; and a heat-resistant lubricating layer containing a lubricant and a resin formed on the other side of the base film;

wherein at least one of said at least one dye is represented by formula (2):

Formula (2)

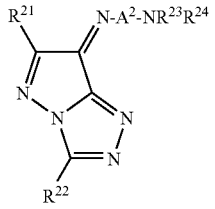

wherein $A^2$ represents a substituted or unsubstituted arylene group or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group;

wherein the content of said at least one heat-transferable dye represented by formula (2) is 20% by mass or more of the total amount of the dyes in the layer, wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

(3-2) The heat-sensitive transfer sheet described in the above item (3-1), wherein the ratio of the largest value to the smallest value of the characteristic X-ray intensity is at least 3 times or more, and the coefficient of variation is 0.22 or less.

(3-3) The heat-sensitive transfer sheet described in the above item (3-1) or (3-2), wherein the melting point of at least one of the compounds represented by formula (P) contained in the heat-resistant lubricating layer is 40° C. to 100° C.

(3-4) The heat-sensitive transfer sheet described in any one of the above items (3-1) to (3-3), having a multivalent metal salt of alkyl carboxylic acid in the heat-resistant lubricating layer.

(3-5) The heat-sensitive transfer sheet described in any one of the above items (3-1) to (3-4), having talc particles in the heat-resistant lubricating layer.

(3-6) The heat-sensitive transfer sheet described in the above item (3-5), wherein the relationship between the content of the talc particles and the content of the compound represented by formula (P) is such the proportion that the content of the talc particles is 30 parts by mass or more, provided that the content of the compound represented by formula (P) is 100 parts by mass.

(3-7) The heat-sensitive transfer sheet described in any one of the above items (3-1) to (3-6), having an easy adhesion layer on at least one surface of the base film.

(3-8) The heat-sensitive transfer sheet described in any one of the above items (3-1) to (3-7), wherein the resin in the heat-resistant lubricating layer has two or more hydroxyl group at the end of polymer chain length of the resin or in a polymer structure of the resin.

(3-9) The heat-sensitive transfer sheet described in the above item (3-8), wherein the resin is a polyacrylpolyol resin.

(3-10) The heat-sensitive transfer sheet described in the above item (3-8) or (3-9), wherein the resin in the heat-resistant lubricating layer has cross-linking structure.

(3-11) The heat-sensitive transfer sheet described in the above item (3-10), wherein a crosslinking reaction for constructing the cross-linking structure of the resin is carried out in the temperature range from 40° C. to 53° C. and for a period from 1 day to 20 days.

(3-12) The heat-sensitive transfer sheet described in any one of the above items (3-1) to (3-11), wherein the heat-sensitive transfer sheet is used in combination with a heat-transfer image receiving sheet having a support and a heat insulation layer containing a hollow latex polymer and a receptor layer containing a latex polymer disposed on the support.

(3-13) A method of forming an image, having the steps of:

superposing a heat-sensitive transfer sheet on a heat-transfer image receiving sheet; and applying thermal energy from a side of a heat-resistant lubricating layer described below of the heat-sensitive transfer sheet in accordance with an image signal, to form a thermally transferred image, wherein the heat-sensitive transfer sheet has a base film, at least one dye layer containing at least one dye and a resin formed on one side of the base film, and a heat-resistant lubricating layer containing a lubricant and a resin formed on the other side of the base film, wherein the heat-sensitive transfer image-receiving sheet has a support, and a heat insulation layer containing a hollow polymer latex, and a receptor layer containing a latex polymer on the support, wherein, in the superposing step, said at least one dye layer of the heat-sensitive transfer sheet is contact with the receptor layer of the heat-sensitive image receiving sheet, wherein at least one of said at least one dye is represented by formula (2):

Formula (2)

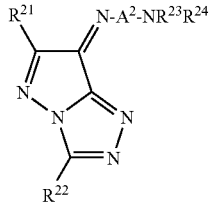

wherein $A^2$ represents a substituted or unsubstituted arylene group or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group, wherein the content of said at least one heat-transferable dye represented by formula (2) is 20% by mass or more of the total amount of the dyes in the layer, wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

Hereinafter, a first embodiment of the present invention means to include the heat-sensitive transfer sheets described in the above items (1-1) to (1-12), the method of forming an image described in the above item (1-13).

A second embodiment of the present invention means to include the heat-sensitive transfer sheets described in (2-1) to (2-12), the method of forming an image described in (2-13).

A third embodiment of the present invention means to include the heat-sensitive transfer sheets described in (3-1) to (3-12), the method of forming an image described in (3-13).

Herein, the present invention means to include all of the above first, second, and third embodiments, unless otherwise specified.

The present invention will be explained in detail below.

1) Heat-Sensitive Transfer Sheet (Structure of Heat-Sensitive Transfer Sheet (Ink Sheet))

The ink sheet is used to transfer a dye (colorant) from the ink sheet to a heat-sensitive transfer image-receiving sheet in the following manner: when a thermally transferred image is formed, the ink sheet is put onto the heat-sensitive transfer image-receiving sheet and then the sheets are heated from the ink sheet side thereof by means of a thermal printer head or the like. The ink sheet of the present invention has a base film, a dye layer (hereinafter also referred to as heat transfer layer or heat-sensitive transfer sheet) containing a heat-transferable dye and a resin formed over one surface of the base film, and a heat-resistant lubricating layer containing a lubricant and a resin formed over the other surface of the base film. An easy-adhesive layer (primer layer) may be formed between the base film and the dye layer and/or between the base film and the heat-resistant lubricating layer.

(Heat-Resistant Lubricating Layer)

In the present invention, phosphoric acid ester having an OH group(s) or a salt of phosphoric acid ester is contained as a lubricant in the heat-resistant lubricating layer.

Preferable embodiments of the phosphoric acid ester having an OH group(s) or the salt of phosphoric acid ester are exemplified below. However, the present invention is not limited to these embodiments.

(Phosphoric Acid Ester Having OH Group)

The phosphoric acid ester having an OH group(s) that is used in the present invention is an ester in which with respect to three OH groups per molecule of the phosphoric acid, one OH group is esterified (mono ester), or two OH groups are esterified (di ester), and an unesterified OH group(s) (hydroxyl group(s)) is remaining.

(Salt of Phosphoric Acid Ester)

The salt of phosphoric acid ester that is used in the present invention is a compound in which with respect to three OH groups bonded to phosphorus atom per molecule of the phosphoric acid, one OH group is esterified (mono ester), or two OH groups are esterified (di ester), and one hydrogen atom of the unesterified OH group is substituted with a metal ion or an ammonium ion.

As the phosphoric acid ester having an OH group(s) or the salt of phosphoric acid ester, compounds represented by the following formula (P) are preferable.

$$\{(R^{1a}O)(R^{2a}O)P(=O)O\}_m M \qquad \text{Formula (P)}$$

In formula (P), M represents a hydrogen atom, a metal ion, or an ammonium ion; $R^{1a}$ represents a aliphatic group or a aryl group; $R^{2a}$ represents a hydrogen atom, a metal ion, an ammonium ion, a aliphatic group, or an aryl group; the aliphatic group and the aryl group may have a substituent; m has the same valence as that of M and represents a number of from 1 to 6.

Examples of the substituents with which the aliphatic group or the aryl group may be substituted include an aliphatic group (an alkyl group, an alkenyl group, an alkynyl group, a cycloalkyl group, a cycloalkenyl group, a cycloalkynyl group, and the like), an aryl group (a phenyl group, a naphthyl group, and the like), a heterocyclic group, a halogen atom, a hydroxyl group, an alkoxy group, an alkenoxy group, a cycloalkoxy group, a cycloalkenoxy group, an aryloxy group, a heterocyclic oxy group, a mercapto group, an alkylthio group, an alkenylthio group, an arylthio group, an amino group, an alkylamino group, an aryl amino group, a heterocyclic amino group, an acylamino group, a sulfonamide group, an imido group, a cyano group, a nitro group, a carboxyl group, a sulfo group, a carbamoyl group, and a sulfamoyl group.

Examples of the aliphatic group for $R^{1a}$ or $R^{2a}$ include an alkyl group, an alkenyl group, an alkynyl group, a cycloalkyl group, a cycloalkenyl group, and the like. Examples of the aryl group for $R^{1a}$ or $R^{2a}$ include a phenyl group, a naphthyl group, and the like. Further, these substituents may be substituted with these substituents.

$R^{1a}$ preferably an aliphatic group. Among aliphatic groups, an alkyl group and an alkenyl group are preferable. $R^{2a}$ is preferably a hydrogen atom, or an aliphatic group, and more preferably a hydrogen atom, an alkyl group or an alkenyl group. Further, these aliphatic group, alkyl group and alkenyl groups may be substituted with the above-recited substituents.

When $R^{1a}$ or/and $R^{2a}$ are an aliphatic group, the following group is preferable.

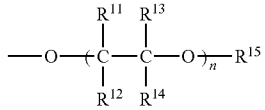

$R^{11}$ to $R^{14}$ each independently represent a hydrogen atom, or a substituent. Examples of the substituent include those groups that the aliphatic group and the aryl group for $R^{1a}$ and $R^{2a}$ in the above-described formula (P) may have. $R^{11}$ to $R^{14}$ each are preferably a hydrogen atom, or an alkyl group, and particularly a hydrogen atom is preferable. n represents the number of 0 to 20, and more preferably 1 to 8. $R^{15}$ represents an aliphatic group, or an aryl group.

The aliphatic group for $R^{15}$ is preferably an alkyl group, or an alkenyl group. These groups preferably have 6 to 20 carbon atoms, and more preferably 12 to 18 carbon atoms. Further, $R^{15}$ may have a substituent. Examples of the substituent include the substituents that the aliphatic group and the aryl group for $R^{1a}$ and $R^{2a}$ in the above-described formula (P) may have. The substituent is preferably an unsubstituted aliphatic group.

Examples of the aryl group for $R^{15}$ include a phenyl group, a naphthyl group, and the like. Further, the aryl group may have a substituent. Examples of the substituent include the substituents that the aliphatic group and the aryl group for $R^{1a}$ and $R^{2a}$ in the above-described formula (P) may have. Among them, the substituent is preferably an alkyl group. The alkyl group in this case preferably has 6 to 20 carbon atoms, and more preferably 12 to 18 carbon atoms.

$R^{15}$ is preferably an aliphatic group, and more preferably a stearyl group, or an oleyl group.

Further, the aliphatic group in which n is 0 is also preferable.

Among phosphoric acid esters having an OH group(s), phosphoric acid monoesters or diesters including an alkyl group having 12 to 18 carbon atoms are more preferable.

The metal ion for M and $R^{2a}$ may be a monovalent metal ion, or a polyvalent metal ion. As the monovalent metal ion, an alkali metal ion is preferable, a lithium ion, a sodium ion and a potassium ion are more preferable, and a sodium ion is most preferable. The polyvalent metal ion may be any kinds of polyvalent metal ions excluding alkali metal ions. Examples of the polyvalent metal ion include a magnesium ion, a calcium ion, a zinc ion, a cupper ion, a plumbum ion, an aluminum ion, an iron ion, a cobalt ion, a chromium ion, a manganese ion, and the like. Among these ions, a magnesium ion, a calcium ion, a zinc ion, and an aluminum ion are preferable. Particularly, a zinc ion is most preferable.

As the ammonium ion, those ions represented by the following formula are preferable.

$$^{+}N(R^{A1})(R^{A2})(R^{A3})(R^{A4})$$

In the formula, $R^{A1}$ to $R^{A4}$ each independently represent a hydrogen atom, an alkyl group which may have a substituent, or an aryl group which may have a substituent. Examples of the substituent include the substituents that the aliphatic group and the aryl group for $R^{1a}$ and $R^{2a}$ in the above-described formula (P) may have. Among these substituents, a hydroxyl group and a phenyl group are preferable. Further, any two or three groups of $R^{A1}$ to $R^{A4}$ may combine with each other to form a ring (for example, a pyrrolidine ring, a piperidine ring, a morpholine ring, a piperazine ring, an indoline ring, a quinuclidine ring, a pyridine ring).

$R^{A1}$ to $R^{A4}$ each are preferably a hydrogen atom or an alkyl group which may have a substituent.

As an ammonium ion, $NH_4^+$, $NH(CH_2CH_2OH)_3^+$, $NH_3(CH_2CH_2OH)^+$, morpholinium, $N(CH_2CH_2OH)_4^+$, and $NH_3(C_4H_9)^+$ are preferable, $NH_4^+$, $NH_3(CH_2CH_2OH)^+$, and morpholinium are more preferable.

In the present invention, a compound represented by the above-described formula (P) is contained as the phosphoric acid ester having an OH group(s) and/or the salt of phosphoric acid ester. These compounds may be used solely, or in combination of two or more species.

Many of these phosphoric acid esters are commercially available. Examples thereof include NIKKOL DLP-10, NIKKOL DOP-8NV, NIKKOL DDP-2, NIKKOL DDP-4, NIKKOL DDP-6, NIKKOL DDP-8, and NIKKOL DDP-10, (trade names, manufactured by Nikko Chemicals Co., Ltd.); PLYSURF AL, PLYSURF A208F, PLYSURF A208N, PLYSURF A217E, and PLYSURF A219B (trade name, manufactured by DAI-ICHI KOGYO SEIYAKYU Co., Ltd.); Phosphanol RB410, Phosphanol RB710, Phosphanol GF199, Phosphanol LP700, and Phosphanol LB400 (trade name, manufactured by TOHO Chemical Industry Co., LTD.); and Phoslex A-8, Phoslex A-18, and Phoslex A-18D (trade name, manufactured by Sakai Chemical Industry Co., Ltd.).

Other examples of the phosphoric acid ester include dilauryl phosphate, dioleyl phosphate, distearyl phosphate, and di(polyoxyethylene dodecyl phenyl ether) phosphate.

Many of these salts of phosphoric acid esters are commercially available. Examples of these commercial products include PLYSURF M 208B, PLYSURF M 208 F (trade name, manufactured by DAI-ICHI KOGYO SEIYAKU Co., Ltd.), Phosphanol RD 720, Phosphanol GF 185, Phosphanol GF 215, Phosphanol RS 710M, Phosphanol SC 6103 (trade name, manufactured by TOHO Chemical Industry Co., LTD.), LBT-1830, LBT-1830 purified product, LBT-2230, LBT-1813, and LBT-1820 (trade name, manufactured by Sakai Chemical Industry Co., Ltd.).

Other examples of the salts of phosphoric acid ester include zinc dilauryl phosphate, zinc dioleyl phosphate, distearylzinc phosphate, sodium di(polyoxyethylene nonyl ether)phosphate, sodium di(polyoxyethylene dodecyl phenyl ether) phosphate, sodium di(polyoxyethylene decyl phenyl ether) phosphate, sodium di(polyoxyethylene nonyl ether) phosphate, and potassium di(polyoxyethylene decyl phenyl ether)phosphate.

In the present invention, the total coating amount of the phosphoric acid ester having an OH group(s) and the salt of phosphoric acid ester is preferably from 1% by mass to 25% by mass, and more preferably from 2% by mass to 15% by mass, with respect to the total coating amount of the heat-resistant lubricating layer. Further, in the present invention, it is also preferable that the phosphoric acid ester having an OH group(s) or the salt of phosphoric ester is used in combination of two or more species. When these phosphoric acid ester having an OH group(s) and salt of phosphoric acid ester each are a solid, and have low solubility with respect to a coating liquid for the heat-resistant lubricating layer, or are difficult to dissolve in the coating liquid, it is preferable to preliminarily grind the solid to a fine powder in order to accelerate dispersion of the solid to the coating liquid for the heat-resistant lubricating layer, or to stabilize the solid in the coating liquid. The particle size of the powder is preferably from 0.1 μm to 100 μm, and more preferably from 1 μm to 30 μm.

Next, a method for measuring the characteristic X-ray intensity originated from K-line of phosphorus element in the heat-resistant lubricating layer that is specified in the present invention is described below.

(Characteristic X-Ray Intensity)

The method for measuring characteristic X-ray intensities is in principle a method of measuring intensities of the characteristic X-ray obtained by exciting atoms in a sample by irradiation with an electron beam. The method will be described in detail hereinafter.

(Electron Beam Radiation)

The electron beam to be radiated needs to receive an accelerating voltage of 20 kV and have a beam diameter of 1 μm or less in order to keep a necessary resolution certainly. Even if the accelerating voltage is made higher or lower, the intensity of the characteristic X-ray originating from the phosphorus element in a sample decreases and simultaneously base line noises increase. As a result, the intensity cannot be precisely measured. By the radiation of the beam, the electrons in the sample are scattered so that the spatial resolution of the X-ray image becomes larger than the beam diameter. The scattering of the electrons is varied in accordance with the kind of the element to be measured; in the present invention, the scattering distance in the depth direction is about 5 μm and that in the width direction is about 10 μm at an accelerating voltage of 20 kV. When the beam diameter is 1 μm or less, no difference in the spatial resolution is generated. In order to make the characteristic X-ray intensity to be measured large, the electric current amount is usually increased. However, the increase in the beam diameter simultaneously increases. A field emission electron gun is used as a source for the electrons since a larger electric current amount can be obtained and an increase in the beam diameter resulting from an increase in the electric current amount is small. The electric current amount is kept at a constant value since the amount is in proportion to the characteristic X-ray intensity.

(Characteristic X-Ray Measurement)

The method for the measurement includes wavelength dispersive X-ray spectrometry (abbreviated to "WDS" or "WDX") and energy dispersive X-ray spectrometry (abbreviated to "EDS" or "EDX"). Each of the spectrometries is a characteristic measuring method. In the present invention, the energy dispersive X-ray spectrometry is used since the spectrometry is excellent for analysis of microscopic areas and the analysis period is short. In the present invention, the measurement at a single spot can be attained in a period of about 1 to 10 minutes. The characteristic X-ray of any phosphorus element includes three species of the Kα1 line (2.014 keV), the Kα2 line (2.013 keV), and the Kβ1 line (2.139 keV); however, in the energy dispersive X-ray spectrometry, the individual rays overlap with each other so that the rays are detected as a single peak. For this reason, this is named the K-line. The intensity of the characteristic X-ray originating from the K-line of the phosphorus element, in the present invention, is the intensity of the K-line of phosphorus. In the case of measuring the intensities of the characteristic X-ray originating from the K-line of the phosphorus element at plural spots in a single sample, the measuring periods for the individual spots is preferably made equal to each other as well as the electric current amounts.

The measurement is preferably made by means of a device wherein a scanning electron microscope (abbreviated to an "SEM") is equipped with an energy dispersive X-ray spectrometer (abbreviated to an "SEM-EDX" or "SEM-EDS") since only a single electron beam source can be used for the microscope and the spectrometer and the positions of the measured spots can be checked.

Specifically, a sample is first measured with an SEM so as to check whether or not the focus of the electron beam is sufficiently adjusted. After a sufficient adjustment of the focus, the whole of the same area as measured with the SEM is scanned and measured with an EDX (energy dispersive X-ray spectrometer) so as to carry out element mapping of phosphorus. The element mapping with the EDX is a method of: measuring the intensity of the characteristic X-ray from the element at each spot in a short period while an electron beam is scanned; and then mapping the resultant characteristic X-ray intensities. From the intensity-mapped image, spots where the ratio of the amount of the contained phosphorus element is large and spots where the ratio is small can be selected. An electron beam is not scanned but fixed onto each of the selected spots to measure the intensity of the characteristic X-ray originating from the K-line of the phosphorus element. In this way, the intensities of the characteristic X-ray at each of the selected spots can be precisely measured.

Herein, when the thus-obtained intensity values are plotted in a three-dimensional space in which a plane (two-dimensional distance plane, X axis and Y axis at right angles to each other) is taken parallel to the support, and the characteristic X-ray intensity originated from K-line of phosphorus element is taken at the longitudinal axis (Z axis) perpendicular to the plane, peaks (their summits (highest points) are maximum values) and troughs (their bottoms (lowest points) are minimum values) of the intensity values are present.

In the present invention, the maximum region of the characteristic X-ray intensity includes at least one maximum value of the characteristic X-ray intensity (one summit of intensity values plotted in the aforementioned three-dimensional space). Further, the maximum region is a maximum region (a region including a portion ranging from the peak portion to the lowest portion (minimum value) of the trough) in which, relative to a low level point of the characteristic X-ray intensity (its minimum value is the aforementioned bottom) that is encompassing and adjacent to the point of the above-described maximum value, the maximum value (largest value) has a maximum value of the characteristic X-ray intensity of 1.5 times or more as much as the minimum value (smallest value). If the maximum value is less than 1.5 times relative to the minimum value, similar inspection is carried out in more enlarged region surrounding the peak. The distance plane is enlarged until the requirement of 1.5 times or more is met as described above. Thereby a maximum region, in which a relationship between the lowest point of the characteristic X-ray intensity (the lowest point in the maximum region) and the highest point of the characteristic X-ray intensity (the highest point in the maximum region) is a relationship of 1.5 times or more, is obtained. For this reason, each maximum regions of the characteristic X-ray intensity have a different distance plane area from each other, and a plurality of maximum values and minimum values (summits of peak and bottoms of trough) may be present in one maximum region of the characteristic X-ray intensity. In this way, the maximum region that meets the above-described requirement is defined as one maximum region of the characteristic X-ray intensity. In the measuring method used in the present invention, as mentioned above, the scattering of electron beams in the width direction is about 10 μm, and therefore in view of the spatial resolution, the distance between points showing a maximum value in the maximum region of the characteristic X-ray intensity is separated from by 4 μm or more.

Further, in the present invention, a maximum of the characteristic X-ray intensity (hereinafter, also referred to as "a maximum characteristic X-ray intensity") means the highest characteristic X-ray intensity (the largest value among one or a plurality of maximum values, namely the intensity value corresponding to the summit of the highest peak) measured in the above-described maximum region.

The largest value and the smallest value of the X-ray intensity originated from K-line of phosphorus element present in a 200 μm square region are the greatest value and the lowest value of the X-ray intensity in the 200 μm square region. Generally, the smallest value may be obtained by selecting total 10 to 20 points of low phosphorus element content, and irradiating electron beams to these selected points, and then measuring X-ray intensity. On the other hand, the largest value may be obtained by irradiating electron beams to each center of contained phosphorus-element-rich region, and then measuring X-ray intensity.

In the present invention, the contained phosphorus-element-rich region generally swell up. Therefore, the contained phosphorus-element-rich region may be roughly determined with reference to the region swelling up preliminarily specified by SEM measurement. In the present invention, accelerating voltage may be applied at 2 to 5 kV in order to carry out SEM measurement of surface shape.

(Preparation of Sample for Measurement)

When an electron beam is radiated to a sample so that the sample is electrified, the electron beam is fluctuated by an electric field generated by the electrification and further the electric current value of the electron beam is varied. Thus, a precise measurement cannot be attained. In order to prevent such an electrification, the sample surface is usually covered with an electroconductive thin film. The electroconductive thin film is preferably a coating formed by sputtering carbon (C) into a thickness of 20 to 35 nm.

Such preparation is described in more detail in "Hyoumen Bunseki Gizyutsu Sensyo (Surface Analyzing Technique Selected-Book) Electronic Probe/Microanalyzer" edited by the Surface Science Society of Japan and published by Maruzen Co., Ltd., 1998, and "EMPA Electron probe microanalyzer" written by Shiro Kinouchi and published by Gijutusyoin, 2001.

(Characteristic X-Ray Intensity Originated from K-Line of Phosphorus Element in Heat-Resistant Lubricating Layer)

In the present invention, with respect to the characteristic X-ray intensity originated from K-line of phosphorus element in each point of the heat-resistant lubricating layer that is measured according to the above-described method, the largest value of the characteristic X-ray intensity within the 200 μm square region is preferably 2.5 times or more (preferably 10.0 times or less), and more preferably 3.0 times or more (preferably 8.0 times or less), relative to the smallest value of the characteristic X-ray intensity within the 200 μm square region. The larger relative value indicates that the phosphoric acid esters having an OH group(s) or the salts of phosphoric acid ester is not uniformly present, but localized in the heat-resistant lubricating layer. In the present invention, there are plural regions in which the phosphoric acid esters having an OH group(s) or the salts of phosphoric acid ester are localized in the heat-resistant lubricating layer (the aforementioned maximum regions of the characteristic X-ray intensity, namely the regions having the maximum value of 1.5 times or more as much as intensity of the characteristic X-ray of the minimum value). The number of the maximum region is preferably 10 to 1,000, and most preferably 20 to 500, with respect to the 200 μm square region. It is preferable that a variation of the characteristic X-ray intensity originated from K-line of phosphorus element (the aforementioned maximum value of the characteristic X-ray intensity) corresponding to the region in which the phosphoric acid ester having an OH group(s) or the salt of phosphoric acid is localized, is small. A coefficient of variation (variation coefficient) (a calculation method is described below) corresponding to each region in which the phosphoric acid ester having an OH group(s) or the salt of phosphoric acid is present in the 200 μm square region and is localized is preferably 0.25 or less, more preferably 0.22 or less, and most preferably 0.20 or less. Further, among these regions in which the phosphoric acid ester having an OH group(s) or the salt of phosphoric acid is localized, the number of the regions having a maximum value of the characteristic X-ray intensity in the range of 0.7 times to 1.3 times as much as an average of maximum values of the characteristic X-ray intensity is preferably 80% or more, further preferably 90% or more, and most preferably 98% or more, relative to the total number.

The coefficient of variation of distribution can be obtained from an average of maximum values of the characteristic X-ray intensity and a standard deviation. The calculation formulae are described below.

(Average of maximum values of characteristic X-ray intensity)=(Total sum of maximum values of characteristic X-ray intensity)/(Total sum number of measurement) Numerical Formula (1)

(Standard Deviation)=a square root of {Sum from a square of [(Maximum value of each characteristic X-ray intensity)−(Average of maximum values of characteristic X-ray intensity)]/(Total sum number of measurement)} Numerical Formula (2)

(Coefficient of variation)=(Standard Deviation)/(Average of maximum values of characteristic X-ray intensity) Numerical Formula (3)

In the present invention, the phosphoric acid ester having an OH group(s) or the salt of phosphoric acid ester is used to give a lubricating property to a heat-resistant lubricating layer. In the first embodiment of the present invention, the lubricating property can be improved by increasing a content of the phosphoric acid ester having an OH group(s) or the salt of phosphoric ester in the heat-resistant lubricating layer whereby a stretch of the heat-sensitive transfer sheet at the time of high-speed print can be reduced. However, at the same time, a transfer of a dye to the heat-resistant lubricating layer increases. According to the first embodiment of the present invention, only if all requirements (i) to (iii) as described below are fulfilled, it is possible to achieve such an excellent effect that the stretch of the heat-sensitive transfer sheet at the time of high-speed print is reduced and also the transfer of the dye from a dye layer to the heat-resistant lubricating layer can be suppressed:

Requirement (i): As a result of measurement of a characteristic X-ray intensity originated from K-line of phosphorus element according to the above-described method, the ratio of the largest value to the smallest value of the characteristic X-ray intensity in the predetermined region as described above falls within the given range that is specified in the present invention;

Requirement (ii): There are two or more maximum regions each having a maximum value of the characteristic X-ray intensity originated from K-line of phosphorus element; and Requirement (iii): The value of the coefficient of variation that is obtained according to the above-described calculation formulae (1) to (3) with respect to a maximum value of the characteristic X-ray intensity falls within the given range that is defined in the present invention. Herein, to fulfill all such requirements (i) to (iii) is also called that the prescribed phosphoric acid ester having an OH group(s) or the salt of phosphoric acid fulfills the given distribution condition that is specified in the present invention.

In the second embodiment of the present invention, only if the prescribed phosphoric acid ester having an OH group(s) or the salt of phosphoric acid fulfills the given distribution condition that is specified in the present invention, it is possible to achieve such an excellent effect that even when a heat-sensitive transfer sheet after storage over time is used, occurrence of head stain owing to a running print can be suppressed.

In the third embodiment of the present invention, only if the prescribed phosphoric acid ester having an OH group(s) or the salt of phosphoric acid fulfills the given distribution condition that is specified in the present invention, it is possible to achieve such an excellent effect that a high density can be obtained and also the kickback can be conspicuously improved.

Next, a method of producing a coating liquid for a heat-resistant lubricating layer that is specified in the present invention is described.

The coating liquid for the heat-resistant lubricating layer is a liquid containing granulous regions in which materials are not dispersed in a molecular state. Accordingly, it is possible to use a production technique for pigment dispersion liquid that is used in the paint industry.

Generally, the production steps can be classified roughly into a dissolution step and a dispersion step. The dissolution step is a step of preparing a solution in which constituents that can be dissolved in a solvent for a coating liquid out of all constituents of the heat-resistant lubricating layer are dissolved. Generally, a step of dissolving a resin in an organic solvent is included in the dissolution step. The dispersion step is a step of mixing and dispersing the solution with other constituents of the heat-resistant lubricating layer that do not completely dissolve in a solvent for the coating liquid. It is often the case that the constituent that does not completely dissolve in the solvent for the coating liquid is a secondary-aggregation powder. Accordingly, the dispersion step includes: (1) a step of wetting the surface of the powder with the solution liquid; (2) a step of unstiffening or pulverizing aggregation powder to primary particles; and (3) a step of stabilizing the dispersed particles. In the step of (1), it is preferable that the surface of the powder is likely to get wet with the solution liquid. Further, because air on the surface of the powder is replaced by the solution liquid, high pressure or high shear force (shear stress) is preferable as a dispersion condition. In the step of (2), high shear force as a dispersion condition is necessary to unstiffen aggregation of the powder. In the step of (3), various additives may be added in order to prevent dispersed particles from reaggregating in the solution liquid, or in order to prevent dispersed particles from reaggregating even under the condition that a solvent has gone by heating after coating of a coating liquid. Ordinarily, the steps of (1) to (3) proceed simultaneously with each other in the same dispersing device. It is also preferable to add a step of preliminarily conducting the step of (1) (premixing). Further, when a resin is cured with a crosslinking agent to form a heat-resistant lubricating layer, a coating may be generally carried out in the manner that the crosslinking agent is added after dispersion and before coating.

As a dispersing device that is used for the dispersion, known devices may be used. For example, the 3-roll mill is a dispersing device in which dispersion is performed using both shear force and enforced pressure that effect at contact points among rolls having a different rotation speed from each other. Further, the sand mill and the beads mill are dispersing devices in which dispersion is performed using both impact force and shear stress that are obtained by agitating media such as glass beads and zirconia beads in a container. Because agitation of the media in the beads mill is carried out using gravity, there is a limitation to both impact force and shear stress. In contrast, attritor is a product that is improved so that strong impact force and shear stress can be obtained by forcibly agitating media by means of an arm that rotates media. As a small scale dispersing device, in addition to the above, there are a paint shaker in which a small-volume container is shaken to mix the content; a planetary-type beads mill that is improved so that strong impact force and shear stress can be obtained forcibly agitating media by means of rotation (spin) and revolution of a container at the same time, with respect to the limitation of impact force and shear stress of beads mill; and the like.

More detailed explanation is described in "Toryo no Ryudo to Ganryo Bunsan" (Fluidity of Paint and Pigment Dispersion), published by Kyoritsu shuppan Co, Ltd., 1992, "Toryo to Toso, Zohoban" (Paint and Coating, Enlarged Edition), published by POWERSHA Inc., 1994, "Nyuka/Bunsan no Riron to Jisai Riron Hen" (Theory and Practice of Emulsification and Dispersion, a chapter of theory), published by Tokushukagaku Kogyo K.K., 1997, and "Insatsu Inku Nyumon Kaiteiban" (Introductory Print Ink Revised Edition), published by Insatsugakkai Shuppanbu, Ltd., 2002.

In the present invention, the phosphoric acid ester having an OH group(s) or the salt of phosphoric ester that is used to give lubricating properties to the heat-resistant lubricating layer has a low solubility with respect to the solution liquid. Therefore, these compounds are present at the state of dispersed particles in the coating liquid for the heat-resistant lubricating layer. Further, it is considered that these compounds are also present at the state of dispersed particles in the heat-resistant lubricating layer that is formed by coating the coating liquid for the heat-resistant lubricating layer and then drying it. In the dispersion process, as described above, application of high shear force may accompany with heat generation, and further pulverization of primary particles may occur. To address the heat generation, it is possible to control temperature as a bulk by passing a heating medium into the outer wall of the container or the agitating blade. However, it is difficult to completely inhibit the heat generation at a microscopic interface between rolls causing shear force or a microscopic region of beads interface. Therefore, it is assumed that the phosphoric acid ester having an OH group(s) or the salt of phosphoric ester undergo the following steps: during dispersion steps, dissolving in the dispersion liquid by heat generation at the microscopic region of high-shear force; and resulting in deposition. In order to make the control of dispersion conditions easier by means of controlling the dissolution and the deposition, it is preferable to use at least one of phosphoric acid esters having an OH group(s) or salts of phosphoric ester having a melting point of 40° C. to 100° C., and more preferably from 50° C. to 90° C.

For the above reason, generally the conditions of the dispersed particles in the heat-resistant lubricating layer do not conform to particle size or shape of a powder that is used as a raw material. Further, the dispersion condition substantially varies depending on a composition of the coating liquid, a production scale, and a dispersing device, and therefore it is difficult to determine uniformly the dispersion condition. Accordingly, the dispersion state in the heat-resistant lubricating layer is specified by measuring the characteristic X-ray intensity in present invention.

In the present invention, the heat-resistant lubricating layer may contain other additives such as some other lubricant, a plasticizer, a stabilizer, a bulking agent, and a filler.

Examples of additives include fillers composed of inorganic materials such as fluorides (for example, calcium fluoride, barium fluoride, graphite fluoride), sulfides (for example, molybdenum disulfide, tungsten disulfide, iron sulfide), oxides (for example, silica, colloidal silica, lead oxide, alumina, molybdenum oxide), graphite, mica, boron nitride, magnesium oxide (magnesia), magnesium hydroxide (brucite), magnesium carbonate (magnecite), magnesium calcium carbonate (dolomite), clays (for example, talc, kaolin, acid clay); organic resins such as fluorine resins and silicone resin; silicone oil; polyvalent metal salts of alkyl carboxylic acid (for example, zinc stearate, lithium stearate), various kinds of waxes (for example, polyethylene wax, paraffin wax), and surfactants (for example, anionic-series surfactants, cationic-series surfactants, amphoteric surfactants, nonionic-series surfactants, fluorine-series surfactants). The particle size of the filler is preferably from 0.1 μm to 50 μm, and more preferably from 0.5 μm to 10 μm. As a particle shape of the filler, any shape such as an amorphous, spherical, cubic, needle-like, or tabular form may be used. Among these shapes, a needle-like form, or a tabular form is preferably used.

Among these additives that can be used in combination with the constituents in the heat-resistant lubricating layer, a magnesium oxide, a magnesium hydroxide, a talc, kaolin, and a polyvalent metal salt of alkyl carboxylic acid are preferable, and a magnesium oxide, a talc, and a polyvalent metal salt of alkyl carboxylic acid are more preferable. Of these polyvalent metal salts of alkyl carboxylic acid, zinc stearate is more preferable.

In order to obtain effects of the present invention more effectively, talc (talc particles), or a polyvalent metal salt of alkyl carboxylic acid is preferably used, and it is especially preferable to use talc (talc particles) together with a polyvalent metal salt of alkyl carboxylic acid.

The talc is a magnesium hydrous silicate mineral. A theoretical composition of the talc is $Mg_3Si_4O_{10}(OH)_2$. The talc has, as a unit structure, a three-layer structure in which a magnesium-containing layer is sandwiched between two layers each having a layer structure of silicate salt. On account that a bond between silicate salt layers in the unit structure is weak, the talc has a cleaving property whereby the talc is soft (Mohs hardness 1) and has a lubricating property. The talc does not decompose until round 900° C. and is inactive with respect to most chemicals. Therefore, the talc is a thermally and chemically stable material. With respect to the talc, there are two crystal systems of monoclinic system and triclinic system. In the present invention, either one of these crystal systems may be used. Further, a mixture of these crystal systems may be used.

Incorporation of the talc in the heat-resistant lubricating layer rarely occurs scratch of a thermal printer head because of softness of the talc. Further, the lubricating property of the talc suppresses stretch of the heat-sensitive transfer sheet, which results in less generation of wrinkles on the print. Further, since the talc is thermally and chemically stable, the use of talc is advantageous in that influence of fusion and corrosion on the thermal printer head are small.

As the talc, commercially available powder-shape talc originated from natural mineral may be used. Examples of the commercially available powder-shape talc include MICRO ACE series, and SG series manufactured by NIPPON TALC Co., Ltd., HI-filler Series manufactured by MATSUMURASANGYO Co., Ltd., PS series manufactured by Fukuoka Talc Co., Ltd., JET series manufactured by Asada Milling Co., Ltd., High toron series manufactured by TAKEHARA KAGAKU KOGYO Co., Ltd., and MV series manufactured by Nihon Mistron Co., Ltd. (each trade name). In the present invention, an average sphere-equivalent particle size of the talc particles is preferably from 0.5 μm to 10 μm, more preferably from 0.8 μm to 5 μm, and most preferably from 1 μm to 4 μm. The average sphere-equivalent particle size of the talc may be obtained according to laser diffraction scattering method.

In the present invention, the content of the talc in the heat-resistant lubricating layer is preferably 30 parts by mass or more, further preferably 40 parts by mass or more, and still further preferably 50 parts by mass or more, in a case where the total content of the phosphoric acid ester having an OH group(s) and the salt of phosphoric esters is set as 100 parts by mass. The upper limit of the talc content is preferably 1,000 parts by mass or less, further preferably 500 parts by mass or less, and still further preferably 400 parts by mass or less.

With respect to the polyvalent metal salt of alkyl carboxylic acid, an alkyl carboxylic acid having 8 to 25 carbon atoms is preferable, more preferably from 12 to 21, and further preferably from 14 to 20. Examples of the alkyl carboxylic acid include octanoic acid, lauric acid, myristic acid, palmitic acid, stearic acid, and behenic acid. Examples of the polyvalent metal include alkali earth metals and transition metals that are divalent or trivalent metals with specific examples including calcium, magnesium, barium, strontium, cadmium, aluminum, zinc, cupper, and iron. Among these metals, zinc is preferable. Examples of the polyvalent metal salt of alkyl carboxylic acid include zinc laurate, zinc myristate, zinc palmitate, zinc stearate, zinc behenate, calcium stearate, magnesium myristate, barium stearate, aluminum stearate, and cupper stearate. Among these metal salts, zinc stearate is preferable. These metal salts may be commercially available, or easily synthesized from the corresponding carboxylic acids. The polyvalent metal salt of alkyl carboxylic acid is used in an amount of preferably 0.1 parts by mass to 50 parts by mass, and more preferably from 0.5 parts by mass to 10 parts by mass, relative to 100 parts by mass of the resin (binder resin) in the heat-resistant lubricating layer.

The amount of the additives other than these talc and polyvalent metal salt of alkyl carboxylic acid that are contained in the heat-resistant lubricating layer varies in the kind of the additives. The amount the other additives is preferably from 0.001% by mass to 50% by mass, and more preferably from 0.01% by mass to 20% by mass, relative to the total amount of the heat-resistant lubricating layer.

Some ester-series surfactants have acid groups. As a result, when a large calorie is given thereto from a thermal printer head, the esters may decompose and further the pH of the backside layer may be lowered to corrode and abrade the thermal printer head largely. Examples of a method to be adopted against this problem include a method of using a neutralized ester-series surfactant, and a method of using a neutralizing agent such as magnesium hydroxide.

Other examples of the additives include higher fatty acid alcohols, organopolysiloxanes, and organic carboxylic acids.

The heat-resistant lubricating layer contains a resin. The resin may be a known resin having a high heat-resistance. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl-series resins such as polyvinyl alcohol, polyvinyl acetate, polyvinyl butyral, polyvinyl acetal, polyvinyl acetoacetal resin, vinyl chloride-vinyl acetal copolymer and polyvinyl pyrrolidone; acrylic-series resins such as methyl polymethacrylate, ethyl polyacrylate, polyacrylamide, and acrylonitrile-styrene copolymer; natural or synthetic resins such as polyamide resin, polyimide-series resin, polyamideimide resin, polyvinyl toluene resin, coumarone indene resin, polyester-series resin, polyurethane resin, polyether resin, polybutadiene resin, polycarbonate resin, chlorinated polyolefin resin, fluorine-contained resin, epoxy resin, phenol resin, silicone resin, silicone-modified or fluorine-modified urethane. These may be used alone or in a mixture form.

The resin may be cross-linked by radiating ultraviolet rays or an electron beam thereto in order to make the heat resistance of the resin high. A crosslinking agent may be used to crosslink the resin by aid of heating. At this time, a catalyst may be added thereto. Examples of the crosslinking agent include isocyanate based agents (such as polyisocyanate, and a cyclic trimer of polyisocyanate), and metal-containing agents (such as titanium tetrabutyrate, zirconium tetrabutyrate, and aluminum triisopropionate). Examples of the resin with which these crosslinking agents are each caused to react include polyvinyl acetal, polyvinyl butyral, polyester polyol, alkyd polyol, and silicone compounds containing, in its side chain, an amino group.

It is known that the heat-resistant lubricating layer is formed by coating and then the layer is put under the high-temperature environment or both high-temperature and high-humidity environment whereby the reaction between the resin and the crosslinking agent is promoted. At this point, in the present invention, it is preferable to select conditions for not breaking out a localized structure of the phosphate ester or the salt thereof represented by the above-mentioned formula (P) that is contained in the heat-resistant lubricating layer. Under the selected conditions, an appropriate combination of the resin and the crosslinking agent may be selected in order to promote the crosslinking reaction sufficiently. Under conditions of 60° C. and a low humidity, preferred is a combination of a resin and a crosslinking agent capable of promoting the crosslinking reaction sufficiently within one day.

As the resin, those having two or more hydroxyl groups at the end of polymer chain length or in the polymer structure of the resin are preferable. Herein, the wording "having two or more hydroxyl groups at the end of polymer chain length or in the polymer structure of the resin" means that the resin has two or more hydroxyl groups at the end of polymer chain in the longitudinal direction or in the polymer structure of the resin excluding the end of polymer chain. Examples of the resin include polyacrylpolyol, polyesterpolyol, and polyetherpolyol. Further, in the present invention, the term "polyacrylpolyol" also include polymethacrylpolyol. In the present invention, among these resins, polyacrylpolyol is preferable.

As the resin having two or more hydroxyl groups at the end of polymer chain length or in the polymer structure of the resin, commercially available resins may be used. Examples of the commercially available resins include TAKELAC (registered trademark) series manufactured by Mitsui Chemicals Inc., THERMOLAC series manufactured by Soken Chemical & Engineering Co., Ltd., HITALOID series manufactured by Hitachi Chemical Co., Ltd., HARIACRON series Harima Chemicals Inc., ACRYDIC series manufactured by DIC Corporation and NIPPOLLAN series manufactured by Nippon Polyurethane Industries Co., Ltd.

The hydroxyl value of the resin having two or more hydroxyl groups at the end of polymer chain length or in the polymer structure of the resin is preferably from 5 to 300, and most preferably from 15 to 100, based on the solid content of the resin. The hydroxyl value means mg number of potassium hydroxide equivalent to a hydroxyl group present in 1 g of a sample, as prescribed in JIS K-1557-1. The acid value of such resin is preferably 20 or less, and most preferably from 0 to 10, based on the solid content of the resin. The acid value means mg number of potassium hydroxide necessary to neutralize a free acid present in 1 g of a sample, as prescribed in JIS K-1557-5.

When an isocyanate-based crosslinking agent is used to attain the crosslinking, the advance of the crosslinking reaction can be inspected by detecting remaining isocyanate groups through IR spectral analysis. The wording "promote the crosslinking reaction sufficiently" means that the ratio of the intensity of the IR spectrum peak originating from the remaining isocyanate groups in the heat-resistant lubricating layer after the crosslinking reaction to the intensity of the IR spectrum peak originating from the remaining isocyanate groups in the heat-resistant lubricating layer immediately after being formed by coating and drying is 20% or less, preferably 10% or less, most preferably 5% or less.

In order to effectively achieve effects of the present invention, the temperature for accelerating a reaction between the resin and the crosslinking agent is preferably 65° C. or less, further preferably 55° C. or less, and most preferably from 40° C. to 53° C. Further, the time period of accelerating a reaction between the resin and the crosslinking agent is preferably from 12 hours to 40 days, further preferably from 18 hours to 30 days, and most preferably from 1 day to 20 days.

The heat-resistant lubricating layer is formed by painting the coating solution by a known method such as gravure coating, roll coating, blade coating or wire bar coating. The film thickness of the heat-resistant lubricating layer is preferably from 0.1 to 3 μm, more preferably from 0.2 to 2 μm.

(Base Film)

A base film used in the heat-sensitive transfer sheet of the present invention is not specifically limited. As the base film, any one of known materials can be used, so far as such the material has both a heat resistance and a mechanical strength required for the base film. Specific examples of preferable base films include thin papers such as a glassine paper, a condenser paper, and a paraffin paper; polyesters having high resistance to heat such as polyethyleneterephthalate, polyethylenenaphthalate, and polybuyleneterephthalate; stretched or unstretched films of plastics such as polyphenylene sulfide, polyetherketone, polyethersulfone, polypropylene, polycarbonate, cellulose acetate, polyethylene derivatives, poly(vinyl chloride), poly(vinylidene chloride), polystyrene, polyamide, polyimide, polymethylpentene, and ionomers; and laminates of these materials. Of these materials, polyester films are especially preferred. Stretched polyester films are further preferred. Further, polyester films that are produced by forming an easy adhesion layer on or above at least one surface of the base film, and then stretching the base film are especially preferable.

A thickness of the base film can be properly determined in accordance with the material of the support so that the mechanical strength and the heat resistance become optimum. Specifically, it is preferred to use a base having a thickness of about 1 μm to about 30 μm, more preferably from about 1 μm to 20 μm, and further preferably from about 3 μm to about 10 μm.

(Treatment for Easy Adhesion)

The surface of the base film may be subjected to treatment for easy adhesion to improve wettability and an adhesive property of the coating liquid. Examples of a treatment method for easy adhesion include corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and other known resin surface modifying techniques.

An easily-adhesive layer (easy adhesion layer) may be formed on the base film by coating. It is preferable that the easy adhesion layer is formed, in the present invention. Examples of the resin used in the easily-adhesive layer include polyester-series resins, polyacrylate-series resins, polyvinyl acetate-series resins, vinyl-series resins such as polyvinyl chloride resin and polyvinyl alcohol resin, polyvinyl acetal-series resins such as polyvinyl acetoacetal and polyvinyl butyral, polyether-series resins, polyurethane-series resins, styrene acrylate-series resins, polyacrylamide-series resins, polyamide-series resins, polystyrene-series resins, polyethylene-series resins, polypropylene-series resins, and polyvinylidone-series resins.

When a base film used for the support is formed by melt extrusion, it is allowable to subject an unstretched film to coating treatment followed by stretch treatment.

The above-mentioned treatments may be used in combination of two or more thereof.

As mentioned above, films that are produced by forming an easy adhesion layer on or above at least one surface of the base film, and then stretching the base film is preferable in the present invention. In the heat-sensitive transfer film of the present invention, it is preferable to dispose an easy adhesion layer (dye barrier layer) between a dye layer and a base film.

The dye layer containing a dye for transfer (preferably a sublimation type dye) can be formed by coating a coating liquid for the dye layer.

(Dye Layer)

In the dye layer in the present invention, preferably, dye layers in individual colors of yellow, magenta and cyan, and an optional dye layer in black are repeatedly coated onto a single base film in area order in such a manner that the colors are divided from each other. An example of the dye layer is an embodiment wherein dye layers in individual colors of yellow, magenta and cyan are coated onto a single base film along the long axial direction thereof in area order, correspondingly to the area of the recording surface of the heat-sensitive transfer image-receiving sheet, in such a manner that the colors are divided from each other. Another example thereof is an embodiment wherein not only the three layers but also a dye layer in black and/or a transferable protective layer (the transferable (transfer) protective layer may be replaced with a transferable protective layer laminate) are coated in such a manner that these (sub)layers are divided from each other. This embodiment is also preferred.

In the case of adopting such an embodiment, it is preferred to give marks to the heat-sensitive transfer sheet in order to inform the printer about starting point of the individual colors. Such coating repeated in area order makes it possible that a single heat-sensitive transfer sheet is used to form an image on the basis of transfer of dyes and further laminate a protective layer on the image.

In the present invention, however, the manner in which the dye layer is formed is not limited to the above-mentioned manners. A sublimation heat-transferable ink layer and a heat-melt transferable ink layer may be together formed. A dye layer in a color other than yellow, magenta, cyan and black is formed, or other modifications may be made. The form of the heat-sensitive transfer sheet including the dye layer may be a longitudinal form, or a one-piece form. In particular, the heat-sensitive transfer sheet including the dye layer can be used when being stored in the state that the heat-sensitive transfer sheet before use overlaps from each other.

(Dye-Layer-Coating Liquid)

The dye-layer-coating liquid layer contains at least a sublimation type dye and a binder resin. It is a preferable embodiment of the present invention that the liquid may contain organic or inorganic finely divided powder, waxes, silicone resins, and fluorine-containing organic compounds, in accordance with necessity.

In the heat-sensitive transfer sheet of the present invention, each dye in the dye layer is preferably contained in an amount of 20 to 80 mass % of the dye layer, preferably in that of 30 to 70 mass % thereof.

The coating of the dye layer is performed by an ordinary method such as roll coating, bar coating, gravure coating, or gravure reverse coating. The coating amount of the dye layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

The dye layer may have a mono-layered structure or a multi-layered structure. In the case of the multi-layered structure, the individual layers constituting the dye layer may be the same or different in composition.

(Dye)

The dye used in the present invention, preferably in the first embodiment of the present invention, is not particularly limited as far as the dye is able to diffuse by heat and able to be incorporated in a heat-sensitive transfer sheet, and able to transfer by heat from the heat-sensitive transfer sheet to an image-receiving sheet. As the dye used for the heat-sensitive transfer sheet, ordinarily used dyes or known dyes can be effectively used.

Preferable examples of the dye include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dye that can be used in the present invention, preferably in the first embodiment of the present invention, include Disperse Yellow 231, Disperse Yellow 201 and Solvent Yellow 93. Specific examples of the magenta dye that can be used in the present invention, preferably in the first embodiment of the present invention, include Disperse Violet 26, Disperse Red 60, and Solvent Red 19. Specific examples of the cyan dye that can be used in the present invention, preferably in the first embodiment of the present invention, include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together.

In the present invention, preferably in the second embodiment of the present invention, the transferable dye is a yellow dye represented by formula (1).

Next, the dye represented by formula (1) is explained in detail.

Formula (1)

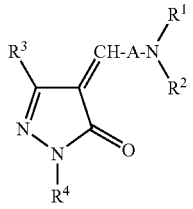

In formula (1), A represents a substituted or unsubstituted arylene group (the number of carbon is preferably from 6 to 12; more preferably a phenylene group, for example, p-phenylene group); $R^1$ and $R^2$ each independently represent a hydrogen atom, a substituted or unsubstituted alkyl group (the number of carbon atoms is preferably from 1 to 10; for example, a methyl group, an ethyl group, a n-propyl group, an isopropyl group, a n-butyl group, a n-octyl group), a substituted or unsubstituted alkenyl group (the number of carbon atoms is preferably from 2 to 10; for example, a vinyl group, an allyl group, a 1-propenyl group), or a substituted or unsubstituted aryl group (the number of carbon atoms is preferably from 6 to 12; for example, a phenyl group, a naphthyl group); $R^3$ represents a hydrogen atom, a substituted or unsubstituted alkyl group (the number of carbon atoms is preferably from 1 to 10; for example, a methyl group, an ethyl group, a n-propyl group, an isopropyl group, a n-butyl group, a n-octyl group), a substituted or unsubstituted aryl group (the number of carbon atoms is preferably from 6 to 12; for example, a phenyl group, a naphthyl group), a substituted or unsubstituted amino group (the number of carbon atoms is preferably from 0 to 12; for example, an amino group, an alkylamino group, an anilino group, an acylamino group, a sulfonamido group, an ureido group, an urethane group), a substituted or unsubstituted alkoxy group (the number of carbon atoms is preferably from 1 to 10; for example, a methoxy group, an ethoxy group, a n-propyloxy group, an isopropyloxy group, a n-butoxy group, a n-octyloxy group), a substituted or unsubstituted aryloxy group (the number of carbon atoms is preferably from 6 to 12; for example, a phenoxy group), a substituted or unsubstituted alkoxycarbonyl group (the number of carbon atoms is preferably from 2 to 11; for example, a methoxycarbonyl group, an ethoxycarbonyl group, a n-propoxycarbonyl group, an isopropoxycarbonyl group, a n-butoxycarbonyl group, a n-octyloxycarbonyl group), a substituted or unsubstituted aryloxycarbonyl group (the number of carbon atoms is preferably from 7 to 13; for example, a phenoxycarbonyl group), or a substituted or unsubstituted carbamoyl group (the number of carbon atoms is preferably from 1 to 13; for example, a carbamoyl group, a N-methylcarbamoyl group, a N-ethylcarbamoyl group, a N-phenylcarbamoyl group, a N,N-dimethylcarbamoyl group), $R^4$ represents a substituted or unsubstituted alkyl group (the number of carbon atoms is preferably from 1 to 10; for example, a methyl group, an ethyl group, a n-propyl group, an isopropyl group, a n-butyl group, a n-octyl group), or a substituted or unsubstituted aryl group (the number of carbon atoms is preferably from 6 to 12; for example, a phenyl group).

Hereinafter, the substituents which the groups represented by A, $R^1$, $R^2$, $R^3$, and $R^4$ may have will be more specifically described.

Examples of such substituent are described below. Specific examples of each substituent as well as preferable groups of each substituent are described below.

The halogen atom that A, $R^1$, $R^2$, $R^3$, and $R^4$ may have includes a fluorine atom, a chlorine atom, a bromine atom, and an iodine atom. Of these, a chlorine atom and a bromine atom are preferable, a chlorine atom is particularly preferable.

The aliphatic group that A, $R^1$, $R^2$, $R^3$, and $R^4$ may have includes a linear, branched or cyclic aliphatic group (the term "cyclic aliphatic group" means a cyclic aliphatic group, such as a cycloalkyl group, a cycloalkenyl group, a cycloalkynyl group, a bicycloalkyl group and the like.). The saturated aliphatic group includes an alkyl group, a cycloalkyl group and bicycloalkyl group and these groups may have a substituent. The number of carbon atoms of these groups is preferably from 1 to 30. Examples of the alkyl group include a methyl group, an ethyl group, an n-propyl group, an isopropyl group, a t-butyl group, an n-octyl group, an eicosyl group, a 2-chloroethyl group, a 2-cyanoethyl group, a benzyl group and a 2-ethylhexyl group. The cycloalkyl group includes a substituted or unsubstituted cycloalkyl group. The substituted or unsubstituted cycloalkyl group is preferably a cycloalkyl group having 3 to 30 carbon atoms. Examples of the cycloalkyl group include a cyclohexyl group, a cyclopentyl group and a 4-n-dodecylcyclohexyl group. The bicycloalkyl group includes a substituted or unsubstituted bicycloalkyl group having 5 to 30 carbon atoms, i.e., a monovalent group obtained by removing one hydrogen atom from a bicycloalkane having 5 to 30 carbon atoms. Examples of the bicycloalkyl group include a bicyclo[1.2.2]heptan-2-yl group or a bicyclo[2.2.2]octan-3-yl group, and a tricyclo or higher structure having three or more ring structures.

The unsaturated aliphatic group that A, $R^1$, $R^2$, $R^3$, and $R^4$ may have includes a linear, branched, or cyclic unsaturated aliphatic group. The unsaturated aliphatic group includes an alkenyl group, a cycloalkenyl group, a bicycloalkenyl group and an alkynyl group. The alkenyl group represents a linear, branched, or cyclic substituted or unsubstituted alkenyl group. The alkenyl group is preferably a substituted or unsubstituted alkenyl group having 2 to 30 carbon atoms. Examples of the alkenyl group include a vinyl group, an allyl group, a prenyl group, a geranyl group, or an oleyl group. The cycloalkenyl group is preferably a substituted or unsubstituted cycloalkenyl group having 3 to 30 carbon atoms, i.e., a monovalent group obtained by removing one hydrogen atom from a cycloalkene having 3 to 30 carbon atoms. Examples of the cycloalkenyl group include a 2-cyclopenten-1-yl group or a 2-cyclohexen-1-yl group. The bicycloalkenyl group includes a substituted and unsubstituted bicycloalkenyl group, and preferably a substituted or unsubstituted bicycloalkenyl group having 5 to 30 carbon atoms, i.e., a monovalent group obtained by removing one hydrogen atom from a bicycloalkene having one double bond. Examples of the bicycloalkenyl group include a bicyclo[2.2.1]hept-2-en-1-yl group and a bicyclo[2.2.2]oct-2-en-4-yl group. The alkynyl group is preferably a substituted or unsubstituted alkynyl group having 2 to 30 carbon atoms, e.g., an ethynyl group, or a propargyl group.

The aryl group that A, $R^1$, $R^2$, $R^3$, and $R^4$ may have is preferably a substituted or unsubstituted aryl group having 6 to 30 carbon atoms, e.g., a phenyl group, a p-tolyl group, a naphthyl group, an m-chlorophenyl group, or an o-hexadecanoylaminophenyl group. The aryl group is more preferably a substituted or unsubstituted phenyl group.

The heterocyclic group that A, $R^1$, $R^2$, $R^3$, and $R^4$ may have, is a monovalent group obtained by removing one hydrogen atom from a substituted or unsubstituted, aromatic or nonaromatic heterocyclic compound, which may be condensed to another ring. The heterocyclic group is preferably a 5- or 6-membered heterocyclic group. The hetero atom(s) constituting the heterocyclic group is preferably an oxygen atom, a sulfur atom, or a nitrogen atom. The heterocyclic group is more preferably a 5- or 6-membered aromatic heterocyclic group having 3 to 30 carbon atoms. The hetero ring in the heterocyclic group are exemplified below: a pyridine ring, a pyrazine ring, a pyridazine ring, a pyrimidine ring, a triazine ring, a quinoline ring, an isoquinoline ring, a quinazoline ring, a cinnoline ring, a phthalazine ring, a quinoxaline ring, a pyrrole ring, an indole ring, a furan ring, a benzofuran ring, a thiophene ring, a benzothiophene ring, a pyrazole ring, an imidazole ring, a benzimidazole ring, a triazole ring, an oxazole ring, a benzoxazole ring, a thiazole ring, a benzothiazole ring, an isothiazole ring, a benzisothiazole ring, a thiadiazole ring, an isoxazole ring, a benzisoxazole ring, a pyrrolidine ring, a piperidine ring, a piperazine ring, an imidazolidine ring and a thiazoline ring.

The aliphatic oxy group (as a representative example, an alkoxy group) that A, $R^1$, $R^2$, $R^3$, and $R^4$ may have includes a substituted or unsubstituted aliphatic oxy group (as a representative example, alkoxy group). The substituted or unsubstituted aliphatic oxy group is preferably an aliphatic oxy group having 1 to 30 carbon atoms, e.g., a methoxy group, an ethoxy group, an isopropoxy group, an n-octyloxy group, a methoxyethoxy group, a hydroxyethoxy group, or a 3-carboxypropoxy group.

The aryloxy group that A, $R^1$, $R^2$, $R^3$, and $R^4$ may have is preferably a substituted or unsubstituted aryloxy group having 6 to 30 carbon atoms, e.g., a phenoxy group, a 2-methylphenoxy group, a 4-t-butylphenoxy group, a 3-nitrophenoxy group, or a 2-tetradecanoylaminophenoxy group. The aryloxy group is more preferably a phenoxy group which may have a substituent.

The acyloxy group that A, $R^1$, $R^2$, $R^3$, and $R^4$ may have is preferably a formyloxy group, a substituted or unsubstituted alkylcarbonyloxy group having 2 to 30 carbon atoms, or a substituted or unsubstituted arylcarbonyloxy group having 7 to 30 carbon atoms, e.g., a formyloxy group, an acetyloxy group, a pivaloyloxy group, a stearoyloxy group, a benzoyloxy group, or a p-methoxyphenylcarbonyloxy group.

The carbamoyloxy group that A, $R^1$, $R^2$, $R^3$, and $R^4$ may have is preferably a substituted or unsubstituted carbamoyloxy group having 1 to 30 carbon atoms, e.g., an N,N-dimethylcarbamoyloxy group, an N,N-diethylcarbamoyloxy group, a morpholinocarbonyloxy group, an N,N-di-n-octylaminocarbonyloxy group, or an N-n-octylcarbamoyloxy group.

The aliphatic oxy carbonyloxy group (as a representative example, an alkoxycarbonyloxy group) that A, $R^1$, $R^2$, $R^3$, and $R^4$ may have is preferably an aliphatic oxy carbonyloxy group having 2 to 30 carbon atoms. There can be exemplified a methoxycarbonyloxy group, an ethoxycarbonyloxy group, a t-butoxycarbonyloxy group, or an n-octylcarbonyloxy group. The aliphatic oxy carbonyloxy group may have a substituent(s).

The aryloxycarbonyloxy group that A, $R^1$, $R^2$, $R^3$, and $R^4$ may have is preferably a substituted or unsubstituted aryloxycarbonyloxy group having 7 to 30 carbon atoms, e.g., a phenoxycarbonyloxy group, a p-methoxyphenoxycarbonyloxy group, or a p-n-hexadecyloxyphenoxycarbonyloxy group. The aryloxycarbonyloxy group is more preferably a substituted or unsubstituted phenoxycarbonyloxy group.

The amino group that A, $R^1$, $R^2$, $R^3$, and $R^4$ may have includes an unsubstituted amino group, an aliphatic amino group (as a representative example, an alkylamino group), an arylamino group, and a heterocyclic amino group. The amino group is preferably a substituted or unsubstituted aliphatic amino group (as a representative example, alkylamino group) having 1 to 30 carbon atoms, or a substituted or unsubstituted arylamino group having 6 to 30 carbon atoms, e.g., an amino group, a methylamino group, a dimethylamino group, an anilino group, an N-methyl-anilino group, a diphenylamino group, a hydroxyethylamino group, a carboxyethylamino group, a sulfoethylamino group, a 3,5-dicarboxyanilino group, or a 4-quinolylamino group.

The acylamino group that A, $R^1$, $R^2$, $R^3$, and $R^4$ may have is preferably a formylamino group, a substituted or unsubstituted alkylcarbonylamino group having 2 to 30 carbon atoms, or a substituted or unsubstituted arylcarbonylamino group having 7 to 30 carbon atoms, e.g., a formylamino group, an acetylamino group, a pivaloylamino group, a lauroylamino group, a benzoylamino group, or a 3,4,5-tri-n-octyloxyphenylcarbonylamino group.

The aminocarbonylamino group that A, $R^1$, $R^2$, $R^3$, and $R^4$ may have is preferably a substituted or unsubstituted aminocarbonylamino group having 1 to 30 carbon atoms, e.g., a carbamoylamino group, an N,N-dimethylaminocarbonylamino group, an N,N-diethylaminocarbonylamino group, or a morpholinocarbonylamino group. In the aminocarbonylamino group, the term "amino" means that the amino moiety in this group has the same meanings as the above-described amino group. These are also applied to other groups.

The aliphatic oxy carbonylamino group (as a representative example, alkoxycarbonylamino group) that A, $R^1$, $R^2$, $R^3$, and $R^4$ may have is preferably a substituted or unsubstituted aliphatic oxy carbonylamino group having 2 to 30 carbon atoms, e.g., a methoxycarbonylamino group, an ethoxycarbonylamino group, a t-butoxycarbonylamino group, an n-octadecyloxycarbonylamino group, or an N-methyl-methoxycarbonylamino group.

The aryloxycarbonylamino group that A, $R^1$, $R^2$, $R^3$, and $R^4$ may have is preferably a substituted or unsubstituted aryloxycarbonylamino group having 7 to 30 carbon atoms, e.g., a phenoxycarbonylamino group, a p-chlorophenoxycarbonylamino group, or an m-n-octyloxyphenoxycarbonylamino group. The aryloxycarbonylamino group is more preferably a substituted or unsubstituted phenoxycarbonylamino group.

The sulfamoylamino group that A, $R^1$, $R^2$, $R^3$, and $R^4$ may have is preferably a substituted or unsubstituted sulfamoylamino group having 0 to 30 carbon atoms, e.g., a sulfamoylamino group, an N,N-dimethylaminosulfonylamino group, or an N-n-octylaminosulfonylamino group.

The aliphatic- (as a representative example, alkyl-) or arylsulfonylamino group that A, $R^1$, $R^2$, $R^3$, and $R^4$ may have is preferably a substituted or unsubstituted aliphatic sulfonylamino group (as a representative example, alkylsulfonylamino group) having 1 to 30 carbon atoms, or a substituted or unsubstituted arylsulfonylamino group (preferably a substituted or unsubstituted phenylsulfonylamino group) having 6 to 30 carbon atoms, e.g., a methylsulfonylamino group, a butylsulfonylamino group, a phenylsulfonylamino group, a 2,3,5-trichlorophenylsulfonylamino group, or a p-methylphenylsulfonylamino group.

The aliphatic thio group (as a representative example, alkylthio group) that A, $R^1$, $R^2$, $R^3$, and $R^4$ may have is preferably a substituted or unsubstituted alkylthio group having 1 to 30 carbon atoms, e.g., a methylthio group, an ethylthio group, and an n-hexadecylthio group.

The sulfamoyl group that A, $R^1$, $R^2$, $R^3$, and $R^4$ may have is preferably a substituted or unsubstituted sulfamoyl group having 0 to 30 carbon atoms, e.g., an N-ethylsulfamoyl group, an N-(3-dodecyloxypropyl)sulfamoyl group, an N,N-dimethylsulfamoyl group, an N-acetylsulfamoyl group, an N-benzoylsulfamoly group, or an N-(N'-phenylcarbamoyl)sulfamoyl group.

The aliphatic- (as a representative example, alkyl-) or arylsulfinyl group that A, $R^1$, $R^2$, $R^3$, and $R^4$ may have is preferably a substituted or unsubstituted aliphatic sulfinyl group (as a representative example, an alkylsufinyl group) having 1 to 30 carbon atoms, or a substituted or unsubstituted arylsulfinyl group (preferably a substituted or unsubstituted phenylsulfinyl group) having 6 to 30 carbon atoms, e.g., a methylsulfinyl group, an ethylsulfinyl group, a phenylsulfinyl group, or a p-methylphenylsulfinyl group.

The aliphatic- (as a representative example, alkyl-) or arylsulfonyl group that A, $R^1$, $R^2$, $R^3$, and $R^4$ may have is preferably a substituted or unsubstituted aliphatic-sulfonyl group (as a representative example, alkylsulfonyl group) having 1 to 30 carbon atoms, or a substituted or unsubstituted arylsulfonyl group (preferably a substituted or unsubstituted phenylsulfonyl group) having 6 to 30 carbon atoms, e.g., a methylsulfonyl group, an ethylsulfonyl group, a phenylsulfonyl group, or a p-toluenesulfonyl group.

The acyl group that A, $R^1$, $R^2$, $R^3$, and $R^4$ may have is preferably a formyl group, a substituted or unsubstituted aliphatic carbonyl group (as a representative example, alkylcarbonyl group) having 2 to 30 carbon atoms, a substituted or unsubstituted arylcarbonyl group (preferably a substituted or unsubstituted phenylcarbonyl group) having 7 to 30 carbon atoms, or a substituted or unsubstituted heterocyclic carbonyl group having 4 to 30 carbon atoms and being bonded to said carbonyl group through a carbon atom, e.g., an acetyl group, a pivaloyl group, a 2-chloroacetyl group, a stearoyl group, a benzoyl group, a p-n-octyloxyphenylcarbonyl group, a 2-pyridylcarbonyl group, or a 2-furylcarbonyl group.

The aryloxycarbonyl group that A, $R^1$, $R^2$, $R^3$, and $R^4$ may have is preferably a substituted or unsubstituted aryloxycarbonyl group having 7 to 30 carbon atoms, e.g., a phenoxycarbonyl group, an o-chlorophenoxycarbonyl group, an m-nitrophenoxycarbonyl group, or a p-t-butylphenoxycarbonyl group. The aryloxycarbonyl group is more preferably a substituted or unsubstituted phenoxycarbonyl group.

The aliphatic oxycarbonyl group (as a representative example, alkoxycarbonyl group) that A, $R^1$, $R^2$, $R^3$, and $R^4$ may have is preferably a substituted or unsubstituted aliphatic oxycarbonyl group having 2 to 30 carbon atoms, e.g., a methoxycarbonyl group, an ethoxycarbonyl group, a t-butoxycarbonyl group, and an n-octadecyloxycarbonyl group.

The carbamoyl group that A, $R^1$, $R^2$, $R^3$, and $R^4$ may have is preferably a substituted or unsubstituted carbamoyl group having 1 to 30 carbon atoms, e.g., a carbamoyl group, an N-methylcarbamoyl group, an N,N-dimethylcarbamoyl group, an N,N-di-n-octylcarbamoyl group, or an N-(methylsulfonyl)carbamoyl group.

Examples of the aryl- or heterocyclic-azo group that A, $R^1$, $R^2$, $R^3$, and $R^4$ may have include a phenylazo group, a 4-methoxyphenylazo group, a 4-pivaloylaminophenylazo group, and a 2-hydroxy-4-propanoylphenylazo group.

Examples of the imido group that A, $R^1$, $R^2$, $R^3$, and $R^4$ may have include an N-succinimido group and an N-phthalimido group.

In addition to these substituents, examples of the substituent that A, $R^1$, $R^2$, $R^3$, and $R^4$ may have include a hydroxyl group, a cyano group, a nitro group, a sulfo group and a carboxyl group.

Each of these groups described as examples of the substituent that A, $R^1$, $R^2$, $R^3$, and $R^4$ each may have, further may have a substituent. Examples of the substituent include the above-mentioned substituents.

A represents a substituted or unsubstituted arylene group, preferably a substituted or unsubstituted phenylene group, more preferably a phenylene group substituted with a methyl group, or a chlorine atom, or an unsubstituted phenylene group, and most preferably an unsubstituted phenylene group. Further, the phenylene group of A is preferably a p-phenylene group.

$R^1$ is preferably a substituted or unsubstituted alkyl group (preferably an alkyl group having 1 to 8 carbon atoms), an allyl group, or a substituted or unsubstituted aryl group (preferably an aryl group having 6 to 10 carbon atoms); more preferably a substituted or unsubstituted alkyl group (preferably an alkyl group having 1 to 6 carbon atoms), or an allyl group; further preferably an unsubstituted alkyl group (preferably an alkyl group having 1 to 4 carbon atoms); and most preferably an ethyl group.

$R^2$ is preferably a substituted or unsubstituted alkyl group (preferably an alkyl group having 1 to 8 carbon atoms), an allyl group, or a substituted or unsubstituted aryl group (preferably an aryl group having 6 to 10 carbon atoms); more preferably a substituted or unsubstituted alkyl group (preferably an alkyl group having 1 to 6 carbon atoms), or an ally! group; further preferably an unsubstituted alkyl group (preferably an alkyl group having 1 to 4 carbon atoms); and most preferably an ethyl group.

$R^3$ is preferably a substituted or unsubstituted amino group, or a substituted or unsubstituted alkoxy group; more preferably a dialkylamino group (preferably a dialkylamino group having 2 to 8 carbon atoms), an unsubstituted amino group, or an unsubstituted alkoxy group (preferably an alkoxy group having 1 to 6 carbon atoms); further preferably a dialkylamino group (preferably a dialkylamino group having 2 to 4 carbon atoms), or an unsubstituted alkoxy group (preferably an alkoxy group having 1 to 4 carbon atoms); furthermore preferably an unsubstituted alkoxy group (preferably an alkoxy group having 1 to 4 carbon atoms); and most preferably an ethoxy group.

$R^4$ is preferably a substituted or unsubstituted alkyl group having 1 to 8 carbon atoms, or a substituted or unsubstituted aryl group (preferably an aryl group having 6 to 10 carbon atoms); more preferably a substituted or unsubstituted alkyl group having 1 to 6 carbon atoms, or a substituted or unsubstituted aryl group (preferably an aryl group having 6 to 10 carbon atoms); further preferably a substituted or unsubstituted aryl group (preferably an unsubstituted aryl group , more preferably an unsubstituted aryl group having 6 to 10 carbon atoms); furthermore preferably a substituted or unsubstituted phenyl group; and most preferably an unsubstituted phenyl group.

The following is an explanation about a preferable combination of various substituents (atoms) that a dye represented by formula (1) may have (combination of A, $R^1$, $R^2$, $R^3$ and $R^4$): A preferred dye is a dye in which at least one of the substituents is the above-described preferable substituent. A more preferred dye is a dye in which more various substituents are the above-described preferable substituents. The most preferred dye is a dye in which all the substituents are the above-described preferable substituents.

Examples of a preferred combination of A, $R^1$, $R^2$, $R^3$ and $R^4$ in the dye represented by formula (1) include combinations wherein A is a substituted or unsubstituted phenylene group; $R^1$ is a substituted or unsubstituted alkyl group having 1 to 8 carbon atoms, an allyl group, or a substituted or unsubstituted aryl group having 6 to 10 carbon atoms; $R^2$ is a substituted or unsubstituted alkyl group having 1 to 8 carbon atoms, an allyl group, or a substituted or unsubstituted aryl group having 6 to 10 carbon atoms; $R^3$ is a substituted or unsubstituted amino group, or a substituted or unsubstituted alkoxy group; and $R^4$ is a substituted or unsubstituted alkyl group having 1 to 8 carbon atoms, or a substituted or unsubstituted aryl group having 6 to 10 carbon atoms.

In more preferred combinations thereof, A is a substituted or unsubstituted phenylene group; $R^1$ is a substituted or unsubstituted alkyl group having 1 to 6 carbon atoms, an allyl group, or a substituted or unsubstituted phenyl group; $R^2$ is a substituted or unsubstituted alkyl group having 1 to 6 carbon atoms, an allyl group, or a substituted or unsubstituted phenyl group; $R^3$ is a substituted or unsubstituted amino group, or a substituted or unsubstituted alkoxy group; and $R^4$ is a substituted or unsubstituted alkyl group having 1 to 6 carbon atoms, or a substituted or unsubstituted phenyl group.

In most preferred combinations thereof, A is a phenylene group substituted with a methyl group or a chlorine atom, or an unsubstituted phenylene group; $R^1$ is a substituted or unsubstituted alkyl group having 1 to 4 carbon atoms, or an allyl group; $R^2$ is a substituted or unsubstituted alkyl group having 1 to 4 carbon atoms, or an allyl group; $R^3$ is a substituted or unsubstituted amino group, or a substituted or unsubstituted alkoxy group; and $R^4$ is a substituted or unsubstituted phenyl group.

Among the dyes represented by formula (1), dyes that are not commercially available may be synthesized according to dehydration condensation reaction of an pyrazolone derivative and an aminobenzaldehyde as conventionally carried out.

Specific examples of yellow dye represented by formula (1) used in the present invention are described below. However, the yellow dyes that can be used in the present invention should not be construed as being limited to the below-described specific examples.

TABLE 1

Specific examples of yellow dyes represented by formula (1)

| No. | A | $R^1$ | $R^2$ | $R^3$ | $R^4$ |
|---|---|---|---|---|---|
| Y1 | 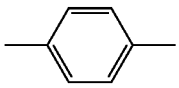 | n-Propyl | n-Propyl | Ethoxy | Phenyl |
| Y2 | 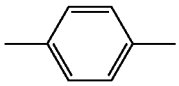 | n-Butyl | n-Butyl | Ethoxy | Phenyl |
| Y3 | 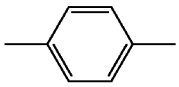 | Ethyl | Ethyl | Di-methyl-amino | Phenyl |
| Y4 | 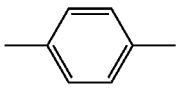 | Ethyl | Ethyl | Ethoxy | Phenyl |

The dye represented by formula (1) in the present invention may be used together with other dyes. The dyes that may be used together with the dye of formula (1) are not limited so long as the dye is able to diffuse by heat, and may be incorporated in a heat-sensitive transfer sheet, and further the dye transfers by heat from the heat-sensitive transfer sheet to a heat-sensitive image-receiving sheet. As such dyes, it is possible to use dyes that are conventionally used or known as dyes for the heat-sensitive transfer sheet.

Examples of preferable dyes that may be used together with the dye represented by formula (1) include those described as preferable dyes in the first embodiment.

Specific examples of dyes that may be used together with the dye represented by formula (1) include those described as specific examples of the dye in the first embodiment. However, the dye that may be used together with the dye represented by formula (1) is not limited to these examples. Further, an arbitrary combination of dyes each having color hue as described above is also possible.

In the present invention, preferably in the third embodiment of the present invention, the transferable dye is a dye represented by formula (2).

Next, the dye represented by the formula (2) is explained in detail.

Formula (2)

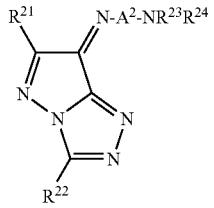

In formula (2), $A^2$ represents a substituted or unsubstituted arylene group (preferably a substituted or unsubstituted arylene group having 6 to 12 carbon atoms; more preferably a phenylene group, for example, p-phenylene group), or a divalent substituted or unsubstituted pyridine ring group (preferably a divalent substituted or unsubstituted pyridine ring having 5 to 11 carbon atoms; for example, pyridine-2,5-diyl group); $R^{21}$, $R^{22}$, $R^{23}$ and $R^{24}$ each independently represent a substituted or unsubstituted alkyl group (preferably a substituted or unsubstituted alkyl group having 1 to 10 carbon atoms; for example, a methyl group, an ethyl group, a n-propyl group, an isopropyl group, a n-butyl group, a n-octyl group), a substituted or unsubstituted alkenyl group (preferably a substituted or unsubstituted alkenyl group having 2 to 10 carbon atoms; for example, a vinyl group, an allyl group, a 1-propenyl group), or a substituted or unsubstituted aryl group (preferably a substituted or unsubstituted aryl group having 6 to 12 carbon atoms; for example, a phenyl group, a naphthyl group).

Hereinafter, the substituents which the groups represented by $A^2$, $R^{21}$, $R^{22}$, $R^{23}$, and $R^{24}$ may have will be more specifically described. Examples of the substituents which the groups represented by $A^{2l}$, $R^{21}$, $R^{22}$, $R^{23}$, and $R^{24}$ may have are the same as those exemplified as the examples of the substituents which the groups represented by A, $R^1$, $R^2$, $R^3$, and $R^4$ in formula (1); and preferable ranges are also the same.

Each of these groups described as examples of the substituent that $A^2$, $R^{21}$, $R^{22}$, $R^{23}$, and $R^{24}$ each may have, further may have a substituent. Examples of the substituent include the above-mentioned substituents.

$A^2$ is preferably a substituted or unsubstituted arylene group, or an unsubstituted divalent pyridine ring group, preferably a substituted or unsubstituted divalent pyridine ring group and an unsubstituted phenylene group (preferably p-phenylene group) (more preferably a substituted or unsubstituted divalent pyridine ring group); more preferably a substituted divalent pyridine ring group substituted with an alkyl group having 1 to 2 carbon atoms, or an unsubstituted phenylene group; further preferably a substituted divalent pyridine ring group substituted with an alkyl group having 1 to 2 carbon atoms; and particularly preferably a 6-methyl-pyridine-2,5-diyl group.

$R^{21}$ is preferably a substituted or unsubstituted alkyl group (preferably a substituted or unsubstituted alkyl group having 1 to 8 carbon atoms), or a substituted or unsubstituted aryl group (preferably a substituted or unsubstituted aryl group having 6 to 10 carbon atoms) (among them, preferably a substituted or unsubstituted alkyl group (more preferably a substituted or unsubstituted alkyl group having 1 to 8 carbon atoms)); more preferably a substituted or unsubstituted alkyl group having 1 to 6 carbon atoms, or a substituted or unsubstituted phenyl group, and most preferably a substituted or unsubstituted alkyl group having 1 to 4 carbon atoms. Among these groups, a t-butyl group is especially preferable.

$R^{22}$ is preferably a substituted or unsubstituted alkyl group (preferably a substituted or unsubstituted alkyl group having 1 to 8 carbon atoms), or a substituted or unsubstituted aryl group (preferably a substituted or unsubstituted aryl group having 6 to 10 carbon atoms) (among them, preferably a substituted or unsubstituted aryl group (more preferably a substituted or unsubstituted aryl group having 6 to 10 carbon atoms)); more preferably a substituted or unsubstituted alkyl group having 1 to 6 carbon atoms, or a substituted or unsubstituted phenyl group, and most preferably a substituted or unsubstituted phenyl group. Among these groups, an alkyl-substituted phenyl group is especially preferable, further preferably a 3-methylphenyl group.

$R^{23}$ is preferably a substituted or unsubstituted alkyl group (preferably a substituted or unsubstituted alkyl group having 1 to 8 carbon atoms) or a substituted or unsubstituted aryl group (preferably a substituted or unsubstituted aryl group having 6 to 10 carbon atoms) (among them, preferably a substituted or unsubstituted alkyl group (more preferably a substituted or unsubstituted alkyl group having 1 to 8 carbon atoms)); more preferably a substituted or unsubstituted alkyl group having 1 to 6 carbon atoms, or a substituted or unsubstituted phenyl group, and most preferably a substituted or unsubstituted alkyl group having 1 to 4 carbon atoms. Among these groups, an ethyl group is especially preferable.

$R^{24}$ is preferably a substituted or unsubstituted alkyl group (preferably a substituted or unsubstituted alkyl group having 1 to 8 carbon atoms), or a substituted or unsubstituted aryl group (preferably a substituted or unsubstituted aryl group having 6 to 10 carbon atoms) (among them, preferably a substituted or unsubstituted alkyl group (more preferably a substituted or unsubstituted alkyl group having 1 to 8 carbon atoms)); more preferably a substituted or unsubstituted alkyl group having 1 to 6 carbon atoms, or a substituted or unsubstituted phenyl group, and most preferably a substituted or unsubstituted alkyl group having 1 to 4 carbon atoms. Among these groups, an ethyl group is especially preferable.

The following is an explanation about a preferable combination of various substituents (atoms) that a dye represented by formula (2) may have (combination of $A^2$, $R^{21}$, $R^{22}$, $R^{23}$ and $R^{24}$): A preferred dye is a dye in which at least one of the substituents is the above-described preferable substituent. A more preferred dye is a dye in which more various substituents are the above-described preferable substituents. The most preferred dye is a dye in which all the substituents are the above-described preferable substituents.

Examples of a preferred combination of the dye represented by formula (2) (combination of $A^2$, $R^{21}$, $R^{22}$, $R^{23}$ and $R^{24}$) include combinations wherein $A^2$ is a substituted or unsubstituted divalent pyridine ring group, or an unsubstituted phenylene group; $R^{21}$ is a substituted or unsubstituted alkyl group having 1 to 8 carbon atoms, or a substituted or unsubstituted aryl group having 6 to 10 carbon atoms; $R^{22}$ is a substituted or unsubstituted alkyl group having 1 to 8 carbon atoms, or a substituted or unsubstituted aryl group having 6 to 10 carbon atoms; $R^{23}$ is a substituted or unsubstituted alkyl group having 1 to 8 carbon atoms; and $R^{24}$ is a substituted or unsubstituted alkyl group having 1 to 8 carbon atoms.

In more preferred combinations thereof, $A^2$ is a substituted or unsubstituted divalent pyridine ring group, or an unsubstituted phenylene group; $R^{21}$ is a substituted or unsubstituted alkyl group having 1 to 6 carbon atoms; $R^{22}$ is a substituted or unsubstituted alkyl group having 1 to 6 carbon atoms; $R^{23}$ is a substituted or unsubstituted alkyl group having 1 to 6 carbon atoms; and $R^{24}$ is a substituted or unsubstituted alkyl group having 1 to 6 carbon atoms.

In most preferred combinations thereof, $A^2$ is a substituted or unsubstituted divalent pyridine ring group, or an unsubstituted phenylene group; $R^{21}$ is a substituted or unsubstituted alkyl group having 1 to 4 carbon atoms; $R^{22}$ is a substituted or unsubstituted alkyl group having 1 to 4 carbon atoms; $R^{23}$ is a substituted or unsubstituted alkyl group having 1 to 4 carbon atoms; and $R^{24}$ is a substituted or unsubstituted alkyl group having 1 to 4 carbon atoms.

Specific example of the compound of the dye represented by formula (2) used in the present invention are described below. However, the present invention should not be construed as being limited to the below-described specific examples.

TABLE 2

Specific examples of magenta dyes represented by formula (2)

| Example of compound | $A^2$ | $R^{21}$ | $R^{22}$ | $R^{23}$ | $R^{24}$ |
|---|---|---|---|---|---|
| 1-1 | 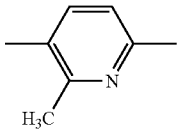 | t-butyl | 3-methylphenyl | n-propyl | n-propyl |
| 1-2 | 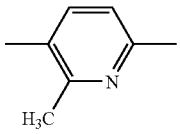 | methyl | phenyl | Ethyl | methoxyethyl |
| 1-3 | 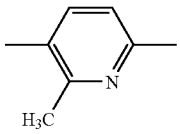 | t-butyl | 3-methylphenyl | Ethyl | ethyl |
| 1-4 | 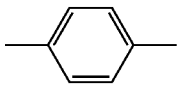 | 2-chlorophenyl | isopropyl | n-butyl | cyanoethyl |

Among these dyes represented by formula (2), dyes that are not commercially available may be synthesized according to the method, for example, described in JP-A-7-137455, or a method based on the method.

In the third embodiment of the present invention, a dye represented by formula (2) may be used solely, or in combination of two or more kinds as a dye in the dye layer containing the dye represented by formula (2). Further, the dye represented by formula (2) may be used together with dyes other than the dye represented by formula (2). Even better, this type of combination of the dyes is preferable. In this type of combination, the other dye that may be combined may be single, or two or more kinds.

The dyes that may be used together with the dye represented by formula (2) are not particularly limited so long as the dye is able to diffuse by heat, and may be incorporated in a heat-sensitive transfer sheet, and further the dye transfers by heat from the heat-sensitive transfer sheet to a heat-sensitive image-receiving sheet. As such dyes, it is possible to use dyes that are conventionally used or known as dyes for the heat-sensitive transfer sheet.

Examples of preferable dyes that may be used together with the dye represented by formula (2) include those described as preferable dyes in the first embodiment.

Specific examples of dyes to be used together with the dye represented by formula (2) include those described as specific examples of the dye in the first embodiment. However, the present invention is not limited to these examples. Further, an arbitrary combination of dyes having each color hue as described above is also possible.

Examples of the dye that is contained in a dye layer having a hue other than that of the dye layer containing the dye represented by formula (2) include the above-described dyes.

In the case where the dye represented by formula (2) is used together with other dye, when the content of the dye represented by formula (2), relative to all of dyes in the dye layer containing the dye represented by formula (2) is low, it is difficult to obtain high density while suppressing kickback. As a result, the content of the dye represented by formula (2) is generally 20% by mass or more, and preferably 30% by mass or more. Further, when the dye other than the dye represented by formula (2) is contained in the dye layer containing the dye represented by formula (2), the upper limit of the content of the dye represented by formula (2) is preferably 95% by mass or less, more preferably 90% by mass or less, and further preferably 85% by mass or less.

(Resin for Dye Layer)

In the heat-sensitive transfer sheet of the present invention, ordinarily the dye is coated on or above a base film in the state of dispersion in a polymer compound that is called a resin (also called a binder or a resin binder). As a resin binder that is contained in the dye layer, known materials may be used in the present invention. Examples thereof include acrylic-series resins such as a polyacrylonitrile, a polyacrylate, and a polyacrylamide; polyvinyl acetal-series resins such as a polyvinyl acetoacetal, and a polyvinyl butyral; cellulose-series resins such as an ethylcellulose, a hydroxyethylcellulose, an ethylhydroxycellulose, a hydroxypropylcellulose, an ethylhydroxyethylcellulose, a methylcellulose, a cellulose acetate, a cellulose acetate butyrate, a cellulose acetate propionate, modified cellulose-series-resin nitrocelluloses such as a cellulose nitrate, and an ethylhydroxyethylcellulose; a polyurethane resin, a polyamide resin, a polyester resin, a polycarbonate resin, a phenoxy resin, a phenol resin, and an epoxy resin; and various elastomers. The heat transfer layer may be made of at least one resin selected from the above-mentioned group.

These may be used alone, or two or more thereof may be used in the form of a mixture or copolymer. These may be cross-linked with various crosslinking agents.

In the present invention, the binder is preferably a cellulose-series resin and a polyvinyl acetal-series resin, more preferably a polyvinyl acetal-series resin. In the present invention, of these, the binder resin is particularly preferably a polyvinyl acetoacetal resin, or a polyvinyl butyral resin.

The content ratio by mass of the dye to the resin in the dye layer may be any proportion, and preferably from 0.1 to 5.0, more preferably from 0.5 to 3.0, and further preferably from 0.9 to 2.0.

(Transferable Protective Layer Laminate)

In the present invention, a transferable protective layer laminate is preferably formed in area order onto the heat-sensitive transfer sheet. The transferable protective layer laminate is used for forming a protective layer composed of a transparent resin on the image by thermal transfer and thus covering and protecting the image, thereby to improve durability such as scratch resistance, light-fastness, and resistance to weather. This laminate is effective in the case where the transferred dye is insufficient in image durabilities such as light resistance, scratch resistance, and chemical resistance in the state that the dye is naked in the surface of an image-receiving sheet.

The transferable protective layer laminate can be formed by forming, onto a base film, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

(Transferable Protective Layer)

In the present invention, as a transferable protective layer-forming resin, preferred are resins that are excellent in scratch resistance, chemical resistance, transparency and hardness. Examples of the resin include polyester resins, acrylic resins, polystyrene resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins.

These resins may be cross-linked with any one of various crosslinking agents.

(Transferable Protective Layer Resin)

As the acrylic resin, use can be made of polymers composed of at least one monomer selected from a conventionally known acrylate monomer and a methacrylate monomer. Other monomers than these acrylate-series monomers, such as a styrene and an acrylonitrile may be co-polymerized with said acrylic monomers. A preferred monomer is methyl methacrylate. It is preferred that methyl methacrylate is contained in terms of preparation mass ratio of 50 mass % or more in the polymer.

The acrylic resin that can be used in the present invention preferably has a molecular weight of 20,000 or more and 100,000 or less.

As the polyester resin that can be used in the present invention, a saturated polyester resin known in the prior art can be used. In the case where the above-described polyester resin is used, a preferable glass transition temperature ranges from 50° C. to 120° C., and a preferable molecular weight ranges from 2,000 to 40,000. A molecular weight ranging from 4,000 to 20,000 is more preferred, because so-called "foil-off" properties at the time of transfer of the protective layer are improved.

(Ultraviolet Absorbent)

In the present invention, an ultraviolet absorbent is preferably incorporated into the protective layer and/or the adhesive layer. As the ultraviolet absorbent, an inorganic-series ultraviolet absorbent or organic-series ultraviolet absorbent, which are known in the prior art can be used.

As the organic ultraviolet absorbents, use can be made of non-reactive ultraviolet absorbents such as a salicylate-series absorbent, a benzophenone-series absorbent, a benzotriazole-series absorbent, a triazine-series absorbent, a substituted acrylonitrile-series absorbent, and a hindered amine-series ultraviolet absorbent; and copolymers or graft polymers of thermoplastic resins (e.g., acrylic resins) obtained by introducing addition-polymerizable double bonds (originated from a vinyl group, an acryroyl group, a methacryroyl group, or the like) to the above-described non-reactive ultraviolet absorbents, or alternatively by introducing thereto other types of groups such as an alcoholic hydroxyl group, an amino group, a carboxyl group, an epoxy group, and an isocyanate group. In addition, disclosed is a method of obtaining ultraviolet-shielding resins by the steps of dissolving ultraviolet absorbents in a monomer or oligomer of a resin, and then polymerizing the monomer or oligomer (JP-A-2006-21333). The thus-obtained ultraviolet-shielding resins may be used in the present invention. In this case, the ultraviolet absorbents may be non-reactive.

Of these ultraviolet absorbents, preferred are benzophenone-series absorbent, benzotriazole-series absorbent, and triazine-series ultraviolet absorbents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitating.

Examples of commercially available ultraviolet absorbents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISORB 200 (trade name, manufactured by Sumitomo Chemical Co., Ltd.), VIOSORB 520 (trade name, manufactured by KYODO CHEMICAL CO., LTD.), and ADKSTAB LA-32 (trade name, manufactured by ADEKA).

(Formation of Transferable Protective Layer)

A method for forming the protective layer, which depends on the kind of the resin to be used, may be the same method for forming the dye layer. The protective layer preferably has a thickness of 0.5 to 10 μm.

(Releasing Layer)

In a case where the transferable protective layer is not easily peeled from the base film at the time of thermal transferring, a releasing layer may be formed between the base film and the protective layer. Alternatively, a peeling layer may be formed between the transferable protective layer and the releasing layer. The releasing layer may be formed by applying a coating liquid by a method known in the prior art, such as gravure coating and gravure reverse coating, and then drying the coated liquid. The coating liquid contains at least one selected from, for example, waxes, silicone waxes, silicone resins, fluorine-containing resins, acrylic resins, polyvinyl alcohol resins, cellulose derivative resins, urethane-series resins, vinyl acetate-series resins, acrylic vinyl ether-series resins, maleic anhydride resins, and copolymers of these resins. Of these resins, preferred are: acrylic resins, such as resin obtained by homopolymerizing a (meth)acrylic monomer such as acrylic acid or methacrylic acid, or obtained by copolymerizing an acrylic or methacrylic monomer with a different monomer; or cellulose derivative resins. They are each excellent in adhesive property to the base film, and releasing ability from the protective layer.

These resins may be cross-linked with any one of various crosslinking agents. Moreover, an ionizing radiation curable resin and an ultraviolet curable resin may also be used.

The releasing layer may be appropriately selected from a releasing layer which is transferred to a transferred-image-receiving member when the protective layer is thermally transferred, a releasing layer which remains on the base film side at that time, a releasing layer which is broken out by aggregation at that time, and other releasing layers. A preferred embodiment of the present invention is an embodiment wherein the releasing layer remains on the base film side by the thermal transfer, and the interface between the releasing layer and the thermally transferable protective layer becomes a protective layer surface after the thermal transfer, since the embodiment is excellent in surface gloss, the transfer stability of the protective layer, and others. The method for forming the releasing layer may be a coating method known in the prior art. The releasing layer preferably has a thickness of about 0.5 to 5 μm in the state that the layer is dried.

(Adhesive Layer)

An adhesive layer may be formed, as the topmost layer of the transferable protective layer laminate, on the topmost surface of the protective layer. This makes the adhesive property of the protective layer to a transferred-image-receiving member good.

2) Heat-Sensitive Transfer Image-Receiving Sheet

The heat-sensitive transfer image-receiving sheet (hereinafter also referred to simply as an image-receiving sheet) that can be used together with the heat-sensitive transfer sheet of the present invention in order to form a heat-sensitive transfer print will be described in detail hereinafter.

The heat-sensitive transfer image-receiving sheet has a support and at least one receiving layer (receptor layer) containing a thermoplastic dye-receiving polymer formed on the support. The receiving layer may contain an ultraviolet absorbent, a releasing agent, a lubricant, an antioxidant, a preservative, a surfactant, and other additives. Between the support and the receiving layer may be formed an intermediate layer such as a heat insulating layer (porous layer), a gloss control layer, a white background adjusting layer, a charge control layer, an adhesive layer, or a primer layer. The heat-sensitive transfer image-receiving sheet preferably has at least one heat insulating layer between the support and the receiving layer.

The receiving layer and these interlayers are preferably formed by simultaneous multilayer coating, and a multiple number of these interlayers may be formed as needed.

A curling control layer, a writing layer, or a charge-control layer may be formed on the backside of the support. Each of these layers may be coated on the backside of the support by using a ordinary method such as a roll coating, a bar coating, a gravure coating, and a gravure reverse coating.

In the present invention, from a viewpoint that effects of the present invention can be achieved effectively, a heat-sensitive transfer image-receiving sheet having, on or above the support, a heat insulating layer containing hollow latex polymer (particles), and a receiving layer containing latex polymer (particles), is especially preferable.

In the heat-sensitive transfer image-receiving sheet, it is preferable to use latex polymer capable of dyeing with a dye in a receiving layer. The latex polymer may be used alone or as a mixture of two or more latex polymers.

The latex polymer is generally a dispersion of fine particles of thermoplastic resins in a water-soluble dispersion medium. Examples of the thermoplastic resins used for the latex polymer in the present invention include polycarbonates, polyesters, polyacrylates, vinyl chloride copolymers, polyurethane, styrene/acrylonitrile copolymers, polycaprolactone and the like.

Among them, polycarbonates, polyesters, and vinyl chloride copolymers are preferable, polyesters and vinyl chloride copolymers are particularly preferable.

The polyester polymers are obtained by condensation of a dicarboxylic acid component and a diol compound. The polyester polymers may contain an aromatic ring and/or a saturated hydrocarbon ring. The polyester polymers may contain a water-soluble group to promote their dispersion.

Examples of the vinyl chloride copolymers include vinyl chloride/vinyl acetate copolymers, vinyl chloride/acrylate copolymers, vinyl chloride/methacrylate copolymers, vinyl chloride/vinyl acetate/acrylate copolymers, vinyl chloride/acrylate/ethylene copolymers and the like. As described above, it may be a binary copolymer or a ternary or higher copolymer, and the monomers may be distributed randomly or uniformly by block copolymerization.

The copolymer may contain auxiliary monomer components such as vinylalcohol derivatives, maleic acid derivatives, and vinyl ether derivatives. The copolymer preferably contain vinyl chloride components in an amount of 50 mass % or more, and auxiliary monomer components such as maleic acid derivative and vinyl ether derivative in an amount of 10 mass % or less.

The latex polymers may be used singly or as a mixture. The latex polymer may have a uniform structure or a core/shell structure, and in the latter case, the resins constituting the core and shell respectively may have different glass transition temperatures.

The glass transition temperature (Tg) of these latex polymers is preferably from 20° C. to 90° C., and more preferably from 25° C. to 80° C.

Commercially available acrylate latexes include Nipol LX814 (Tg: 25° C.) and Nipol LX857X2 (Tg: 43° C.) (all, trade names, manufactured by ZEON CORPORATION) and others.

Commercially available polyester latexes include Vylonal MD-1100 (Tg: 40° C.), Vylonal MD-1400 (Tg: 20° C.), Vylonal MD-1480 (Tg: 20° C.) and MD-1985 (Tg: 20° C.) (all, trade names, manufactured by Toyobo Co., Ltd.) and others.

Commercially available vinyl chloride copolymers include Vinybran 276 (Tg: 33° C.) and Vinybran 609 (Tg: 48° C.)

produced by Nissin Chemical Industry Co., Ltd., Sumielite 1320 (Tg: 30° C.) and Sumielite 1210 (Tg: 20° C.) (all, trade names, manufactured by Sumika Chemtex Co., Ltd.) and others.

The addition amount of the latex polymer (latex polymer solid content) is preferably 50 to 98 mass %, more preferably 70 to 95 mass %, with respect to all polymers in the receiving layer. The average particle diameter of the latex polymer is preferably 1 to 50,000 nm, more preferably 5 to 1,000 nm.

The heat-sensitive transfer image-receiving sheet that can be used in the present invention preferably contains hollow polymer particles in the heat insulation layer.

In the present invention, the hollow polymer particles are polymer particles having independent voids inside of the particle and they are preferably used in aqueous dispersion state. Examples of the hollow polymer particles include (1) non-foaming type hollow polymer particles obtained in the following manner: dispersion solvent such as a water is contained inside of a capsule wall formed of a polystyrene, acrylic resin, styrene/acrylic resin, and the like; and, after a coating liquid is applied and dried, for example, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

As the hollow polymer particles, the non-foaming hollow polymer particles of the foregoing (1) are preferred. If necessary, use can be made of a mixture of two or more kinds of the polymer particles. Specific examples include Rohpake HP-1055, manufactured by Rohm and Haas Co.; SX866(B), manufactured by JSR Corporation; and Nippol MH5055, manufactured by ZEON CORPORATION (all of these product names are trade names).

The average particle diameter (particle size) of the hollow polymer particles is preferably 0.1 to 5.0 μm, more preferably 0.2 to 3.0 μm, and particularly preferably 0.4 to 1.4 μm.

The hollow ratio (percentage of void) of the hollow polymer particles is preferably in the range of 20% to 70%, and particularly preferably 30% to 60%.

The particle diameter (size) of the hollow polymer particles is calculated after measurement of the equivalent-circle diameter of the periphery of the particles under a transmission electron microscope. The average particle diameter is determined by measuring the equivalent-circle diameter of the periphery of at least 300 hollow polymer particles observed under the transmission electron microscope and obtaining the average thereof.

As for the polymer properties of the hollow polymer particles, the glass transition temperature (Tg) is preferably 70° C. or higher and 200° C. or lower, more preferably 90° C. or higher and 180° C. or lower. The hollow polymer particles are particularly preferably latex hollow polymer particles.

The heat-sensitive transfer image-receiving sheet may contain a water-soluble polymer in the receiving layer and/or the heat insulation layer. Herein, the "water-soluble polymer" means a polymer which dissolves, in 100 g of water at 20° C., in an amount of preferably 0.05 g or more, more preferably 0.1 g or more, further preferably 0.5 g or more.

Examples of the water-soluble polymers for use in the heat-sensitive transfer image-receiving sheet include carrageenans, pectin, dextrin, gelatin, casein, carboxymethylcellulose, hydroxyethylcellulose, hydroxypropylcellulose, polyvinylpyrrolidone, polyvinylpyrrolidone copolymers, polyvinylalcohol, polyethylene glycol, polypropylene glycol, water-soluble polyesters, and the like. Among them, gelatin and polyvinylalcohol are preferable.

Gelatin having a molecular weight of 10,000 to 1,000,000 may be used. Gelatin may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

To the gelatin above, may be added a known crosslinking agent such as an aldehyde-type crosslinking agent, an N-methylol-type crosslinking agent, a vinylsulfone-type crosslinking agent, and a chlorotriazine-type crosslinking agent. Among the crosslinking agents above, a vinylsulfone-type agents and a chlorotriazine-type crosslinking agents are preferable, and typical examples thereof include bisvinylsulfonylmethylether, N,N'-ethylene-bis(vinylsulfonylacetamido) ethane, and 4,6-dichloro-2-hydroxy-1,3,5-triazine or the sodium salt thereof.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano et al., "Poval", Kobunshi Kankokai, Inc. are useful. The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For a typical example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117, and PVA-117H; partially saponificated polyvinyl alcohol such as PVA-203, PVA-205, PVA-210, and PVA-220; and modified polyvinyl alcohols such as C-118, HL-12E, KL-118, and MP-203 (all of these names are trade names, manufactured by KURARAY CO., LTD.).

The receiving layer of the heat-sensitive transfer image-receiving sheet may contain the polymer compound having fluorine atom-substituted aliphatic groups on its side chains. In such a case, it may contain a polymer compound identical with or different in kind from the polymer compound having fluorine atom-substituted aliphatic groups on its side chains contained in the heat-sensitive transfer sheet, and both cases are preferable embodiments of the present invention. It may also contain, as releasing agent, a known polyethylene wax, a solid wax such as amide wax, a silicone oil, a phosphate-series compound, a fluorine-series surfactant or a silicone-series surfactant.

The content of the polymer compound having fluorine atom-substituted aliphatic groups on its side chains is 0.01% to 20%, preferably 0.1% to 10% and more preferably 1% to 5%, with respect to the total solid content (mass) in the receiving layer.

3) Image-Forming Method (System)

Next, an image-forming method that can be conducted by using the heat-sensitive transfer sheet of the present invention will be described.

In the image-forming method (system) of the present invention, imaging is achieved by superposing a heat-sensitive transfer sheet on a heat-sensitive transfer image-receiving sheet so that a dye layer of the heat-sensitive transfer sheet is in contact with a receptor layer of the heat-sensitive transfer image-receiving sheet, and giving, from the heat-resistant lubricating layer side of the heat-sensitive transfer sheet, thermal energy in accordance with image signals given from a thermal printer head.

Specifically, an image-forming may be conducted in a similar manner as the method described in, for example, JP-A-2005-88545. In the present invention, a printing time is preferably less than 15 seconds, more preferably in the range of 3 to 12 seconds, and further preferably 3 to 7 seconds, from the viewpoint of shortening the time taken until a consumer gets a print.

In order to accomplish the above-described printing time, a line speed at the time of printing is preferably 0.73 msec/line or less, more preferably 0.65 msec/line or less. Further, from the viewpoint of improvement in transfer efficiency as one of speeding-up conditions, the maximum ultimate temperature of the thermal printer head at the time of printing is preferably in the range of 180° C. or higher and 450° C. or lower, more preferably 200° C. or higher and 450° C. or lower, and furthermore preferably 350° C. or higher and 450° C. or lower.

The method of the present invention may be utilized for printers, copying machines and the like, which employ a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (e.g., trade name: Video Printer VY-100, manufactured by Hitachi, Ltd.), sufficiently attains the expected result. Also, the heat-sensitive transfer image-receiving sheet used in the combination with the heat-sensitive transfer sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

First, according to the present invention, there can be provided a heat-sensitive transfer sheet that is able to provide an image having less image defects due to reduction in a stretch of the heat-sensitive transfer sheet that occurs at the time of self-service high-speed print, and that is able to obtain a print having less discoloration due to suppression of dye transfer from a dye layer to a heat-resistant lubricating layer, even though the heat-sensitive transfer sheet is stored in a roll form.

Second, according to the present invention, there can be provided a heat-sensitive transfer sheet having conspicuously improved a head stain that occurs when the heat-sensitive transfer sheet stored over time is used to print in running.

Third, according to the present invention, there can be provided a heat-sensitive transfer sheet whereby a high density is obtained and kickback is conspicuously improved.

EXAMPLES

The present invention will be described in more detail based on the following examples, but the invention is not intended to be limited thereto. In the following Examples, the terms "part" and "%" are values by mass, unless they are indicated differently in particular.

Example 1-1

(Production of Heat-Sensitive Transfer Sheets)

By forming an easy adhesion layer on one surface of a base film, and then stretching, a polyester film having a thickness of 4.5 μm was produced. Then, on the surface of the polyester film opposite to the easy adhesion layer side, the below-described heat-resistant lubricating layer-coating liquid was coated so that the solid coating amount would be 1 g/m$^2$ after drying. In the below-described heat-resistant lubricating layer-coating liquid, the ratio of reactive groups of polyisocyanate to those of the resin (—NCO/OH) was 1.1. Immeadiately after coating, the film was dried at 100° C. for 1 minute in an oven, and continuously subjected to a heat treatment at 60° C. for 18 hours so that a crosslinking reaction between the isocyanate and a polyol could be conducted to cure the heat-resistant lubricating layer. After the heat treatment, the presence of unreacted isocyanate group was checked by IR measurement and confirmed that the reaction was completed in each heat treatment condition.

Coating liquids, which will be detailed later, were used to form, onto the easily-adhesive layer painted surface of the thus-formed polyester film on which the heat-resistant lubricating layer was formed, individual dye layers in yellow, magenta and cyan, and a transferable protective layer laminate in area order by coating. In this way, a heat-sensitive transfer sheet was produced. The solid coating amount in each of the heat-sensitive transfer layers (dye layers) was set to 0.8 g/m$^2$. Immediately after the coating, the workpiece was dried at 100° C. in an oven for 1 minute.

In the formation of the transferable protective layer laminate, a releasing-layer-coating liquid was applied, and a protective-layer-coating liquid was applied thereon. The resultant was dried, and then an adhesive-layer-coating liquid was applied thereon.

Dispersion Liquid for Heat-Resistant Lubricating Layer

| | |
|---|---|
| Polyacrylpolyol-series resin (50% solution) (Hydroxyl value: 61, Acid value: 5 with respect to resin solid content) | 50.0 mass parts |
| Tris (m-cresyl) phosphate (melting point: 26° C.) | 3.5 mass parts |
| Zinc stearate (Zinc solt of calboxylic acid having 18 carbon atoms) | 0.5 mass part |
| Talc | 2.0 mass parts |
| Magnesium oxide | 0.5 mass part |
| Methyl ethyl ketone/toluene mixtured solvent | 43.5 mass parts |

The resin and the solvent for the above-described dispersion liquid for a heat-resistant lubricating layer were previously dissolved. To the resultant solution, other additives were added, and a premixing was conducted. Thereafter, dispersion was performed under any one of the following three conditions.

(Condition 1-1) Dispersion for 180 minutes using a paint shaker (Condition 1-2) Dispersion at 500 rpm for 40 minutes using a planet type ball mill P-7 type, trade name, manufactured by FRITSCH (Germany) Corporation (Condition 1-3) Dispersion at 500 rpm for 20 minutes and continuously dispersion at 100 rpm for 20 minutes using a planet type ball mill P-7 type manufactured by FRITSCH (Germany) Corporation Heat-Resistant-Lubricating-Layer-Coating Liquid

| | |
|---|---|
| Dispersion liquid for heat-resistant lubricating layer | 67.8 mass parts |
| Polyisocyanate (75% solution) (trade name: BURNOCK D-750, manufactured by DIC Corporation) | 11.2 mass parts |
| Methyl ethyl ketone/toluene mixtured solvent | 21.0 mass parts |

Yellow-Dye-Coating Liquid

| | |
|---|---|
| Dye compound (Y-1) | 1.0 mass part |
| Dye compound (Y-2) | 6.1 mass parts |
| Dye compound (Y-3) | 0.8 mass part |
| Polyvinylacetal resin (trade name: DENKA BUTYRAL #5000-D, manufactured by DENKI KAGAKU KOGYOU K. K.) | 6.9 mass parts |
| Fluorine-containing polymer compound (trade name: Megafac F-472SF, manufactured by DIC Corporation) | 0.1 mass part |
| Matting agent (trade name: Flo-thene UF, manufactured by Sumitomo Seika Chemicals Co., Ltd.) | 0.12 mass part |
| Methyl ethyl ketone/toluene mixtured solvent | 85 mass parts |

Y-1

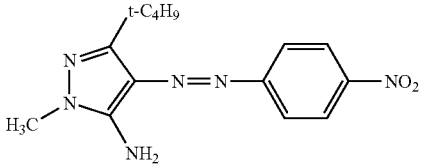

Y-2

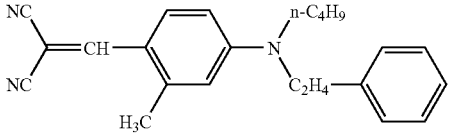

Y-3

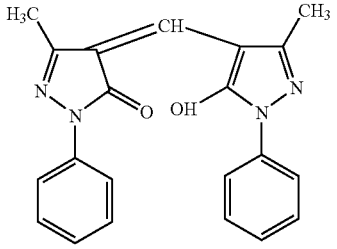

Magenta-Dye-Coating Liquid

| | |
|---|---|
| Dye compound (M-1) | 0.8 mass part |
| Dye compound (M-2) | 1.0 mass part |
| Dye compound (M-3) | 6.8 mass parts |
| Polyvinylacetal resin (trade name: S-LEC KS-1, manufactured by Sekisui Chemical Co., Ltd.) | 6.2 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 85 mass parts |

-continued

M-1

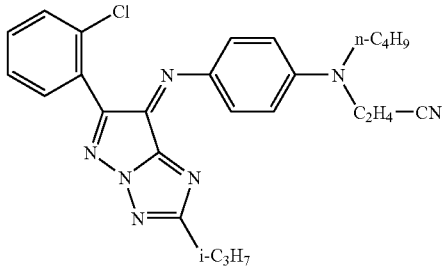

M-2

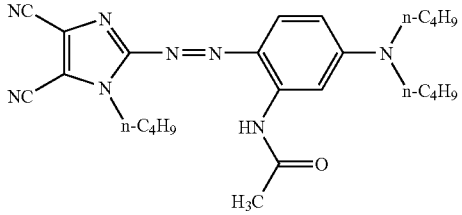

M-3

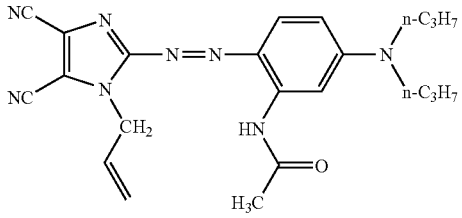

Cyan-Dye-Layer-Coating Liquid

| | |
|---|---|
| Dye compound (C-1) | 0.4 mass part |
| Dye compound (C-2) | 8.9 mass parts |
| Dye compound (C-3) | 0.5 mass part |
| Polyvinylacetal resin (trade name: DENKA BUTYRAL #5000-D, manufactured by DENKI KAGAKU KOGYOU K. K.) | 5.0 mass parts |
| Fluorine-containing polymer compound (trade name: Megafac F-472SF, manufactured by DIC Corporation) | 0.1 mass part |
| Matting agent (trade name: Flo-thene UF, manufactured by Sumitomo Seika Chemicals Co., Ltd.) | 0.12 mass part |
| Methyl ethyl ketone/toluene mixtured solvent | 85 mass parts |

C-1

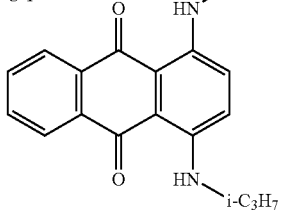

C-2

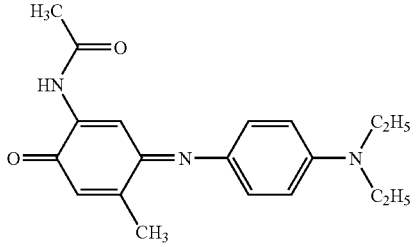

-continued

C-3

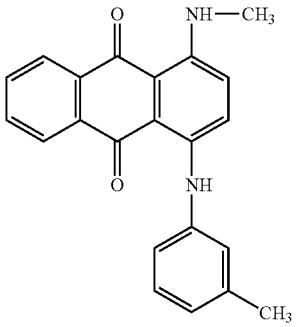

(Transferable Protective Layer Laminate)

On the polyester film coated with the dye layers as described above, coating liquids for a releasing layer, a protective layer and an adhesive layer each having the following composition was coated, to form a transferable protective layer laminate. Coating amounts of the releasing layer, the protective layer and the adhesive layer after drying were 0.2 g/m$^2$, 0.4 g/m$^2$ and 2.0 g/m$^2$, respectively.

Releasing-Layer-Coating Liquid

| | |
|---|---|
| Modified cellulose resin (trade name: L-30, manufactured by DAICEL CHEMICAL INDUSTRIES, LTD.) | 5.0 mass parts |
| Methyl ethyl ketone/toluene mixtured solvent | 95.0 mass parts |
| Protective-layer-coating liquid | |
| Acrylic resin solution (Solid content: 40%) (trade name: UNO-1, manufactured by Gifu Ceramics Limited) | 90 mass parts |
| Methanol/isopropanol mixtured solvent | 10 mass parts |

Adhesive-Layer-Coating Liquid

| | |
|---|---|
| Acrylic resin (trade name: DIANAL BR-77, manufactured by MITSUBISHI RAYON CO., LTD.) | 25 mass parts |
| The following ultraviolet absorber UV-1 | 0.5 mass part |
| The following ultraviolet absorber UV-2 | 2 mass parts |
| The following ultraviolet absorber UV-3 | 0.5 mass part |
| The following ultraviolet absorber UV-4 | 0.5 mass part |
| PMMA fine particles (polymethyl methacrylate fine particles) | 0.4 mass part |
| Methyl ethyl ketone/toluene mixtured solvent | 70 mass parts |

(UV-1)

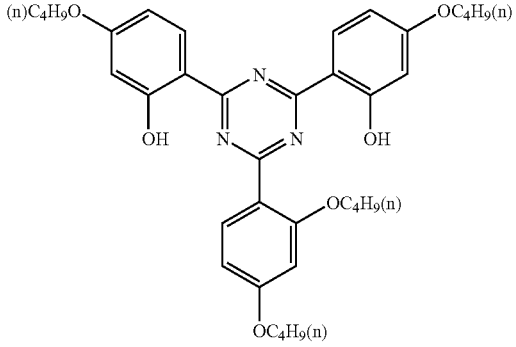

-continued (UV-2)

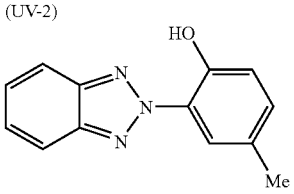

(UV-3)

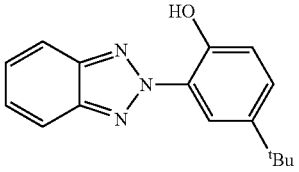

(UV-4)

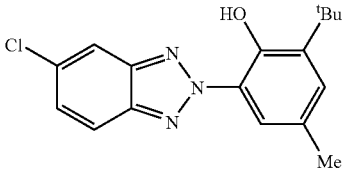

(Preparation of Heat-Sensitive Image-Receiving Sheet)

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer, and the upper receptor layer after drying would be 6.2 g/m$^2$, 8.0 g/m$^2$, 2.8 g/m$^2$ and 2.3 g/m$^2$, respectively. The following conpositions are presented by mass parts as solid contents.

Upper Receptor Layer

| | |
|---|---|
| Vinyl chloride-series latex (trade name: Vinybran 900, manufactured by Nisshin Chemicals Co., Ltd.) | 20.0 mass parts |
| Vinyl chloride-series latex (trade name: Vinybran 276, manufactured by Nisshin Chemicals Co., Ltd.) | 2.6 mass parts |
| Gelatin (10% solution) | 2.3 mass parts |
| The following ester-series wax EW-1 | 2.0 mass parts |
| The following surfactant F-1 | 0.09 mass part |
| The following surfactant F-2 | 0.36 mass part |

Lower Receptor Layer

| | |
|---|---|
| Vinyl chloride-series latex (trade name: Vinybran 690, manufactured by Nisshin Chemicals Co., Ltd.) | 13.0 mass parts |
| Vinyl chloride-series latex (trade name: Vinybran 900, manufactured by Nisshin Chemicals Co., Ltd.) | 13.0 mass parts |
| Gelatin (10% solution) | 8.0 mass parts |
| The following surfactant F-1 | 0.04 mass part |

Heat Insulation Layer

| | |
|---|---|
| Hollow latex polymer particles (trade name: MH5055, manufactured by Nippon Zeon Co., Ltd.) | 66.0 mass parts |
| Gelatin (10% solution) | 24.0 mass parts |

Subbing Layer

| | |
|---|---|
| Polyvinyl alcohol (trade name: POVAL PVA 205, manufactured by Kuraray) | 7.0 mass parts |
| Styrene butadiene rubber latex (trade name: SN-307, manufactured by NIPPON A & L INC) | 55.0 mass parts |
| The following surfactant F-1 | 0.03 mass part |

(EW-1)

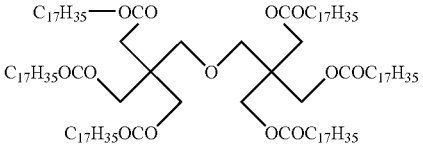

(F-1)

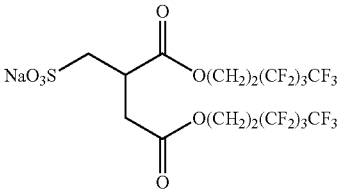

F-2

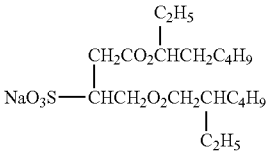

Heat-sensitive transfer sheets (104a) to (109a) were prepared in the same manner as heat-sensitive transfer sheets (101a) to (103a), except that the kind of phosphoric acid ester in the heat-sensitive lubricating layer was each changed to compounds represented by formula (P) specified in the present invention as described below.

In the heat-sensitive transfer sheets (104a) to (106a), Phoslex A-18 (trade name, a mixture of mono- and di-stearyl phosphates having a melting point of 62° C., manufactured by Sakai Chemical Industry Co., Ltd.) was each used as a phosphoric acid ester.

In the heat-sensitive transfer sheets (107a) to (109a), PLYSURF A 208N (trade name, a mixture of mono- and di-polyoxyalkylenealkyl ether phosphates having a melting point of −2° C., manufactured by DAI-ICHI KOGYO SEIYAKU CO., LTD.) was each used as a phosphoric acid ester. Herein, these melting points are values obtained by differential scanning calorimeter (DSC) measurement.

(Characteristic X-Ray Intensity Measurement and Calculation)

The characteristic X-ray intensity originated from K-line of phosphorus element in the heat-resistant lubricating layer was measured by irradiating electron beams from the side of the heat-resistant lubricating layer of the heat-sensitive transfer sheet (101a). Specifically, the measurement was conducted using high-resolution field-emission-type scanning electron microscope S-4700 (trade name) manufactured by Hitachi Corporation and an energy-dispersive X-ray spectrometer installed in the microscope. Irradiation of electron beams was conducted under the condition of electron accelerating voltage of 20 kV and electron beam size of 1 μm or less. According to the description of the present application, the characteristic X-ray intensity originated from K-line of phosphorus element was measured with respect to each of points within a 200 μm square region in a manner of selecting a high content region of phosphorus element and a low content point of phosphorus element. From the largest value of the phosphorus element content (the largest value of the phosphorus element-containing characteristic X-ray intensity) and the smallest value of the phosphorus element content (the smallest value of the phosphorus element-containing characteristic X-ray intensity) of each measurement value, the ratio (largest value/smallest value) was obtained. Hereinafter, this ratio is also referred to simply as "largest value/smallest value". The larger value indicates that the more quantity of phosphoric acid ester is localized in the heat-resistant lubricating layer. Further, according to the method described in detail in the above-description, a local region of phosphorus element X-ray intensity (maximum region of characteristic X-ray intensity originated from K-line of phosphorus element) and the maximum value (largest maximum value) of the X-ray intensity corresponding to the local region were obtained. Further, the coefficient of variation of these maximum values (hereinafter also referred to simply as "coefficient of variation") was obtained according to the above-described Numerical formulae (1) to (3). These values are used as a measure of indicating a distribution state of the localized portion of the phosphoric acid ester having an OH group(s) or the salt of phosphoric acid ester (hereinafter, the localized portion of the phosphoric acid ester having an OH group(s) together with the salt of phosphoric acid ester is abbreviated to "phosphoric acid ester localized portion"). Herein, the less coefficient of variation value indicates the more uniform distribution of the phosphoric acid ester localized portion in the heat-resistant lubricating layer.

The X-ray intensity value and the coefficient of variation value of the heat-sensitive transfer sheets (102a) to (109a) were each obtained in the same manner as the heat-sensitive transfer sheet (101a).

The heat-resistant lubricating layer compositions of these heat-sensitive transfer sheets and the thus-obtained values are shown in Table 3.

TABLE 3

| Sample No. of heat-sensitive transfer sheet | Kind of phosphoric acid ester | Distribution condition | Larges value/ Smallest value | Variation coefficient |
|---|---|---|---|---|
| 101a | Tris (m-cresyl) phosphate (melting point: 26° C.) | Condition 1-1 | 2.3 | 0.16 |
| 102a | | Condition 1-2 | 3.4 | 0.32 |
| 103a | | Condition 1-3 | 3.3 | 0.35 |
| 104a | Mixture of mono- and di-stearyl phosphates (melting point: 62° C.) | Condition 1-1 | 8.2 | 0.29 |
| 105a | | Condition 1-2 | 3.4 | 0.22 |
| 106a | | Condition 1-3 | 3.1 | 0.19 |
| 107a | Mixture of mono- and di-polyoxy alkylenealkyl ether phosphates (melting point: −2° C.) | Condition 1-1 | 3.3 | 0.28 |
| 108a | | Condition 1-2 | 2.8 | 0.22 |
| 109a | | Condition 1-3 | 3.1 | 0.25 |

From Table 3, it was shown that, with respect to each of the samples (heat-resistant transfer sheets) (101a) to (103a) in which the employed phosphoric acid ester was only phosphoric acid ester having no OH group that was outside of the scope of the present invention, the distributed state of phosphoric acid ester in the heat-resistant lubricating layer was not able to be adjusted to the range of the present invention, even though the distribution condition was changed. As a result of consideration of their distribution condition among the samples (104a) to (109a) in which the employed phosphoric acid ester was a phosphoric acid ester having an OH group(s) that was in the scope of the present invention, the distributed state of phosphoric acid ester in the heat-resistant lubricating layer of each of the samples (105a), (106a), (108a) and (109a) were able to be adjusted to the range of the present invention. Further, the distribution condition whereby the distributed state of phosphoric acid ester in the heat-resistant lubricating layer was able to be adjusted to a more preferable range of the present invention varied depending on the kind of phosphoric acid ester that was used in the heat-resistant lubricating layer. For this reason, it was also understood that the distribution condition was not be able to be arbitrarily defined.

(Formation, Measurement and Evaluation of Image)

Using the heat-sensitive transfer sheet (101a) and a heat-sensitive transfer image-receiving sheet, five sheets of black solid image print were continuously produced on a heat-sensitive transfer image-receiving paper of 152 mm×102 mm size by a thermal transfer-type printer. With respect to the first sheet and the fifth sheet among five sheets of continuous print, the length of the heat-sensitive transfer sheet was each measured in terms of before and after printing. The length of stretch owing to printing was obtained by deducting the length of sheet before printing from that after printing. Further, a proportion of the stretch was obtained as a value of the length of stretch divided by a value of the length of print portion. The larger proportion of stretch indicates the more frequent occurrence of image defect. In contrast, the smaller proportion of stretch indicates the less frequent occurrence of image defect.

Print was performed under the condition of print resolution: 300 dpi; each of yellow, magenta and cyan recording energy: 1.9 J/cm$^2$ and line speed: 1.3 msec/line, as well as recording energy: 2.0 J/cm$^2$ and line speed: 0.7 msec/line. The highest achieving temperature of TPH was 410° C. Black solid image prints were produced in the same manner as those described above, except that the heat-sensitive transfer sheets (102a) to (109a) were used in place of the heat-sensitive transfer sheet (101a). When five sheets of print were continuously produced using plural kinds of the heat-sensitive transfer sheets, the printer-waiting time of 20 minutes or more was set between one and another of five-sheet continuous print.

Separately, a sheet was prepared in the same manner as the above-described production of the heat-sensitive transfer sheets, except that a heat-resistant lubricating layer was only formed on a base film. The surface of the cyan dye layer of the heat-sensitive transfer sheet (101a) and the surface of the heat-resistant lubricating layer of the sheet in which the heat-resistant lubricating layer was only formed on the base film were stuck together and stored for 2 weeks under the environment of 40° C. and 90% relative humidity. After storage, the surface of the cyan dye layer and the surface of the heat-resistant lubricating layer were peeled from each other. Transmission optical densities of the sheet in which the heat-resistant lubricating layer was only formed on the base film before and after storage were measured. A variation range of the optical density was obtained by deducting the optical density before storage from the optical density after storage. The thus-obtained variation range was used as a measure of the amount of dye transferred to the heat-resistant lubricating layer. The less variation range value indicates the less dye transfer to the heat-resistant lubricating layer, which results in the less discoloration of print even though the heat-sensitive transfer sheet is stored in a roll form.

Further, the above-described values of each samples (102a) to (109a) were obtained in the same manner as those described above, except that the heat-sensitive transfer sheets (102a) to (109a) were used in place of the heat-sensitive transfer sheet (101a).

The evaluation results are shown in the following Table 4.

TABLE 4

| Sample No. of heat-sensitive transfer sheet | Proportion of stretch of heat-sensitive transfer sheet (%) 1.3 ms/line First sheet | 1.3 ms/line Fifth sheet | 0.7 ms/line First sheet | 0.7 ms/line Fifth sheet | Variation range of the optical density |
|---|---|---|---|---|---|
| 101a | 6.3 | 5.9 | 7.1 | 7.3 | 0.08 |
| 102a | 6.1 | 5.8 | 8.0 | 7.8 | 0.10 |
| 103a | 5.6 | 5.6 | 7.5 | 7.7 | 0.11 |
| 104a | 2.8 | 1.8 | 6.8 | 4.4 | 0.14 |
| 105a | 1.9 | 1.8 | 2.1 | 1.9 | 0.03 |
| 106a | 1.5 | 1.1 | 1.8 | 1.1 | 0.01 |
| 107a | 2.6 | 2.0 | 7.2 | 4.2 | 0.18 |
| 108a | 1.7 | 1.7 | 2.2 | 1.8 | 0.03 |
| 109a | 1.7 | 1.6 | 2.0 | 1.8 | 0.04 |

From Tables 3 and 4, it was understood that stretch of each sample of the heat-sensitive transfer sheet owing to a high speed print (such that the time period required per 1 line is short) was larger than that owing to a lower speed print. Further, from comparison of a group of samples (104a) and (109a) to a group of samples (101a) to (103a), it was understood that stretch of each sample of the heat-sensitive transfer sheet using phosphoric acid ester having an OH group(s) that was within the scope of present invention tends to reduce. It was also understood that with respect to the first sheets of high-speed print in particular, the stretch was conspicuous and at the same time a dye transfer to the heat-resistant lubricating layer was substantial. From the samples (104a) to (109a), it was understood that only samples in which phosphoric acid ester having an OH group(s) that was within the scope of the present invention was used as a phosphoric acid ester, and further the distributed state of the phosphoric acid ester in the heat-resistant lubricating layer was adjusted to the range within the scope of the present invention enabled to reduce stretch of the heat-sensitive transfer sheet including the situation of high speed print as well as the first sheets of print, and further enabled to suppress a transfer of dye to the heat-resistant lubricating layer.

Example 1-2

Production of Heat-Sensitive Transfer Sheet (201a)

Heat-sensitive transfer sheet (201a) was prepared in the same manner as the heat-sensitive transfer sheet (106a) in Example 1-1, except that zinc stearate contained in a dispersion liquid for heat-resistant lubricating layer was omitted from the dispersion liquid, and further the dispersion conditions were changed so as to change a distribution state of the phosphoric acid ester in the heat-resistant lubricating layer.

Production of Heat-Sensitive Transfer Sheet (202a)

Heat-sensitive transfer sheet (202a) was prepared in the same manner as the heat-sensitive transfer sheet (201a), except that 3.5 parts by mass of a mixture of mono- and di-stearyl phosphates (melting point: 62° C.) in a dispersion liquid for heat-resistant lubricating layer was replaced by 3.5 parts by mass of a mono- and di-stearylzinc phosphates (melting point: 190° C.), and further 0.5 part by mass of zinc stearate was used.

Production of Heat-Sensitive Transfer Sheet (203a)

Heat-sensitive transfer sheet (203a) was prepared in the same manner as the heat-sensitive transfer sheet (201a), except that 3.5 parts by mass of a mixture of mono- and di-stearyl phosphates (melting point: 62° C.) in a dispersion liquid for heat-resistant lubricating layer was replaced by 0.5 part by mass of the mixture of mono-and di-stearyl phosphate esters, and 3.0 parts by mass of a mono- and di-stearylzinc phosphates (melting point: 190° C.), and further 0.5 part by mass of zinc stearate was used.

With respect to the heat-sensitive transfer sheets (201a) to (203a) prepared above, measurement of characteristic X-ray intensity and calculation were carried out in the same manner as Example 1-1. The compositions of heat-resistant lubricating layers of these heat-sensitive transfer sheets and the values obtained by the measurement of characteristic X-ray intensity and calculation are shown together with the results of the heat-sensitive transfer sheet (106a) in Example 1-1 in Table 5.

TABLE 5

| Sample No. of heat-sensitive transfer sheet | Kind of phosphoric acid ester | Zinc stearate | Largest value/ Smallest value | Variation coefficient |
|---|---|---|---|---|
| 106a | Mixture of mono- and di-stearyl phosphates (melting point: 62° C.) | contained | 3.1 | 0.19 |

TABLE 5-continued

| Sample No. of heat-sensitive transfer sheet | Kind of phosphoric acid ester | Zinc stearate | Largest value/ Smallest value | Variation coefficient |
|---|---|---|---|---|
| 201a | Mixture of mono- and di-stearyl phosphates (melting point: 62° C.) | not contained | 2.8 | 0.23 |
| 202a | Mixture of mono- and di-stearylzinc phosphates (melting point: 190° C.) | contained | 2.6 | 0.22 |
| 203a | Mixture of mono- and di-stearyl phosphates (melting point: 62° C.) and Mixture of mono- and di-stearylzinc phosphates (melting point 190° C.) | contained | 3.3 | 0.18 |

(Formation, Measurement and Evaluation of Image)

Image formation, measurement and evaluation were carried out in the same manner as those in Example 1-1, except that the print condition of the thermal transfer-type printer was changed from recording energy of 1.9 J/cm$^2$ and line speed of 1.3 msec/line to recording energy of 2.1 J/cm$^2$ and line speed of 0.5 msec/line, respectively.

The evaluation results are shown in the following Table 6.

TABLE 6

| Sample No. of heat-sensitive transfer sheet | Proportion of stretch of heat-sensitive transfer sheet (%) | | | | Variation range of the optical density |
|---|---|---|---|---|---|
| | 0.7 ms/line First sheet | 0.7 ms/line Fifth sheet | 0.5 ms/line First sheet | 0.5 ms/line Fifth sheet | |
| 106a | 1.8 | 1.1 | 2.0 | 1.5 | 0.01 |
| 201a | 1.9 | 1.1 | 3.1 | 1.9 | 0.03 |
| 202a | 1.9 | 1.2 | 3.0 | 2.1 | 0.01 |
| 203a | 1.8 | 1.2 | 1.9 | 1.6 | 0.01 |

From Table 5, it is understood that each heat-sensitive transfer sheet using the phosphoric acid ester and/or the salt of phosphoric acid ester that was within the present invention enable to adjust the distributed state of the phosphoric acid ester in the heat-resistant lubricating layer to the range within the present invention. Further, as apparent from Table 6 from comparison of sample (106a) and sample (201a), it is understood that stretch of the heat-sensitive transfer sheet was able to be reduced by a combination use with zinc stearate even at further high-speed print, and at the same time, transfer of dye to the heat-resistant lubricating layer was able to be further suppressed. Further, from comparison of sample (106a), sample (202a) and sample (203a), it was understood that samples using the phosphoric acid ester having a melting point of 62° C. among the phosphoric acid esters and/or the salt of phosphoric ester that were within the scope of the present invention enabled to reduce more effectively stretch of the heat-sensitive transfer sheet even at further high-speed print.

Example 1-3

Production of Heat-Sensitive Transfer Sheet (301a)

Heat-sensitive transfer sheet (301a) was prepared in the same manner as the heat-sensitive transfer sheet (203a) in Example 1-2, except that the composition of a dispersion liquid for a heat-resistant lubricating layer was changed so that 3.0 parts by mass of a mono- and di-stearylzinc phosphates (melting point: 190° C.) in the dispersion liquid for heat-resistant lubricating layer was replaced by 0.5 parts by mass of the mono- and di-stearylzinc phosphates, and further 2.5 parts by mass of a mixture of mono-and di-polyoxy alkylenealkyl ether phosphate (melting point: −2° C.) was used, and further the heat processing condition that performed a crosslinking reaction between isocyanate and polyol was changed to 55° C. and 2 days. Similarly, heat-sensitive transfer sheets (302a), (303a), and (304a) were each prepared in the same manner as the heat-sensitive transfer sheet (301a), except that the heat processing condition was changed to 50° C. and 6 days, 42° C. and 18 days, and 36° C. and 30 days, respectively. Further, the heat-sensitive transfer sheets (305a) to (308a) were prepared in the same manner as the heat-sensitive transfer sheets (301a) to (304a), except that the polyacrylpolyol resin in a dispersion liquid for heat-resistant lubricating layer was replaced by polyvinylbutyral resin in an equivalent amount as a solid content, and further an amount of polyisocyanate in the heat-resistant-layer-coating liquid was changed so that a ratio of a reactive group of the polyisocyanate and a reactive group of the polyvinylbutyral resin in the heat-resistant-layer-coating liquid (—NCO/OH) was 1.1. The presence of an unreacted isocyanate group after a heat treatment was confirmed by IR measurement. As a result, it was confirmed that a crosslinking reaction was completed under any heat processing condition.

With respect to the heat-sensitive transfer sheets (301a) to (308a) prepared above, measurement of characteristic X-ray intensity and calculation were carried out in the same manner as Example 1-1. Resins of the heat-resistant lubricating layers of these heat-sensitive transfer sheets, heat processing conditions, and values obtained from measurement of characteristic X-ray intensity and calculation are shown in Table 7.

TABLE 7

| Sample No. of heat-sensitive transfer sheet | Resin | Heat processing conditions | Largest value/ Smallest value | Variation coefficient |
|---|---|---|---|---|
| 301a | Polyacrylpolyol | 55° C. and 2 days | 2.8 | 0.22 |
| 302a | Polyacrylpolyol | 50° C. and 6 days | 3.1 | 0.19 |
| 303a | Polyacrylpolyol | 42° C. and 18 days | 3.5 | 0.18 |
| 304a | Polyacrylpolyol | 36° C. and 30 days | 3.3 | 0.23 |
| 305a | Polyvinylbutyral | 55° C. and 2 days | 2.6 | 0.24 |
| 306a | Polyvinylbutyral | 50° C. and 6 days | 3.0 | 0.20 |
| 307a | Polyvinylbutyral | 42° C. and 18 days | 3.1 | 0.20 |
| 308a | Polyvinylbutyral | 36° C. and 30 days | 2.8 | 0.25 |

(Formation, Measurement and Evaluation of Image)

Image formation, measurement and evaluation were carried out in the same manner as Example 1-2, except for using the heat-sensitive transfer sheets (301a) to (308a).

The evaluation results are shown in Table 8 described below.

TABLE 8

| Sample No. of heat-sensitive transfer sheet | Proportion of stretch of heat-sensitive transfer sheet (%) | | | | Variation range of optical density |
|---|---|---|---|---|---|
| | 0.7 ms/line First sheet | 0.7 ms/line Fifth sheet | 0.5 ms/line First sheet | 0.5 ms/line Fifth sheet | |
| 301a | 1.9 | 1.6 | 3.3 | 2.0 | 0.04 |
| 302a | 1.9 | 1.1 | 2.1 | 1.6 | 0.01 |
| 303a | 1.9 | 1.0 | 1.9 | 1.5 | 0.01 |
| 304a | 2.0 | 1.1 | 2.7 | 2.0 | 0.03 |
| 305a | 1.9 | 1.7 | 3.8 | 2.8 | 0.04 |
| 306a | 1.9 | 1.1 | 3.0 | 2.1 | 0.02 |
| 307a | 1.9 | 1.0 | 2.9 | 2.1 | 0.02 |
| 308a | 2.0 | 1.1 | 3.9 | 2.9 | 0.04 |

From the above-described Table 8, it was understood that though samples (301a) to (308a) were each within the scope of the present invention, it was possible to reduce stretch of the heat-sensitive transfer sheet even in the situations of further high-speed print and the first sheets of print, and to suppress a transfer of dye to the heat-resistant lubricating layer, by adjusting a heat processing condition to the range of temperature of 40 to 53° C. and period of 1 to 20 days. Further, it was understood that the effects of the present invention can be enhanced by using polyacrylpolyol as a resin of the heat-resistant lubricating layer.

Example 2-1

(Production of Heat-Sensitive Transfer Sheet)

By forming an easy adhesion layer on one surface of a base film, and then stretching, a polyester film having a 4.5 μm thickness was produced. Then, on the surface of the polyester film opposite to the easy adhesion layer side, the below-described heat-resistant lubricating layer-coating liquid was coated so that the solid coating amount would be 1 g/m$^2$ after drying. In the below-described heat-resistant lubricating layer-coating liquid, the ratio of reactive groups of polyisocyanate to those of the resin (—NCO/OH) was 1.1. Immediately after coating, the film was dried at 100° C. for 1 minute in an oven, and continuously subjected to a heat treatment at 60° C. for 20 hours so that a crosslinking reaction between the isocyanate and a polyol could be conducted to cure the heat-resistant lubricating layer. After the heat treatment, the presence of unreacted isocyanate group was checked by IR measurement and confirmed that the reaction was completed in each heat treatment conditions.

Coating liquids, which will be detailed later, were used to form, onto the easily-adhesive layer painted surface of the thus-formed polyester film on which the heat-resistant lubricating layer was formed, individual dye layers in yellow, magenta and cyan, and a transferable protective layer laminate in area order by painting. In this way, a heat-sensitive transfer sheet was produced. The solid coating amount in each of the heat-sensitive transfer layers (dye layers) was set to 0.8 g/m$^2$. Immediately after the painting, the workpiece was dried at 100° C. in an oven for 1 minute.

In the formation of the transferable protective layer laminate, a releasing-layer-coating liquid was applied, and a protective-layer-coating liquid was applied thereon. The resultant was dried, and then an adhesive-layer-coating liquid was applied thereon.

Dispersion Liquid for Heat Resistant Lubricating Layer

| | |
|---|---|
| Polyacrylpolyol-series resin (50% solution) (Hydroxyl value: 61, Acid value: 5 with respect to resin solid content) | 51.0 mass parts |
| Tris (m-cresyl) phosphate (melting point: 26° C.) | 3.6 mass parts |
| Zinc stearate (Zinc solt of calboxylic acid having 18 carbon atoms) | 0.5 mass part |
| Talc | 2.0 mass parts |
| Magnesium oxide | 0.5 mass part |
| Methyl ethyl ketone/toluene mixtured solvent | 43.5 mass parts |

The resin and the solvent for the above-described despersion liquid for a heat-resistant lubricating layer were previously dissolved. To the resultant solution liquid, other additives were added, and a premixing was conducted. Thereafter, dispersion was performed under any one of the following three conditions.

(Condition 2-1) Dispersion for 185 minutes using a paint shaker (heat-resistant lubricating layer 101)

(Condition 2-2) Dispersion at 500 rpm for 45 minutes using a planet type ball mill P-7 type, trade name, manufactured by FRITSCH (Germany) Corporation (heat-resistant lubricating layer 102).

(Condition 2-3) Dispersion at 500 rpm for 20 minutes and continuously dispersion at 100 rpm for 20 minutes using a planet type ball mill P-7 type manufactured by FRITSCH (Germany) Corporation (heat-resistant lubricating layer 103).

Heat-Resistant-Lubricating-Layer-Coating Liquid

| | |
|---|---|
| Dispersion liquid for heat resistant lubricating layer | 68.0 mass parts |
| Polyisocyanate (75% solution) (trade name: BURNOCK D-750, manufactured by DIC Corporation) | 11.2 mass parts |
| Methyl ethyl ketone/toluene mixtured solvent | 21.0 mass parts |

Yellow-Dye-Coating Liquid

| | |
|---|---|
| Yellow-dye described in Table 10 | 5.0 mass parts |
| Dye Y | 1.5 mass parts |
| Polyvinylacetal resin (trade name: DENKA BUTYRAL #5000-D, manufactured by DENKI KAGAKU KOGYOU K. K.) | 6.9 mass parts |
| Fluorine-containing polymer compound (trade name: Megafac F-472SF, manufactured by DIC Corporation) | 0.1 mass part |
| Matting agent (trade name: Flo-thene UF, manufactured by Sumitomo Seika Chemicals Co., Ltd.) | 0.12 mass part |
| Methyl ethyl ketone/toluene mixtured solvent | 85 mass parts |

Dye Y

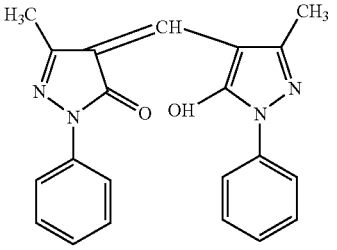

Magenta-Dye-Coating Liquid

The same liquid as the liquid in Example 1-1 was used.

Cyan-Dye-Layer-Coating Liquid

The same liquid as the liquid in Example 1-1 was used.

(Transferable Protective Layer Laminate)

On the same polyester film as the polyester film used for preparing the dye layer, a releasing layer-coating liquid, a protective layer-coating liquid, and an adhesive layer-coating liquid each having the same compositions as those described in Example 1-1 were each coated. As a result, a transferable protective layer laminate was prepared in the same manner as Example 1-1. The coating amount of each layer after drying was also the same as that in Example 1-1.

(Preparation of Heat-Transfer Image-Receiving Sheet (Z-1))

A synthetic paper (trade name: Yupo FPG 200, manufactured by Yupo Corporation, thickness: 200 μm) was used as a support; and, on one surface of the support, a white intermediate layer and a receptor layer, having the following compositions, were coated in this order by a bar coater. The coating was carried out such that the amount of the white intermediate layer and the amount of the receptor layer after each layer was dried would be 1.0 g/m$^2$ and 4.0 g/m$^2$, respectively, and the resulting film was dried after coating, processed into a shape suitable for the settings of the printer, to give a heat-sensitive transfer image-receiving sheet (Z-1).

White Intermediate Layer

| | |
|---|---|
| Polyester resin (Trade name: Vylon 200, manufactured by Toyobo Co., Ltd.) | 10 mass parts |
| Fluorescent whitening agent (Trade name: Uvitex OB, manufactured by Ciba Specialty Chemicals Company) | 1 mass part |
| Titanium oxide | 30 mass parts |
| Methyl ethyl ketone/toluene (1/1, at mass ratio) | 90 mass parts |

Receptor Layer

| | |
|---|---|
| Vinyl chloride/vinyl acetate copolymer (Trade name: Solbin A, manufactured by Nisshin Chemicals Co., Ltd.) | 100 mass parts |
| Amino-modified silicone (X22-3050C, tradename, manufactured by Shin-Etsu Chemical Co., Ltd.) | 5 mass parts |
| Epoxy-modified silicone (X22-3000E, tradename, manufactured by Shin-Etsu Chemical Co., Ltd.) | 5 mass parts |
| Methyl ethyl ketone/toluene (1/1, at mass ratio) | 400 mass parts |

(Preparation of Heat-Sensitive Transfer Image-Receiving Sheet (Z-2))

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer and the upper receptor layer after drying would be 6.0 g/m$^2$, 8.5 g/m$^2$, 2.4 g/m$^2$ and 3.0 g/m$^2$, respectively. The resulting composite was dried and then heat-treated at 30° C. for 5 days, subjected to crosslinking reaction with a crosslinking agent and gelatin, and processed into a shape suitable for the settings of the printer, to give a heat-sensitive transfer image-receiving sheet (Z-2).

The following compositions are presented by mass parts as solid contents.

Upper Receptor Layer

| | |
|---|---|
| Vinyl chloride-series latex (trade name: Vinybran 900, manufactured by Nisshin Chemicals Co., Ltd.) | 21.0 mass parts |
| Vinyl chloride-series latex (trade name: Vinybran 276, manufactured by Nisshin Chemicals Co., Ltd.) | 1.6 mass parts |
| Gelatin (10% solution) | 2.5 mass parts |
| Ester-series wax EW-1 | 1.8 mass parts |
| Surfactant F-1 | 0.1 mass part |
| Surfactant F-2 | 0.4 mass part |

Lower Receptor Layer

| | |
|---|---|
| Vinyl chloride-series latex (Tg = 46° C.) (trade name: Vinybran 690, manufactured by Nisshin Chemicals Co., Ltd.) | 18.0 mass parts |
| Vinyl chloride-series latex (Tg = 73° C.) (trade name: Vinybran 900, manufactured by Nisshin Chemicals Co., Ltd.) | 8.0 mass parts |
| Gelatin (10% solution) | 8.0 mass parts |
| Surfactant F-1 | 0.03 mass part |

Heat Insulation Layer

| | |
|---|---|
| Acrylic styrene based hollow polymer particles (average particle size 0.5 μm) (trade name: MH5055, manufactured by Nippon Zeon Co., Ltd.) | 66.0 mass parts |
| Gelatin (10% solution) | 24.0 mass parts |
| Sodium salt of 2,4-dichloro-6-hydroxy-s-triazine (Crosslinking agent) | 0.1 mass part |

Subbing Layer

| | |
|---|---|
| Polyvinyl alcohol (trade name: POVAL PVA 205, manufactured by Kuraray) | 7.0 mass parts |
| Styrene butadiene rubber latex (trade name: SN-307, manufactured by NIPPON A & L INC) | 55.0 mass parts |
| Surfactant F-1 | 0.02 mass part |

Heat-resistant lubricating layers (104) to (109) were prepared in the same manner as heat-resistant lubricating layers (101) to (103), except that the kind of phosphoric acid ester in the heat-resistant lubricating layers was each changed to compounds represented by formula (P) specified in the present invention as described below.

In the heat-resistant lubricating layers (104) to (106), Phoslex A-18 (trade name, a mixture of mono- and di-stearyl phosphates having a melting point of 62° C., manufactured by Sakai Chemical Industry Co., Ltd.) was each used as a phosphoric acid ester.

In the heat-resistant lubricating layers (107) to (109), PLYSURF A 208N (trade name, a mixture of mono- and di-polyoxyalkylenealkyl ether phosphates having a melting point of −2° C., manufactured by DAI-ICHI KOGYO SEIYAKU CO., LTD.) was each used as a phosphoric acid ester. Herein, these melting points are values obtained by differential scanning calorimeter (DSC) measurement.

Production of Heat-Resistant Lubricating Layer (110)

As a heat-resistant lubricating layer free of a phosphoric acid ester compound like a lubricating layer described in Example 3 of JP-B-6-19033, a heat-resistant lubricating layer (110) was prepared in the same manner as the heat-resistant lubricating layer (105), except that a mixture of mono- and di-stearyl phosphates was only excluded from the heat-resistant lubricating layer (105).

Production of Heat-Resistant Lubricating Layer (201)

Heat-sensitive transfer sheet (201) was prepared in the same manner as the heat-sensitive transfer sheet (106), except that zinc stearate in a dispersion liquid for the heat-resistant lubricating layer was not used and the dispersion condition for adjusting distribution of phosphoric acid ester in the heat-resistant lubricating layer was changed.

Production of Heat Resistant Lubricating Layer (202)

Heat-resistant lubricating layer (202) was prepared in the same manner as the heat-resistant lubricating layer (201), except that 3.5 parts by mass of a mixture of mono- and di-stearyl phosphates (melting point: 62° C.) in a dispersion liquid for heat-resistant lubricating layer was replaced by 3.5 parts by mass of a mono- and di-stearylzinc phosphates (melting point: 190° C.), and further 0.5 part by mass of zinc stearate was used.

Production of Heat-Resistant Lubricating Layer (203)

Heat-resistant lubricating layer (203) was prepared in the same manner as the heat-resistant lubricating layer (201), except that 3.6 parts by mass of a mixture of mono- and di-stearyl phosphates (melting point: 62° C.) in a dispersion liquid for heat-resistant lubricating layer was replaced by 0.6 part by mass of a mixture of mono- and di-stearyl phosphates, and 2.9 parts by mass of a mono- and di-stearylzinc phosphates (melting point: 190° C.), and further 0.5 part by mass of zinc stearate was used.

(Characteristic X-Ray Intensity Measurement and Calculation)

With respect to the heat-resistant lubricating layers (101) to (109) and (201) to (203) prepared above, measurement of characteristic X-ray intensity and calculation were carried out in the same manner as Example 1-1.

The compositions of these heat-resistant lubricating layers, dispersion conditions, and the values obtained by the measurement of characteristic X-ray intensity and calculation are shown in Table 9.

TABLE 9

| Heat-resistant lubricating layer No. | Kind of phosphoric acid ester | Zinc stearate | Distribution condition | Largest value/ Smallest value | Variation coefficient |
|---|---|---|---|---|---|
| 101 | Tris (m-cresyl) phosphate (melting point: 26° C.) | contained | Condition 2-1 | 2.2 | 0.17 |
| 102 | | | Condition 2-2 | 3.5 | 0.31 |
| 103 | | | Condition 2-3 | 3.4 | 0.36 |
| 104 | Mixture of mono- and di-stearyl phosphates | contained | Condition 2-1 | 8.3 | 0.28 |
| 105 | (melting point: 62° C.) | | Condition 2-2 | 3.3 | 0.23 |
| 106 | | | Condition 2-3 | 3.2 | 0.18 |
| 107 | Mixture of mono- and di-polyoxy alkylenealkyl ether | contained | Condition 2-1 | 3.4 | 0.29 |
| 108 | phosphates | | Condition 2-2 | 2.7 | 0.23 |
| 109 | (melting point: −2° C.) | | Condition 2-3 | 3.2 | 0.24 |
| 201 | Mixture of mono- and di-stearyl phosphates (melting point: 62° C.) | not contained | Condition 2-3 | 2.9 | 0.18 |
| 202 | Mixture of mono- and di-stearylzinc phosphates (melting point: 190° C.) | contained | Condition 2-3 | 2.7 | 0.24 |
| 203 | Mixture of mono- and di-stearyl phosphates (melting point: 62° C.) and Mixture of mono- and di-stearylzinc phosphates (melting point: 190° C.) | contained | Condition 2-3 | 3.4 | 0.21 |

From Table 9, it was shown that, with respect to each of the heat-resistant lubricating layers (101) to (103) in which the employed phosphoric acid ester is only phosphoric acid ester having no OH group that was outside of the scope of the present invention. The distributed state of phosphoric acid ester in the heat-resistant lubricating layer was not able to be adjusted to the range of the present invention, even though the distribution condition was changed. As a result of consideration of their distribution condition among the heat-resistant lubricating layers (104) to (109) in which the employed phosphoric acid ester was a compound having an OH group(s) that was in the scope of the present invention, the distributed state of phosphoric acid ester in the heat-resistant lubricating layer of each of the heat-resistant lubricating layers (105), (106), (108) and (109) was able to be adjusted to the range of the present invention. Further, the distribution condition whereby the distributed state of phosphoric acid ester in the heat-resistant lubricating layer was able to be adjusted to a more preferable range of the present invention varied depending on the kind of phosphoric acid ester that was used in the heat-resistant lubricating layer. For this reason, it was also understood that the distribution condition cannot be arbitrarily defined.

Various kinds of heat-sensitive transfer sheets shown in Table 10 set forth below were prepared by combining these heat-resistant lubricating layers with the above-described yellow dye-coating liquids but for the dyes being changed to those dyes shown in the Table 10.

(Evaluation Condition of Formation, and Measurement of Image)

Each sample of the heat-sensitive transfer sheet was processed in a roll form so that the heat-resistant lubricating layer and the dye layer of the each sample contact each other, and each sample was left for 30 days under the environment of 30° C. and 80% relative humidity.

Thereafter, in combination with the heat-sensitive transfer image-receiving sheet Z-1, 4800 sheets of black solid image print were continuously produced using a Fujifilm Thermal Photo Printer ASK-2000 (trade name) manufactured by FUJIFILM Corporation under the environment of 25° C. and 50% relative humidity. Taking out the thermal head after print, height measurement of the thermal head shape profile was carried out using a Color 3 D Laser Microscope VK-9500G II (trade name, manufactured by KEYENCE CORPORATION) to obtain height μm of stain attached to the thermal head. This value was used as an indicator of the head stain generated by running after the heat-sensitive transfer sheet was stored over a period of time. The smaller the value, the more good the situation of head stain was judged. Specifically, if the height of head stain was 4.0 μm or less, the situation of head stain was judged as being good. If the height of head stain was more than 4.0 μm, but less than 7.0 μm, the situation of head stain was judged as being practically allowable on account that the stain has almost no affect on the printed image. If the height of head stain was more than 7.0 μm, the situation of head stain was judged as being problematic on account that the scratch generated also on the printed image.

These results are shown together in the following Table 10.

TABLE 10

| Sample No. of heat-sensitive transfer sheet | Heat-resistant lubricating layer No. | Yellow dye | Largest value/Smallest value | Variation coefficient | Height (μm) of head stain by running over a period of time |
|---|---|---|---|---|---|
| Sample 1 | 101 | YA | 2.2 | 0.17 | 19.6 |
| Sample 2 | 102 | YA | 3.5 | 0.31 | 17.4 |
| Sample 3 | 103 | YA | 3.4 | 0.36 | 17.0 |
| Sample 4 | 104 | YA | 8.3 | 0.28 | 15.1 |
| Sample 5 | 105 | YA | 3.3 | 0.23 | 9.6 |
| Sample 6 | 106 | YA | 3.2 | 0.18 | 9.8 |
| Sample 7 | 107 | YA | 3.4 | 0.29 | 16.7 |
| Sample 8 | 108 | YA | 2.7 | 0.23 | 10.7 |
| Sample 9 | 109 | YA | 3.2 | 0.24 | 10.7 |
| Sample 10 | 201 | YA | 2.9 | 0.18 | 11.7 |
| Sample 11 | 202 | YA | 2.7 | 0.24 | 10.1 |
| Sample 12 | 203 | YA | 3.4 | 0.21 | 13.1 |
| Sample 13 | 101 | YB | 2.2 | 0.17 | 16.2 |
| Sample 14 | 102 | YB | 3.5 | 0.31 | 13.8 |
| Sample 15 | 103 | YB | 3.4 | 0.36 | 20.8 |
| Sample 16 | 104 | YB | 8.3 | 0.28 | 16.5 |
| Sample 17 | 105 | YB | 3.3 | 0.23 | 9.4 |
| Sample 18 | 106 | YB | 3.2 | 0.18 | 12.3 |
| Sample 19 | 107 | YB | 3.4 | 0.29 | 19.9 |
| Sample 20 | 108 | YB | 2.7 | 0.23 | 10.0 |
| Sample 21 | 109 | YB | 3.2 | 0.24 | 12.1 |
| Sample 22 | 201 | YB | 2.9 | 0.18 | 7.9 |
| Sample 23 | 202 | YB | 2.7 | 0.24 | 8.8 |
| Sample 24 | 203 | YB | 3.4 | 0.21 | 9.9 |
| Sample 25 | 101 | Y3 | 2.2 | 0.17 | 11.4 |
| Sample 26 | 102 | Y3 | 3.5 | 0.31 | 13.6 |
| Sample 27 | 103 | Y3 | 3.4 | 0.36 | 12.2 |
| Sample 28 | 104 | Y3 | 8.3 | 0.28 | 12.4 |
| Sample 29 | 105 | Y3 | 3.3 | 0.23 | 2.6 |
| Sample 30 | 106 | Y3 | 3.2 | 0.18 | 1.1 |
| Sample 31 | 107 | Y3 | 3.4 | 0.29 | 12.5 |
| Sample 32 | 108 | Y3 | 2.7 | 0.23 | 4.3 |
| Sample 33 | 109 | Y3 | 3.2 | 0.24 | 4.3 |
| Sample 34 | 201 | Y3 | 2.9 | 0.18 | 1.7 |
| Sample 35 | 202 | Y3 | 2.7 | 0.24 | 3.0 |
| Sample 36 | 203 | Y3 | 3.4 | 0.21 | 2.0 |
| Sample 37 | 110 | Y3 | — | — | 16.1 |
| Sample 38 | 101 | Y4 | 2.2 | 0.17 | 14.4 |
| Sample 39 | 102 | Y4 | 3.5 | 0.31 | 10.1 |
| Sample 40 | 103 | Y4 | 3.4 | 0.36 | 11.2 |
| Sample 41 | 104 | Y4 | 8.3 | 0.28 | 15.0 |
| Sample 42 | 105 | Y4 | 3.3 | 0.23 | 0.2 |
| Sample 43 | 106 | Y4 | 3.2 | 0.18 | 0.7 |
| Sample 44 | 107 | Y4 | 3.4 | 0.29 | 10.1 |
| Sample 45 | 108 | Y4 | 2.7 | 0.23 | 3.3 |
| Sample 46 | 109 | Y4 | 3.2 | 0.24 | 1.9 |
| Sample 47 | 201 | Y4 | 2.9 | 0.18 | 2.5 |
| Sample 48 | 202 | Y4 | 2.7 | 0.24 | 2.0 |
| Sample 49 | 203 | Y4 | 3.4 | 0.21 | 3.2 |

YA

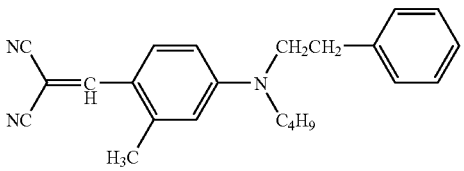

YB

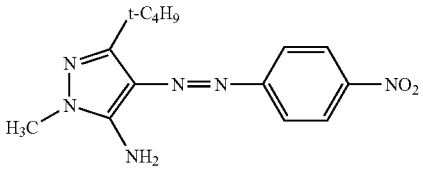

From the above-described Table 10, it was shown that head stain was conspicuously suppressed also in the running after each of the heat-sensitive transfer sheets in the scope of the present invention was stored over a period of time.

Example 2-2

The same experimental test and evaluation was carried out in the same manner as Example 2-1, except that the heat-sensitive transfer image-receiving sheet Z-1 in Example 2-1 was replaced by the heat-sensitive transfer image-receiving sheet Z-2. As a result, greater results than those of Example 2-1 were obtained.

Example 2-3

Production of Heat-Resistant Lubricating Layers (301) to (308)

Heat-resistant lubricating layer (301) was prepared in the same manner as the heat-resistant lubricating layer (203) in Example 2-1, except that the composition of a dispersion liquid for heat-resistant lubricating layer was changed so that 2.9 parts by mass of a mono- and di-stearylzinc phosphates (melting point: 190° C.) in the dispersion liquid for heat-resistant lubricating layer was replaced by 0.6 part by mass of the mono- and di-stearylzinc phosphates, and further 2.4 parts by mass of a mixture of mono-and di-polyoxy alkylenealkyl ether phosphate (melting point: −2° C.) was used, and further the heat processing condition that performed a crosslinking reaction between isocyanate and polyol was changed to 56° C. and 2 days. Similarly, heat-resistant lubricating layers (302), (303), and (304) were each prepared in the same manner as the heat-resistant lubricating layer (301), except that the heat processing condition was changed to 51° C. and 6 days, 43° C. and 18 days, and 35° C. and 30 days, respectively. Further, heat-resistant lubricating layers (305) to (308) were prepared in the same manner as the heat-resistant lubricating layers (301) to (304), except that the polyacrylpolyol resin in a dispersion liquid for heat-resistant lubricating layer was replaced by polyvinylbutyral resin in an equivalent amount as a solid content, and further an amount of polyisocyanate in the heat-resistant-layer-coating liquid was changed so that a ratio of a reactive group of the polyisocyanate and a reactive group of the polyvinylbutyral resin in the heat-resistant-layer-coating liquid (—NCO/OH) was 1.1. The presence of an unreacted isocyanate group after a heat treatment was confirmed by IR measurement. As a result, it was confirmed that a crosslinking reaction was completed under any heat processing condition.

With respect to the heat-resistant lubricating layers (301) to (308) prepared above, measurement of characteristic X-ray intensity and calculation were carried out in the same manner as Example 2-1. Resins of the heat-resistant lubricating layers of these heat-sensitive transfer sheets, heat processing conditions, and values obtained from measurement of characteristic X-ray intensity and calculation are shown in Table 11.

TABLE 11

| Sample No. of heat-resistant lubricating layer | Resin | Heat processing condition | Largest value/ Smallest value | Variation coefficient |
|---|---|---|---|---|
| 301 | Polyacrylpolyol | 56° C. and 2 days | 2.7 | 0.23 |
| 302 | Polyacrylpolyol | 51° C. and 6 days | 3.0 | 0.18 |
| 303 | Polyacrylpolyol | 43° C. and 18 days | 3.4 | 0.19 |
| 304 | Polyacrylpolyol | 35° C. and 30 days | 3.2 | 0.22 |
| 305 | Polyvinylbutyral | 56° C. and 2 days | 2.7 | 0.25 |
| 306 | Polyvinylbutyral | 51° C. and 6 days | 3.1 | 0.19 |
| 307 | Polyvinylbutyral | 43° C. and 18 days | 3.0 | 0.21 |
| 308 | Polyvinylbutyral | 35° C. and 30 days | 2.7 | 0.25 |

The below-described heat-sensitive transfer sheets were prepared in the same manner as the heat-sensitive transfer sheet sample 36, except that the heat-resistant lubricating layer and the yellow dye of the sample were each changed to the combinations shown in the following Table 12. These heat-sensitive transfer sheets were each evaluated by the experimental test in the same manner as Example 2-1.

The evaluation results are shown in Table 12.

TABLE 12

| Sample No. of heat-sensitive transfer sheet | Heat-resistant lubricating layer No. | Yellow dye | Largest value/ Smallest value | Variation coefficient | Height (μm) of head stain by running over a period of time |
|---|---|---|---|---|---|
| Sample 50 | 301 | Y3 | 2.7 | 0.23 | 2.1 |
| Sample 51 | 302 | Y3 | 3.0 | 0.18 | 0.1 |
| Sample 52 | 303 | Y3 | 3.4 | 0.19 | 0.1 |
| Sample 53 | 304 | Y3 | 3.2 | 0.22 | 3.4 |
| Sample 54 | 305 | Y3 | 2.7 | 0.25 | 2.8 |
| Sample 55 | 306 | Y3 | 3.1 | 0.19 | 0.1 |
| Sample 56 | 307 | Y3 | 3.0 | 0.21 | 0.1 |
| Sample 57 | 308 | Y3 | 2.7 | 0.25 | 2.7 |
| Sample 58 | 301 | Y4 | 2.7 | 0.23 | 1.8 |
| Sample 59 | 302 | Y4 | 3.0 | 0.18 | 0.1 |
| Sample 60 | 303 | Y4 | 3.4 | 0.19 | 0.1 |
| Sample 61 | 304 | Y4 | 3.2 | 0.22 | 0.2 |
| Sample 62 | 305 | Y4 | 2.7 | 0.25 | 4.4 |
| Sample 63 | 306 | Y4 | 3.1 | 0.19 | 0.1 |
| Sample 64 | 307 | Y4 | 3.0 | 0.21 | 0.1 |
| Sample 65 | 308 | Y4 | 2.7 | 0.25 | 4.2 |

From the above-described Table 12, it was shown that samples 50 to 65 were within the scope of the present invention, and effects of the present invention were more effectively enhanced by setting a heat processing condition to the range of temperature of 40° C. to 53° C. and the period of 1 day to 20 days, and by using polyacryl polyol as a resin of the heat-resistant lubricating layer, and further by combining the resin and the specific dye in the present invention.

Example 3-1

(Production of Heat-Sensitive Transfer Sheet)

By forming an easy adhesion layer on one surface of a base film, and then stretching, a polyester film having 4.5 μm thickness was produced. Then, on the surface of the polyester film opposite to the easy adhesion layer side, the below-described heat-resistant lubricating layer-coating liquid was coated so that the solid coating amount would be 1 g/m$^2$ after drying. In this way, polyester films (101b) to (103b) each on which heat-resistant lubricating layer was formed were obtained. In the below-described heat-resistant lubricating layer-coating liquid, the ratio of reactive groups of polyisocyanate to those of the resin (—NCO/OH) was 1.1. Immediately after coating, the film was dried at 100° C. for 1 minute in an oven, and continuously subjected to a heat treatment at 60° C. for 18 hours so that a crosslinking reaction between the isocyanate and a polyol could be conducted to cure the heat-resistant lubricating layer. After the heat treatment, the presence of unreacted isocyanate group was checked by IR measurement and confirmed that the reaction was completed in each heat treatment condition.

Coating liquids, which will be detailed later, were used to form, onto the easily-adhesive layer painted surface of the thus-formed polyester films (101b) to (103b) each on which heat-resistant lubricating layer was formed, individual dye layers and a transferable protective layer laminate in area order by painting. In this way, heat-sensitive transfer sheets (101b) to (103b) were produced. The solid coating amount of the heat-sensitive transfer layers (dye layers) was set to 0.8 g/m$^2$. Immediately after the painting, the workpiece was dried at 100° C. in an oven for 1 minute.

In the formation of the transferable protective layer laminate, a releasing-layer-coating liquid was applied, and a protective-layer-coating liquid was applied thereon. The resultant was dried, and then an adhesive-layer-coating liquid was applied thereon.

Dispersion Liquid for Heat-Resistant Lubricating Layer

| | |
|---|---|
| Polyacrylpolyol-series resin (50% solution) (Hydroxyl value: 61, Acid value: 5 with respect to resin solid content) | 50.0 mass parts |
| Tris (m-cresyl) phosphate (melting point: 26° C.) | 3.5 mass parts |
| Zinc stearate (Zinc solt of calboxylic acid having 18 carbon atoms) | 0.5 mass part |
| Talc | 2.0 mass parts |
| Magnesium oxide | 0.5 mass part |
| Methyl ethyl ketone/toluene mixtured solvent | 43.5 mass parts |

The resin and the solvent for the above-described dispersion liquid for a heat-resistant lubricating layer were previously dissolved. To the resultant solution liquid, other additives were added, and a premixing was conducted. Thereafter, dispersion was performed under any one of the three conditions 1-1 to 1-3 in Example 1-1.

Heat-Resistant-Lubricating-Layer-Coating Liquid

| | |
|---|---|
| Dispersion liquid for heat-resistant lubricating layer | 67.8 mass parts |
| Polyisocyanate (75% solution) (trade name: BURNOCK D-750, manufactured by DIC Corporation) | 11.2 mass parts |
| Methyl ethyl ketone/toluene mixtured solvent | 21.0 mass parts |

Dye-Coating Liquid

| | |
|---|---|
| Dye compound A (Exemplified compound 1-1) | 0.8 mass part |
| Dye compound B (Disperse Violet 26 (D.V.26)) | 3.6 mass parts |
| Dye compound C (Disperse Red 60 (D.R.60)) | 3.6 mass parts |
| Polyvinylacetal resin (trade name: DENKA BUTYRAL #5000-D, manufactured by DENKI KAGAKU KOGYOU K. K.) | 6.6 mass parts |
| Fluorine-containing polymer compound (trade name: Megafac F-472SF, manufactured by DIC Corporation) | 0.25 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 85 mass parts |

(Transferable Protective Layer Laminate)

On the same polyester film as the polyester film used for preparing the dye layer, a releasing layer-coating liquid, a protective layer-coating liquid, and an adhesive layer-coating liquid each having the same compositions as those described in Example 1-1 were each coated. As a result, a transferable protective layer laminate was prepared in the same manner as Example 1-1. The coating amount of each layer after drying was also the same as that in Example 1-1.

(Preparation of Heat Sensitive Image-Receiving Sheet)

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer, and the upper receptor layer after drying would be 6.2 g/m$^2$, 8.0 g/m$^2$, 2.8 g/m$^2$ and 2.3 g/m$^2$, respectively. The following compositions are presented by mass parts as solid content.

Upper Receptor Layer

| | |
|---|---|
| Vinyl chloride-series latex (trade name: Vinybran 900, manufactured by Nisshin Chemicals Co., Ltd.) | 19.0 mass parts |
| Vinyl chloride-series latex (trade name: Vinybran 276, manufactured by Nisshin Chemicals Co., Ltd.) | 3.6 mass parts |
| Gelatin (10% solution) | 2.4 mass parts |
| Ester-series wax EW-1 | 1.9 mass parts |
| Surfactant F-1 | 0.12 mass part |
| Surfactant F-2 | 0.33 mass part |

Lower Receptor Layer

| | |
|---|---|
| Vinyl chloride-series latex (trade name: Vinybran 690, manufactured by Nisshin Chemicals Co., Ltd.) | 12.0 mass parts |
| Vinyl chloride-series latex (trade name: Vinybran 900, manufactured by Nisshin Chemicals Co., Ltd.) | 12.0 mass parts |
| Gelatin (10% solution) | 7.0 mass parts |
| Surfactant F-1 | 0.04 mass part |

Heat Insulation Layer

| | |
|---|---|
| Hollow latex polymer particles (trade name: MH5055, manufactured by Nippon Zeon Co., Ltd.) | 60.0 mass parts |
| Gelatin (10% solution) | 22.0 mass parts |

Subbing Layer

| | |
|---|---|
| Polyvinyl alcohol (trade name: POVAL PVA 205, manufactured by Kuraray) | 7.7 mass parts |
| Styrene butadiene rubber latex (trade name: SN-307, manufactured by NIPPON A & L INC) | 60.0 mass parts |
| Surfactant F-1 | 0.03 mass part |

Polyester films (104b) to (109b) each on which heat-resistant lubricating layer was formed were prepared in the same manner as the polyester films (101b) to (103b) each on which heat-resistant lubricating layer was formed, except that the kind of phosphoric acid ester was each changed as described below.

In the polyester films (104b) to (106b) each on which heat-resistant lubricating layer was formed, Phoslex A-18 (trade name, a mixture of mono- and di-stearyl phosphates having a melting point of 62° C., manufactured by Sakai Chemical Industry Co., Ltd.) was each used as a phosphoric acid ester.

In the polyester films (107b) to (109b) each on which heat-resistant lubricating layer was formed, PLYSURF A 208N (trade name, a mixture of mono- and di-polyoxyalkylenealkyl ether phosphates having a melting point of −2° C., manufactured by DAI-ICHI KOGYO SEIYAKU CO., LTD.) was each used as a phosphoric acid ester. Herein, these melting points are values obtained by differential scanning calorimeter (DSC) measurement.

(Characteristic X-Ray Intensity Measurement and Calculation)

With respect to the polyester films (101b) to (109b) each on which heat-resistant lubricating layer was formed, measurement of characteristic X-ray intensity and calculation were carried out in the same manner as Example 1-1.

The compositions of these heat-resistant lubricating layers, dispersion conditions, and the values obtained by the measurement of characteristic X-ray intensity and calculation are shown in Table 13.

TABLE 13

| Polyester film No. for providing heat-resistant lubricating layer | Kind of phosphoric acid ester | Zinc stearate | Distribution condition | Largest value/ Smallest value | Variation coefficient |
|---|---|---|---|---|---|
| 101b | Tris (m-cresyl) phosphate (melting point: 26° C.) | contained | Condition 1-1 | 2.2 | 0.15 |
| 102b | | | Condition 1-2 | 3.5 | 0.33 |
| 103b | | | Condition 1-3 | 3.1 | 0.34 |
| 104b | Mixture of mono- and di-stearyl phosphates | contained | Condition 1-1 | 8.2 | 0.27 |
| 105b | (melting point: 62° C.) | | Condition 1-2 | 3.5 | 0.21 |
| 106b | | | Condition 1-3 | 3.2 | 0.18 |
| 107b | Mixture of mono- and di-polyoxy alkylenealkyl | contained | Condition 1-1 | 3.3 | 0.29 |
| 108b | ether phosphates | | Condition 1-2 | 2.9 | 0.21 |
| 109b | (melting point: −2° C.) | | Condition 1-3 | 3.1 | 0.25 |

From Table 13, it was shown that, with respect to each of the samples (the polyester films each on which heat-resistant lubricating layer was formed) (101b) to (103b) in which the employed phosphoric acid ester was only phosphoric acid ester having no OH group that is outside of the scope of the present invention, the distributed state of phosphoric acid ester in the heat-resistant lubricating layer was not able to be adjusted to the range of the present invention, even though the distribution condition was changed. As a result of consideration of their distribution condition among the samples (104b) to (109b) in which the employed phosphoric acid ester was a phosphoric acid ester having an OH group(s), the distributed state of phosphoric acid ester in the heat-resistant lubricating layer of each of the samples (105b), (106b), (108b) and (109b) was able to be adjusted to the range of the present invention. Further, the distribution condition whereby the distributed state of phosphoric acid ester in the heat-resistant lubricating layer can be adjusted to a more preferable range of the present invention varies depending on the kind of phosphoric acid ester that was used in the heat-resistant lubricating layer. For this reason, it was also understood that the distribution condition was not able to be arbitrarily defined.

Heat-sensitive transfer sheets (201b) to (709b) were prepared in the same manner as the heat-sensitive transfer sheet (101b), except that the kind of dye and the dye mixture ratio in the dye layer were each changed as shown in Table 14.

Heat-sensitive transfer sheets (201b) to (709b) were prepared in the same manner as the heat-sensitive transfer sheet (101b), except that the polyester films each on which heat-resistant lubricating layer was formed were each changed as shown in Table 14.

TABLE 14

| Heat-sensitive transfer sheet No. | Polyester film No. for providing heat-resistant lubricating layer | Kind of dye A | B | C | Blending ratio of dye (Mass ratio) A/B/C | Ratio of dye to binder |
|---|---|---|---|---|---|---|
| 101b | 101b | 1-1 | D.V.26 | D.R.60 | 10/45/45 | 1.2 |
| 102b | 102b | 1-1 | D.V.26 | D.R.60 | 10/45/45 | 1.2 |
| 103b | 103b | 1-1 | D.V.26 | D.R.60 | 10/45/45 | 1.2 |
| 104b | 104b | 1-1 | D.V.26 | D.R.60 | 10/45/45 | 1.2 |
| 105b | 105b | 1-1 | D.V.26 | D.R.60 | 10/45/45 | 1.2 |
| 106b | 106b | 1-1 | D.V.26 | D.R.60 | 10/45/45 | 1.2 |
| 107b | 107b | 1-1 | D.V.26 | D.R.60 | 10/45/45 | 1.2 |
| 108b | 108b | 1-1 | D.V.26 | D.R.60 | 10/45/45 | 1.2 |
| 109b | 109b | 1-1 | D.V.26 | D.R.60 | 10/45/45 | 1.2 |
| 201b | 101b | None | D.V.26 | D.R.60 | 0/50/50 | 1.2 |
| 202b | 102b | None | D.V.26 | D.R.60 | 0/50/50 | 1.2 |
| 203b | 103b | None | D.V.26 | D.R.60 | 0/50/50 | 1.2 |
| 204b | 104b | None | D.V.26 | D.R.60 | 0/50/50 | 1.2 |
| 205b | 105b | None | D.V.26 | D.R.60 | 0/50/50 | 1.2 |
| 206b | 106b | None | D.V.26 | D.R.60 | 0/50/50 | 1.2 |
| 207b | 107b | None | D.V.26 | D.R.60 | 0/50/50 | 1.2 |
| 208b | 108b | None | D.V.26 | D.R.60 | 0/50/50 | 1.2 |
| 209b | 109b | None | D.V.26 | D.R.60 | 0/50/50 | 1.2 |
| 301b | 101b | None | D.V.26 | D.R.60 | 0/50/50 | 1.6 |
| 302b | 102b | None | D.V.26 | D.R.60 | 0/50/50 | 1.6 |
| 303b | 103b | None | D.V.26 | D.R.60 | 0/50/50 | 1.6 |
| 304b | 104b | None | D.V.26 | D.R.60 | 0/50/50 | 1.6 |
| 305b | 105b | None | D.V.26 | D.R.60 | 0/50/50 | 1.6 |
| 306b | 106b | None | D.V.26 | D.R.60 | 0/50/50 | 1.6 |
| 307b | 107b | None | D.V.26 | D.R.60 | 0/50/50 | 1.6 |
| 308b | 108b | None | D.V.26 | D.R.60 | 0/50/50 | 1.6 |
| 309b | 109b | None | D.V.26 | D.R.60 | 0/50/50 | 1.6 |
| 401b | 101b | 1-1 | D.V.26 | D.R.60 | 20/40/40 | 1.2 |
| 402b | 102b | 1-1 | D.V.26 | D.R.60 | 20/40/40 | 1.2 |
| 403b | 103b | 1-1 | D.V.26 | D.R.60 | 20/40/40 | 1.2 |
| 404b | 104b | 1-1 | D.V.26 | D.R.60 | 20/40/40 | 1.2 |
| 405b | 105b | 1-1 | D.V.26 | D.R.60 | 20/40/40 | 1.2 |
| 406b | 106b | 1-1 | D.V.26 | D.R.60 | 20/40/40 | 1.2 |
| 407b | 107b | 1-1 | D.V.26 | D.R.60 | 20/40/40 | 1.2 |
| 408b | 108b | 1-1 | D.V.26 | D.R.60 | 20/40/40 | 1.2 |
| 409b | 109b | 1-1 | D.V.26 | D.R.60 | 20/40/40 | 1.2 |
| 501b | 101b | 1-1 | D.V.26 | D.R.60 | 30/35/35 | 1.2 |
| 502b | 102b | 1-1 | D.V.26 | D.R.60 | 30/35/35 | 1.2 |
| 503b | 103b | 1-1 | D.V.26 | D.R.60 | 30/35/35 | 1.2 |
| 504b | 104b | 1-1 | D.V.26 | D.R.60 | 30/35/35 | 1.2 |
| 505b | 105b | 1-1 | D.V.26 | D.R.60 | 30/35/35 | 1.2 |
| 506b | 106b | 1-1 | D.V.26 | D.R.60 | 30/35/35 | 1.2 |
| 507b | 107b | 1-1 | D.V.26 | D.R.60 | 30/35/35 | 1.2 |
| 508b | 108b | 1-1 | D.V.26 | D.R.60 | 30/35/35 | 1.2 |
| 509b | 109b | 1-1 | D.V.26 | D.R.60 | 30/35/35 | 1.2 |
| 601b | 101b | 1-1 | D.V.26 | D.R.60 | 80/10/10 | 1.2 |
| 602b | 102b | 1-1 | D.V.26 | D.R.60 | 80/10/10 | 1.2 |
| 603b | 103b | 1-1 | D.V.26 | D.R.60 | 80/10/10 | 1.2 |
| 604b | 104b | 1-1 | D.V.26 | D.R.60 | 80/10/10 | 1.2 |
| 605b | 105b | 1-1 | D.V.26 | D.R.60 | 80/10/10 | 1.2 |
| 606b | 106b | 1-1 | D.V.26 | D.R.60 | 80/10/10 | 1.2 |
| 607b | 107b | 1-1 | D.V.26 | D.R.60 | 80/10/10 | 1.2 |
| 608b | 108b | 1-1 | D.V.26 | D.R.60 | 80/10/10 | 1.2 |
| 609b | 109b | 1-1 | D.V.26 | D.R.60 | 80/10/10 | 1.2 |
| 701b | 101b | 1-3 | D.V.26 | D.R.60 | 80/10/10 | 1.2 |
| 702b | 102b | 1-3 | D.V.26 | D.R.60 | 80/10/10 | 1.2 |
| 703b | 103b | 1-3 | D.V.26 | D.R.60 | 80/10/10 | 1.2 |
| 704b | 104b | 1-3 | D.V.26 | D.R.60 | 80/10/10 | 1.2 |
| 705b | 105b | 1-3 | D.V.26 | D.R.60 | 80/10/10 | 1.2 |
| 706b | 106b | 1-3 | D.V.26 | D.R.60 | 80/10/10 | 1.2 |
| 707b | 107b | 1-3 | D.V.26 | D.R.60 | 80/10/10 | 1.2 |
| 708b | 108b | 1-3 | D.V.26 | D.R.60 | 80/10/10 | 1.2 |
| 709b | 109b | 1-3 | D.V.26 | D.R.60 | 80/10/10 | 1.2 |

(Solid Image Formation, Measurement of Print Density)

Using the heat-sensitive transfer sheets described in the above Table 14 and a heat-sensitive transfer image-receiving sheet, a magenta solid image print was produced under the environment of 25° C. and 50% relative humidity. Print was performed under the conditions of print resolution: 300 dpi; each of yellow, magenta and cyan recording energy: 1.9 J/cm$^2$ and line speed: 1.3 msec/line, as well as recording energy: 2.0 J/cm$^2$ and line speed: 0.7 msec/line. The highest achieving temperature of TPH was 410° C. As for measurement of a print density, 30 points of magenta densities were measured using X-rite 530 LP (trade name, manufacture by X-rite Corporation) and averaged. The higher magenta density indicates that higher quality image was obtained.

(Evaluation of Scumming Owing to Kickback)

The heat-sensitive transfer sheets described in the above Table 14 were superimposed on with each other so that the dye layer and the heat-resistant lubricating layer contacted each other and then stored for 30 days under the environments of 35° C. and 80% relative humidity, while applying a load of 40 gf/cm$^2$. The heat-resistant lubricating layer after the passage of 30 days and a transferable protective layer laminate were superimposed on with each other so that these layers contacted each other, and then stored for 30 days under the environment of 40° C. and 60% relative humidity. Thereafter, white solid image print was produced. 30 points of magenta densities were measured using X-rite 530 LP (trade name, manufacture by X-rite Corporation) and averaged. A difference between the thus-obtained average magenta density and the density of white solid image produced using an unstained heat-sensitive transfer sheet was obtained. This difference was used as a measure of evaluation of scumming. The less difference indicates that the kickback was more suppressed. Specifically, when the value of scumming was 0.01 or less, there was no problem with image appreciation, and in contrast, when the value of scumming was more than 0.01, there was a visual problem with image appreciation.

The evaluation results are shown in Table 15 described below.

TABLE 15

| Heat-sensitive transfer sheet No. | Print density | Scumming |
|---|---|---|
| 101b | 1.71 | 0.007 |
| 102b | 1.72 | 0.006 |
| 103b | 1.70 | 0.007 |
| 104b | 1.69 | 0.007 |
| 105b | 1.66 | 0.004 |
| 106b | 1.71 | 0.005 |
| 107b | 1.70 | 0.008 |
| 108b | 1.69 | 0.005 |
| 109b | 1.69 | 0.004 |
| 201b | 1.61 | 0.007 |
| 202b | 1.62 | 0.007 |
| 203b | 1.61 | 0.006 |
| 204b | 1.60 | 0.006 |
| 205b | 1.59 | 0.007 |
| 206b | 1.61 | 0.005 |
| 207b | 1.62 | 0.007 |
| 208b | 1.61 | 0.006 |
| 209b | 1.61 | 0.006 |
| 301b | 2.12 | 0.022 |
| 302b | 2.11 | 0.034 |
| 303b | 2.14 | 0.025 |
| 304b | 2.11 | 0.028 |
| 305b | 2.13 | 0.022 |
| 306b | 2.12 | 0.030 |
| 307b | 2.11 | 0.031 |
| 308b | 2.13 | 0.028 |
| 309b | 2.11 | 0.018 |
| 401b | 1.92 | 0.021 |
| 402b | 1.93 | 0.016 |
| 403b | 1.97 | 0.018 |
| 404b | 1.99 | 0.018 |
| 405b | 1.91 | 0.005 |
| 406b | 1.94 | 0.002 |
| 407b | 1.96 | 0.018 |
| 408b | 1.94 | 0.008 |
| 409b | 1.95 | 0.007 |
| 501b | 2.12 | 0.020 |
| 502b | 2.08 | 0.022 |
| 503b | 2.11 | 0.018 |
| 504b | 2.09 | 0.021 |
| 505b | 2.11 | 0.004 |
| 506b | 2.13 | 0.003 |
| 507b | 2.09 | 0.018 |
| 508b | 2.14 | 0.007 |

TABLE 15-continued

| Heat-sensitive transfer sheet No. | Print density | Scumming |
|---|---|---|
| 509b | 2.08 | 0.008 |
| 601b | 2.30 | 0.020 |
| 602b | 2.31 | 0.022 |
| 603b | 2.33 | 0.022 |
| 604b | 2.28 | 0.018 |
| 605b | 2.24 | 0.004 |
| 606b | 2.26 | 0.003 |
| 607b | 2.28 | 0.019 |
| 608b | 2.21 | 0.007 |
| 609b | 2.32 | 0.007 |
| 701b | 2.41 | 0.018 |
| 702b | 2.41 | 0.020 |
| 703b | 2.42 | 0.022 |
| 704b | 2.43 | 0.024 |
| 705b | 2.39 | 0.004 |
| 706b | 2.41 | 0.003 |
| 707b | 2.39 | 0.018 |
| 708b | 2.37 | 0.008 |
| 709b | 2.35 | 0.007 |

From Table 15, it was shown that high print density was achieved and also kickback was conspicuously improved in the heat-sensitive transfer sheets in the scope of the present invention.

Example 3-2

Production of Heat-Sensitive Transfer Sheet (801b)

Heat-sensitive transfer sheet (801b) was prepared in the same manner as the heat-sensitive transfer sheet (606b) in Example 3-1, except that zinc stearate contained in a dispersion liquid for heat-resistant lubricating layer was omitted from the dispersion liquid, and further the dispersion conditions were changed so as to change a distribution state of the phosphoric acid ester in the heat-resistant lubricating layer.

Production of Heat-Sensitive Transfer Sheet (802b)

Heat-sensitive transfer sheet (802b) was prepared in the same manner as the heat-sensitive transfer sheet (801b), except that 3.5 parts by mass of a mixture of mono- and di-stearyl phosphates (melting point: 62° C.) in a dispersion liquid for heat-resistant lubricating layer was replaced by 3.5 parts by mass of a mono- and di-stearylzinc phosphates (melting point: 190° C.), and further 0.5 parts by mass of zinc stearate was used.

Production of Heat-Sensitive Transfer Sheet (803b)

Heat-sensitive transfer sheet (803b) was prepared in the same manner as the heat-sensitive transfer sheet (801b), except that 3.5 parts by mass of a mixture of mono- and di-stearyl phosphates (melting point: 62° C.) in a dispersion liquid for heat-resistant lubricating layer was replaced by 0.5 part by mass of the mixture of mono-and di-stearyl phosphates, and 3.0 parts by mass of a mono- and di-stearylzinc phosphates (melting point: 190° C.), and further 0.5 part by mass of zinc stearate was used.

With respect to the heat-sensitive transfer sheets (801b) to (803b) prepared above, measurement of characteristic X-ray intensity and calculation were carried out in the same manner as Example 3-1. The compositions of heat-resistant lubricating layers of these heat-sensitive transfer sheets and the values obtained by the measurement of characteristic X-ray intensity and calculation are shown together with the results of the heat-sensitive transfer sheet (606b) in Example 3-1 in Table 16.

TABLE 16

| Heat-sensitive transfer sheet No. | Kind of phosphoric acid ester | Zinc stearate | Largest value/ Smallest value | Variation coefficient |
|---|---|---|---|---|
| 606b | Mixture of mono- and di-stearyl phosphates (melting point: 62° C.) | contained | 3.2 | 0.18 |
| 801b | Mixture of mono- and di-stearyl phosphates (melting point: 62° C.) | not contained | 2.8 | 0.24 |
| 802b | Mixture of mono- and di-stearylzinc phosphates (melting point: 190° C.) | contained | 2.7 | 0.22 |
| 803b | Mixture of mono-and di-stearyl phosphates (melting point: 62° C.), and Mixture of mono- and di-stearylzinc phosphates (melting point: 190° C.) | contained | 3.2 | 0.18 |

(Formation, Measurement and Evaluation of Images)

Image formation, measurement and evaluation were carried out in the same manner as in Example 3-1, except that the print condition of the thermal transfer-type print was changed from recording energy of 1.9 J/cm$^2$ and line speed of 1.3 msec/line to recording energy of 2.1 J/cm$^2$ and line speed of 0.5 msec/line, respectively.

The evaluation results are shown in Table 17 described below.

TABLE 17

| Heat-sensitive transfer sheet No. | Print density | Scumming |
|---|---|---|
| 606b | 2.20 | 0.003 |
| 801b | 2.19 | 0.009 |
| 802b | 2.20 | 0.007 |
| 803b | 2.18 | 0.008 |

From Table 17, it was shown that each heat-sensitive transfer sheet in which phosphoric acid ester having an OH group(s) or a salt of phosphoric acid ester that was within the scope of the present invention was used enabled to adjust the distributed state of the phosphoric acid ester in the heat-resistant lubricating layer to the range within the present invention. Further, from comparison of sample (606b) and sample (801b), it was shown that occurrence of kickback was able to be more effectively suppressed by using together with zinc stearate. Further, from comparison of sample (606b), sample (802b) and sample (803b), it was shown that the sample in which the phosphoric acid ester having a melting point of 62° C. was used among the phosphoric acid esters having an OH group(s) or a salt of phosphoric acid that were within the scope of the present invention enabled to suppress more effectively occurrence of kickback.

Example 3-3

Production of Heat-Sensitive Transfer Sheets (901b) to (908b)

Heat-sensitive transfer sheet (901b) was prepared in the same manner as the heat-sensitive transfer sheet (803b) in Example 3-2, except that the composition of a dispersion liquid for a heat-resistant lubricating layer was changed so that 3.0 parts by mass of a mono- and di-stearylzinc phosphates (melting point: 190° C.) in the dispersion liquid for heat-resistant lubricating layer was replaced by 0.5 parts by mass of the mono- and di-stearylzinc phosphates, and further 2.5 parts by mass of a mixture of mono-and di-polyoxy alkylenealkyl ether phosphates (melting point: −2° C.) was used, and further the heat processing condition that performed a crosslinking reaction between isocyanate and polyol was changed to 57° C. and 1 day. Similarly, heat-sensitive transfer sheets (902b), (903b), and (904b) were each prepared in the same manner as the heat-sensitive transfer sheet (901b), except that the heat processing condition was changed to 48° C. and 7 days, 42° C. and 18 days, and 36° C. and 30 days, respectively. Further, heat-sensitive transfer sheets (905b) to (908b) were prepared in the same manner as the heat-sensitive transfer sheets (901b) to (904b), except that the polyacrylpolyol resin in a dispersion liquid for heat-resistant lubricating layer was replaced by polyvinylbutyral resin in an equivalent amount as a solid content, and further an amount of polyisocyanate in the heat-resistant-layer-coating liquid was changed so that a ratio of a reactive group of the polyisocyanate and a reactive group of the polyvinylbutyral resin in the heat-resistant-layer-coating liquid (—NCO/OH) was 1.1. The presence of an unreacted isocyanate group after a heat treatment was confirmed by IR measurement. As a result, it was confirmed that a crosslinking reaction was completed under any heat processing condition.

With respect to the heat-sensitive transfer sheets (901b) to (908b) prepared above, measurement of characteristic X-ray intensity and calculation were carried out in the same manner as Example 3-1. The resin, heat processing condition, and the values obtained by the measurement of characteristic X-ray intensity and calculation of the heat-resistant lubricating layer of these heat-sensitive transfer sheets are shown in Table 18.

TABLE 18

| Heat-sensitive transfer sheet No. | Resin | Heat processing condition | Largest value/ Smallest value | Variation coefficient |
|---|---|---|---|---|
| 901b | Polyacrylpolyol | 57° C. and 1 day | 2.9 | 0.21 |
| 902b | Polyacrylpolyol | 48° C. and 7 days | 3.2 | 0.19 |
| 903b | Polyacrylpolyol | 42° C. and 18 days | 3.6 | 0.18 |
| 904b | Polyacrylpolyol | 36° C. and 30 days | 3.3 | 0.24 |
| 905b | Polyvinylbutyral | 57° C. and 1 day | 2.7 | 0.23 |
| 906b | Polyvinylbutyral | 48° C. and 7 days | 3.1 | 0.21 |
| 907b | Polyvinylbutyral | 42° C. and 18 days | 3.2 | 0.20 |
| 908b | Polyvinylbutyral | 36° C. and 30 days | 2.8 | 0.25 |

(Formation, Measurement and Evaluation of Image)

Image formation, measurement and evaluation were carried out in the same manner as Example 3-2, except that the heat-sensitive transfer sheets (901b) to (908b) were used.

The evaluation results are shown in Table 19 described below.

TABLE 19

| Heat-sensitive transfer sheet No. | Print density | Scumming |
|---|---|---|
| 901b | 2.18 | 0.008 |
| 902b | 2.20 | 0.006 |
| 903b | 2.20 | 0.005 |
| 904b | 2.19 | 0.009 |
| 905b | 2.16 | 0.010 |
| 906b | 2.19 | 0.008 |
| 907b | 2.18 | 0.007 |
| 908b | 2.16 | 0.011 |

From Table 19, it was shown that samples (heat-sensitive transfer sheets) (901b) to (908b) were within the scope of the present invention, and print density of the heat-sensitive transfer sheet was made higher and also kickback was more improved by changing a heat processing condition to the range of temperature of 40° C. to 53° C. and time period of 1 day to 20 day, and effects of the present invention were more effectively enhanced by using polyacrylpolyol as a resin of the heat-resistant lubricating layer.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-254800 filed in Japan on Sep. 30, 2008, Patent Application No. 2008-254801 filed in Japan on Sep. 30, 2008, and Patent Application No. 2008-254803 filed in Japan on Sep. 30, 2008, which are entirely herein incorporated by reference.

What we claim is:

1. A heat-sensitive transfer sheet, comprising:

a base film;

at least one dye layer containing at least one heat-transferable dye and a resin formed on one side of the base film; and a heat-resistant lubricating layer containing a lubricant and a resin formed on the other side of the base film;

wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

2. The heat-sensitive transfer sheet according to claim 1, wherein at least one of said at least one dye layer is a yellow dye layer containing at least one yellow dye as the heat-transferable dye, and wherein at least one of said at least one yellow dye is represented by formula (1):

Formula (1)

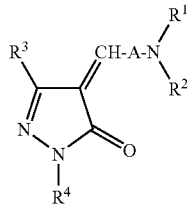

wherein A represents a substituted or unsubstituted arylene group; $R^1$ and $R^2$ each independently represent a hydrogen atom, a substituted or unsubstituted alkyl group, a substituted or unsubstituted alkenyl group, or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group, or a substituted or unsubstituted aryl group.

3. The heat-sensitive transfer sheet according to claim 1, wherein at least one of said at least one dye layer contains at least one heat-transferable dye represented by formula (2), and wherein the content of said at least one heat-transferable dye represented by formula (2) is 20% by mass or more of the total amount of the dyes in the layer:

Formula (2)

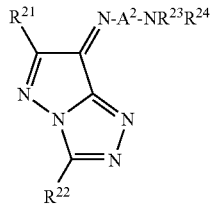

wherein $A^2$ represents a substituted or unsubstituted arylene group, or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group.

4. The heat-sensitive transfer sheet according to claim 1, wherein the ratio of the largest value to the smallest value of the characteristic X-ray intensity is at least 3 times or more, and the coefficient of variation is 0.22 or less.

5. The heat-sensitive transfer sheet according to claim 1, wherein the melting point of at least one of the compounds represented by formula (P) contained in the heat-resistant lubricating layer is 40° C. to 100° C.

6. The heat-sensitive transfer sheet according to claim 1, comprising a multivalent metal salt of alkyl carboxylic acid in the heat-resistant lubricating layer.

7. The heat-sensitive transfer sheet according to claim 1, comprising talc particles in the heat-resistant lubricating layer.

8. The heat-sensitive transfer sheet according to claim 7, wherein the relationship between the content of the talc particles and the content of the compound represented by formula (P) is such the proportion that the content of the talc particles is 30 parts by mass or more, provided that the content of the compound represented by formula (P) is 100 parts by mass.

9. The heat-sensitive transfer sheet according to claim 1, comprising an easy adhesion layer on at least one surface of the base film.

10. The heat-sensitive transfer sheet according to claim 1, wherein the resin in the heat-resistant lubricating layer comprises two or more hydroxyl group at the end of polymer chain length of the resin or in a polymer structure of the resin.

11. The heat-sensitive transfer sheet according to claim 10, wherein the resin is a polyacrylpolyol resin.

12. The heat-sensitive transfer sheet according to claim 10, wherein the resin in the heat-resistant lubricating layer comprises cross-linking structure.

13. The heat-sensitive transfer sheet according to claim 12, wherein a crosslinking reaction for constructing the cross-linking structure of the resin is carried out in the temperature range from 40° C. to 53° C. and for a period from 1 day to 20 days.

14. The heat-sensitive transfer sheet according to claim 1, wherein the heat-sensitive transfer sheet is used in combination with a heat-transfer image receiving sheet comprising a support and a heat insulation layer containing hollow latex polymeric particles and a receptor layer containing a latex polymer disposed on the support.

15. A method of forming an image, comprising the steps of:

superposing a heat-sensitive transfer sheet on a heat-transfer image receiving sheet; and applying thermal energy from a side of a heat-resistant lubricating layer described below of the heat-sensitive transfer sheet in accordance with an image signal, to form a thermally transferred image, wherein the heat-sensitive transfer sheet comprises a base film, at least one dye layer containing at least one heat-transferable dye and a resin formed on one side of the base film, and a heat-resistant lubricating layer containing a lubricant and a resin formed on the other side of the base film, wherein the heat-sensitive transfer image-receiving sheet comprises a support, and a heat insulation layer containing hollow polymeric latex particles, and a receptor layer containing a latex polymer on the support, wherein, in the superposing step, said at least one dye layer of the heat-sensitive transfer sheet is contact with the receptor layer of the heat-sensitive image receiving sheet, wherein the heat-resistant lubricating layer contains a compound represented by formula (P) as the lubricant:

$$\{(R^{1a}O)(R^{2a}O)P(=O)O\}_m M \qquad \text{Formula (P)}$$

wherein M represents a hydrogen atom, a metal ion, or an ammonium ion; $R^{1a}$ represents a substituted or unsubstituted aliphatic group, or a substituted or unsubstituted aryl group; $R^{2a}$ represents a hydrogen atom, a metal ion, an ammonium ion, a substituted or unsubstituted aliphatic group, or a substituted or unsubstituted aryl group; m has the same valence as that of M and represents a number of from 1 to 6; and wherein, when a characteristic X-ray intensity originated from K-line of phosphorus element in the heat-resistant lubricating layer, which intensity is obtained by irradiating an electron beam accelerated at 20 kV and having a beam size of 1 μm or less from the heat-resistant lubricating layer side of the heat-sensitive transfer sheet, is measured with respect to each points within a 200 μm square region, using an energy-dispersive X-ray spectroscope, the largest value of the characteristic X-ray intensity is at least 2.5 times or more as large as the smallest value of the characteristic X-ray intensity within the 200 μm square region, and a plurality of maximum regions having a maximum value of the characteristic X-ray intensity originated from K-line of phosphorus element exist in the 200 μm square region, and a variation coefficient that is obtained by dividing a standard deviation of the maximum values of the characteristic X-ray intensity among these maximum regions with an average value of the characteristic X-ray intensities is 0.25 or less.

16. The method of forming an image according to claim 15, wherein at least one of said at least one dye layer is a yellow dye layer containing at least one yellow dye as the heat-transferable dye, and wherein at least one of said at least one yellow dye is represented by formula (1):

Formula (1)

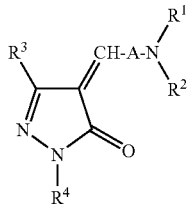

wherein A represents a substituted or unsubstituted phenylene group; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group or a substituted or unsubstituted aryl group.

17. The method of forming an image according to claim 15, wherein at least one of said at least one dye layer contains at least one heat-transferable dye represented by formula (2), and wherein the content of said at least one heat-transferable dye represented by formula (2) is 20% by mass or more of the total amount of dyes in the layer:

Formula (2)

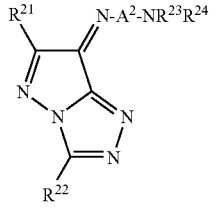

wherein $A^2$ represents a substituted or unsubstituted arylene group or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group.

* * * * *